US009670640B2

(12) United States Patent
Castonguay et al.

(10) Patent No.: US 9,670,640 B2
(45) **Date of Patent: *Jun. 6, 2017**

(54) RETAINING WALL

(71) Applicant: LES MATERIAUX DE CONSTRUCTION OLDCASTLE CANADA, INC., St-John (CA)

(72) Inventors: Bertin Castonguay, Magog (CA); Marc-Andre Lacas, Merignac (FR); Robert Daoust, Boucherville (CA)

(73) Assignee: Les materiaux de construction Oldcastle Canada, Inc., St. John, New Brunswick (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/994,953

(22) Filed: Jan. 13, 2016

(65) Prior Publication Data

US 2016/0130780 A1 May 12, 2016

Related U.S. Application Data

(63) Continuation-in-part of application No. 14/625,107, filed on Feb. 18, 2015, now Pat. No. 9,441,342, which (Continued)

(51) Int. Cl.
*E02D 17/18* (2006.01)
*E04B 2/34* (2006.01)

(Continued)

(52) U.S. Cl.
CPC ..... *E02D 29/025* (2013.01); *E02D 29/0225* (2013.01); *E02D 29/0233* (2013.01);

(Continued)

(58) Field of Classification Search
CPC .... E04B 2/8635; E04B 2/8617; E04B 2/8641; E04B 2001/61; E04B 2002/86;

(Continued)

(56) References Cited

U.S. PATENT DOCUMENTS 738,643 A 9/1903 Van Camp
791,291 A 5/1905 Roberts (Continued)

FOREIGN PATENT DOCUMENTS

CA 2258637 A1 8/1999
CA 2367664 A1 11/2000

(Continued)

OTHER PUBLICATIONS

International Application No. PCT/CA2014/050129, International Search Report and Written Opinion dated May 8, 2014.

(Continued)

*Primary Examiner* — Christine T Cajilig
(74) *Attorney, Agent, or Firm* — Borden Ladner Gervais LLP

(57) ABSTRACT

Disclosed is an economical and effective way of producing a modular retaining wall for a material to be retained, using backer blocks and facing blocks which are stacked into continuous front and back wall components connected by separate connectors in a back to back, spaced apart arrangement, thereby forming a hollow retaining wall. The hollow wall is filled with loose filler material to increase the mass and retaining capacity of the wall. None of the wall components is embedded in the material to be retained. The facing blocks, connectors and filler material are all separated from the material to be retained by the backer blocks. Further disclosed are wall components and a wall kit for a modular retaining wall. A double sided decorative wall is also disclosed. The modular wall system allows for the construction both straight and curved retaining walls.

15 Claims, 47 Drawing Sheets

Related U.S. Application Data is a continuation of application No. 13/247,633, filed on Sep. 28, 2011, now Pat. No. 8,992,131.

(60) Provisional application No. 61/387,222, filed on Sep. 28, 2010, provisional application No. 61/420,890, filed on Dec. 8, 2010.

(51) Int. Cl.

| | |
|---|---|
| ***E04G 21/14*** | (2006.01) |
| ***E02D 29/02*** | (2006.01) |
| ***E04C 1/39*** | (2006.01) |
| *E04B 2/86* | (2006.01) |
| *E04B 2/02* | (2006.01) |
| *E04B 2/84* | (2006.01) |

(52) U.S. Cl.

CPC ..... *E04C 1/395* (2013.01); *E04B 2/84* (2013.01); *E04B 2/8641* (2013.01); *E04B 2002/0239* (2013.01); *E04B 2002/0247* (2013.01); *E04B 2002/0265* (2013.01); *E04B 2002/867* (2013.01); *E04B 2002/8676* (2013.01)

(58) Field of Classification Search

CPC ..... E02D 29/025; E02D 29/0225; E02D 29/0233; E04G 17/0721

See application file for complete search history.

(56) References Cited

U.S. PATENT DOCUMENTS 1,033,988 A 7/1912 Coburn
1,214,964 A 2/1917 Small
1,226,214 A * 5/1917 Hopkins ..... 52/421
1,345,156 A * 6/1920 Flynn ..... E04B 2/8641 29/433
1,472,917 A 11/1923 Laird
1,567,085 A 12/1925 Rowland
1,624,369 A 4/1927 Serra
1,907,053 A 5/1933 Flath
1,943,800 A 1/1934 Morrison
1,953,005 A 3/1934 Nagel
2,049,907 A 8/1936 Hess
2,061,822 A 11/1936 Bankert
2,225,612 A * 12/1940 Allen ..... E04F 15/04 376/459
2,392,551 A 1/1946 Roe
2,544,486 A 3/1951 Brown
2,544,488 A 3/1951 Chittenden
2,929,238 A 3/1960 Kaye
3,353,312 A 11/1967 Storch
3,391,507 A 7/1968 Downing
3,546,833 A 12/1970 Perreton
3,607,643 A 9/1971 Paget
3,609,926 A 10/1971 Muse
3,677,236 A 7/1972 Moss
3,786,605 A 1/1974 Winfrey
3,854,256 A 12/1974 Wilce
3,877,236 A 4/1975 O'Neill et al.
4,068,482 A 1/1978 Hilfiker
4,164,598 A 8/1979 Wilhelm
4,229,922 A 10/1980 Clark, Jr.
4,285,181 A 8/1981 Van Loghem et al.
4,348,847 A 9/1982 Jukes
4,391,077 A * 7/1983 Giess ..... E04B 1/6137 52/233
4,438,605 A 3/1984 DeLucia
4,442,644 A 4/1984 Jukes
4,478,021 A 10/1984 Person
4,490,075 A 12/1984 Risi et al.
4,498,266 A 2/1985 Perreton
4,532,747 A * 8/1985 Koetje ..... B63B 3/18 29/507
4,545,703 A 10/1985 Boynton
4,589,241 A 5/1986 Volpenhein
4,596,102 A 6/1986 Catani et al.
4,597,236 A * 7/1986 Braxton ..... E04B 2/18 52/564
4,655,014 A * 4/1987 Krecke ..... E04B 2/8641 52/105
4,700,523 A 10/1987 Kohara
4,774,791 A 10/1988 Kafarowski
4,825,619 A 5/1989 Forsberg
4,833,856 A 5/1989 Zwagerman
4,835,928 A * 6/1989 Scott ..... E04B 1/4178 52/426
4,866,891 A * 9/1989 Young ..... E04B 2/8641 52/105
4,914,887 A 4/1990 Meheen
4,949,515 A 8/1990 Krecke
4,956,949 A 9/1990 Francis
4,967,528 A 11/1990 Doran
5,033,912 A 7/1991 Vidal
5,140,794 A 8/1992 Miller
5,154,542 A 10/1992 Klenert
5,161,918 A 11/1992 Hodel
5,214,898 A 6/1993 Beretta
5,315,802 A * 5/1994 Hart ..... E04B 2/08 52/426
5,350,256 A 9/1994 Hammer
5,370,480 A 12/1994 Quaney
5,403,127 A 4/1995 Knudsen
5,435,111 A 7/1995 Cox et al.
5,468,098 A 11/1995 Babcock
5,472,297 A 12/1995 Heselden
5,474,405 A 12/1995 Anderson et al.
5,489,074 A 2/1996 Arnold et al.
5,501,049 A 3/1996 Francis et al.
5,505,563 A 4/1996 Curt
5,513,475 A 5/1996 Schaaf et al.
5,570,552 A * 11/1996 Nehring ..... E02D 27/02 249/91
5,586,841 A 12/1996 Anderson et al.
5,647,166 A 7/1997 Neff
5,647,695 A 7/1997 Hilfiker et al.
5,673,530 A 10/1997 Bailey, II
5,688,078 A * 11/1997 Hammer ..... E02D 29/0266 405/262
5,707,184 A 1/1998 Anderson et al.
5,735,643 A 4/1998 Castonguay et al.
5,788,423 A 8/1998 Perkins
5,845,448 A * 12/1998 Potvin ..... E04B 2/30 52/379
5,851,088 A 12/1998 Anderson et al.
5,930,947 A 8/1999 Eckhoff
5,934,039 A 8/1999 Guy
5,957,744 A * 9/1999 Mott ..... A63H 33/105 446/122
5,983,585 A * 11/1999 Spakousky ..... E04B 2/8641 52/405.1
6,024,517 A 2/2000 Castonguay et al.
6,062,772 A 5/2000 Perkins
6,176,059 B1 * 1/2001 Cantarano ..... E02D 29/0283 52/415
6,189,282 B1 2/2001 VanderWerf
6,238,144 B1 5/2001 Babcock
6,240,692 B1 6/2001 Yost et al.
6,622,445 B1 9/2003 Shillingburg et al.
6,637,167 B2 * 10/2003 Hanna ..... E04H 17/16 52/223.7
6,662,520 B1 12/2003 Nelson
6,701,687 B1 3/2004 Shillingburg
6,874,291 B1 4/2005 Weber
6,880,297 B2 4/2005 Johnston
6,912,823 B2 7/2005 MacDonald et al.
6,935,081 B2 * 8/2005 Dunn ..... E04B 2/8641 249/191
6,953,309 B1 10/2005 Tufts et al.
6,978,581 B1 * 12/2005 Spakousky ..... E04B 2/8617 52/405.1
7,198,435 B2 4/2007 Dolan et al.

(56) References Cited

U.S. PATENT DOCUMENTS

| | | | | |
|---|---|---|---|---|
| 7,410,328 | B2 * | 8/2008 | Hamel | E02D 29/0266 405/262 |
| 7,464,509 | B1 | 12/2008 | Brown | |
| 7,503,729 | B2 | 3/2009 | Hammer et al. | |
| 7,591,447 | B2 | 9/2009 | Hammer et al. | |
| 7,827,752 | B2 * | 11/2010 | Scherrer | E04B 2/8641 52/309.12 |
| 8,206,065 | B2 | 6/2012 | Heselden | |
| 8,596,926 | B2 | 12/2013 | Heselden | |
| 8,689,501 | B2 | 4/2014 | Chamoux | |
| 8,777,514 | B2 | 7/2014 | Heselden | |
| 8,851,803 | B2 | 10/2014 | Bott | |
| 8,992,131 | B2 | 3/2015 | Castonguay et al. | |
| 9,151,051 | B2 | 10/2015 | Cossette et al. | |
| 9,234,347 | B2 | 1/2016 | Cossette et al. | |
| 2001/0029717 | A1 * | 10/2001 | Spakousky | E04B 2/8617 52/405.4 |
| 2002/0124508 | A1 | 9/2002 | Dunn et al. | |
| 2003/0126821 | A1 | 7/2003 | Scherer et al. | |
| 2003/0140585 | A1 | 7/2003 | Dueck et al. | |
| 2003/0159378 | A1 | 8/2003 | Johnston | |
| 2003/0182011 | A1 | 9/2003 | Scherer | |
| 2005/0120670 | A1 | 6/2005 | Ness et al. | |
| 2006/0110223 | A1 | 5/2006 | Dawson et al. | |
| 2006/0179779 | A1 | 8/2006 | Ness | |
| 2007/0196184 | A1 * | 8/2007 | Hammer | E02D 29/0225 405/284 |
| 2007/0266656 | A1 | 11/2007 | Blocken | |
| 2008/0057801 | A1 * | 3/2008 | Duffy | E04B 2/8652 439/894 |
| 2008/0236084 | A1 * | 10/2008 | Pontarolo | E04B 2/8647 52/426 |
| 2009/0013629 | A1 * | 1/2009 | Boeshart | E04B 2/8617 52/426 |
| 2009/0041552 | A1 * | 2/2009 | Hammer | E02D 29/0225 405/284 |
| 2009/0308011 | A1 * | 12/2009 | Philippe | E04B 2/8635 52/426 |
| 2011/0217127 | A1 | 9/2011 | MacDonald | |
| 2012/0060438 | A1 | 3/2012 | Jensen | |
| 2012/0117904 | A1 | 5/2012 | Bouchard et al. | |
| 2013/0081353 | A1 | 4/2013 | Jensen | |
| 2014/0215949 | A1 | 8/2014 | Cossette et al. | |
| 2015/0218806 | A1 | 8/2015 | Cossette et al. | |
| 2016/0024786 | A1 | 1/2016 | Castonguay et al. | |
| 2016/0186433 | A1 | 6/2016 | Cossette et al. | |

FOREIGN PATENT DOCUMENTS

| | | | | |
|---|---|---|---|---|
| CA | 2447646 | A1 | 11/2002 | |
| CA | 2485870 | A1 | 11/2003 | |
| CA | 2544152 | A1 | 10/2006 | |
| CA | 2550359 | A1 | 12/2007 | |
| CN | 2353796 | | 12/1999 | |
| DE | 2549162 | A1 | 5/1977 | |
| DE | 4134439 | A1 * | 4/1993 | E04B 2/8635 |
| DE | 10110798 | A1 | 2/2002 | |
| DE | 202008012263 | | 1/2009 | |
| FR | 2583808 | A1 | 12/1986 | |
| FR | 2740488 | A1 | 4/1997 | |
| JP | 58156637 | | 9/1983 | |
| JP | 58156637 | A * | 9/1983 | |
| KR | 1020110011074 | | 2/2011 | |
| NL | 1024629 | A1 | 12/2003 | |
| WO | 2008092237 | A1 | 8/2008 | |

OTHER PUBLICATIONS

Canadian Patent Application No. 2,676,369, Office Action dated Nov. 28, 2013.
International Application No. PCT/CA2007/002351, International Search Report and Written Opinion dated Apr. 1, 2008.
International Application No. PCT/CA2011/050608, International Search Report and Written Opinion dated Nov. 4, 2011.
U.S. Appl. No. 12/752,766, Office Action dated Jul. 18, 2013.
U.S. Appl. No. 12/525,491, Office Action dated Apr. 21, 2014.
U.S. Appl. No. 12/752,766, Office Action dated Jan. 18, 2013.
U.S. Appl. No. 12/525,491, Office Action dated Mar. 6, 2013.
U.S. Appl. No. 12/525,491 Office Action dated Jul. 19, 2011.
U.S. Appl. No. 12/525,491, Office Action dated Aug. 29, 2013.
U.S. Appl. No. 12/525,491, Office Action dated Dec. 22, 2011.
U.S. Appl. No. 12/752,766, Office Action dated Apr. 25, 2012.
U.S. Appl. No. 13/247,633, Office Action dated Jan. 13, 2014.
U.S. Appl. No. 13/247,633, Office Action dated Mar. 20, 2013.
U.S. Appl. No. 13/247,633, Office Action Aug. 7, 2014.
Australian Patent Application No. 2011307995, Office Action dated Dec. 9, 2014.
U.S. Appl. No. 14/188,214, Restriction Requirement dated Jan. 12, 2015.
U.S. Appl. No. 13/247,633, Notice of Allowance dated Nov. 18, 2014.
U.S. Appl. No. 14/188,214, Office Action dated May 6, 2015.
U.S. Appl. No. 12/752,766, Notice of Allowance dated Jul. 31, 2015.
U.S. Appl. No. 12/525,491, Office Action dated Jul. 5, 2011.
U.S. Appl. No. 14/625,107, Notice of Allowance dated May 4, 2016.
Australian Patent Application No. 2011307995, Examination Report dated Feb. 24, 2016.
International Preliminary Report on Patentability for Application No. PCT/CA2007/002351, mailed on Aug. 4, 2009, 7 pages.
International Preliminary Report on Patentability for Application No. PCT/CA2011/050608, mailed on Apr. 2, 2013, 5 pages.
International Preliminary Report on Patentability for Application No. PCT/CA2014/050129, mailed on Aug. 25, 2015, 6 pages.
Supplementary European Search Report for Application No. EP07855631, mailed on Oct. 2, 2015, 6 Pages.
United States Office Action dated Nov. 6, 2014, U.S. Appl. No. 12/752,766.
U.S. Appl. No. 14/625,107, Supplemental Notice of Allowability dated Jul. 8, 2016.
U.S. Appl. No. 14/625,107, Office Action dated Feb. 10, 2016.
U.S. Appl. No. 14/625,107, Office Action dated Jun. 10, 2015.
U.S. Appl. No. 15/216,219, Office Action dated Nov. 1, 2016, 13 pages.
European Application No. 14754912.5, Extended European Search Report dated Nov. 10, 2016, 7 pages.
U.S. Appl. No. 14/876,871 Notice of Allowance dated Jun. 10, 2016.
U.S. Appl. No. 15/267,719, Office action dated Feb. 8, 2017.
U.S. Appl. No. 15/216,219, Office Action dated Apr. 13, 2017.

* cited by examiner

RETAINING WALL

CROSS REFERENCE TO RELATED APPLICATIONS

This application is a continuation in part of U.S. patent application Ser. No. 14/625,107 filed Feb. 18, 2015, which claims the benefit of U.S. patent application Ser. No. 13/247,633 filed Sep. 28, 2011, which claims the benefit of U.S. Provisional Patent Application No. 61/387,222 filed Sep. 28, 2010, and U.S. Patent Application No. 61/420,890, filed Dec. 8, 2010, all of which are hereby incorporated by reference in their entirety.

FIELD OF THE INVENTION

The present invention is generally directed toward retaining walls, in particular modular retaining walls, and to components of such walls.

BACKGROUND OF THE INVENTION

Retaining walls are used in landscaping around residential or commercial buildings. Retaining walls can be made of various materials, but for reasons of durability are most often either concrete structures cast in situ or walls formed of stacked courses of natural stone or masonry blocks. Concrete masonry blocks have become the most popular retaining wall components, due to their ease of manufacture, transport and handling. The blocks are stacked either manually or with the aid of machinery.

Conventional concrete masonry blocks are either wet cast or dry cast. In the dry cast process, a concrete mixture is filled into a mold box and compressed to generate a pre-consolidated block. This pre-block is removed from the mold box and transported to a setting location at which the block is stored for setting of the concrete mixture. Several methods have been developed to provide hollow dry cast blocks with a textured front surface. Molding a slab including several blocks and subsequently braking the slab into individual blocks allows for the creation of an irregular, rough front surface similar to the surface of a split natural stone. Such blocks are generally referred to as split face or hardsplit blocks. Alternatively, the smooth front surface of a finished molded block can be subjected to a percussive treatment, which brakes up and roughens the front surface. Finally, a three dimensional surface structure can be embossed into the front surface of the block during compression of the concrete mixture in the mold.

A retaining wall is also known from WO2008092237, which system includes base or wall blocks forming the actual retaining wall and decorative facing blocks or panels, which are mounted onto the wall blocks to form a decorative facing on the retaining wall. In that system, the wall blocks are of sufficient size and mass to perform the retaining function. They may even be able to support the facing blocks or panels. Although that system is very flexible, since the retaining wall can be provided with many different facing surfaces, which can even be exchanged without dismantling the wall, the base blocks suffer from the same drawbacks as other known retaining wall blocks.

The performance of retaining walls or freestanding walls is generally determined by the height of the wall, the overall mass of the wall and the width or thickness of the wall at the base, with the mass being the most critical. Local building code requirements dictate the forces such walls must be able to withstand, which in turn limit the design possibilities in terms of maximum wall heights for a given width and mass of a wall. Generally, the larger the mass and the width of the wall at the base, the base width, the higher the retaining capacity or resistance to tipping of the wall. More generally, the higher the mass, the higher the retaining capacity of the wall. This must be taken into consideration when building retaining walls of stacked blocks. In a conventional retaining wall of monolithic, stacked blocks, the wall blocks themselves must have a sufficient width to provide the minimum base width and mass required for the retaining wall. This in turn limits the maximum length and height of retaining wall blocks useful for manual installation. It also limits the overall retaining capacity achievable with conventional, manually installed, stacked block walls. As a result, retaining walls of higher retaining capacity are either cast in situ or made of large blocks which must be handled with often specialized machinery. The exposed length and height of an installed retaining wall block are normally referred to as the length and height of the block, while the remaining dimension of the block is referred to as the width of the block. To address the problem of excessive weight of conventional retaining wall blocks, hollow retaining wall blocks have been developed in an effort to reduce block weight and to thereby expand the size range of manually installed blocks. However, using hollow blocks reduces the overall mass of the stacked retaining wall and, thus, limits the retaining capacity of the wall achievable with hollow blocks. Thus, the height and retaining capacity of retaining walls made of conventional monolithic blocks for manual installation is limited, even if the blocks are sized for maximum retaining performance (optimum width) and maximum coverage (maximum length and/or height).

Conventional retaining wall blocks are often tapered towards the back to allow a curved placement of the blocks for the assembly of curved walls. In walls with convex curvature, the blocks then touch at the tapered sides, while in a straight line installation or in walls of concave curvature the blocks only touch at their front edges and comparatively large triangular gaps or spaces are defined between the blocks at the back. Those gaps are disadvantageous, since they reduce the overall mass of the wall and therefore the retaining capacity of the wall.

Modular retaining wall systems made of interconnected facing blocks and buried, spaced apart backer blocks are known from U.S. Pat. Nos. 4,068,482, 5,350,256, 5,468,098, 5,688,078, 7,503,729, 7,410,328 and US2009/0041552. In those conventional retaining walls, the wall of stacked facing blocks principally function as the principle material retaining component of the retaining wall, while the backer blocks have an anchoring function to reduce the tendency for tipping of the wall. The backer blocks are generally spaced apart and buried within the material to be retained and, thus, cannot contribute to the mass of the retaining wall.

Retaining wall systems including stacked blocks with interlocking projections for forming a hollow wall with front and back partial walls and intermediate connectors are disclosed in U.S. Pat. Nos. 4,490,075, 5,403,127 and DE 2549162. However, the connectors in those systems interlock with the blocks in the front partial wall in such a way that the ends of the connectors/spacers between the front and back partial walls are visible in the installed condition, giving the wall an artificial rather than natural appearance.

Thus, a modular retaining wall system which overcomes at least one of these disadvantages is desired.

SUMMARY OF THE INVENTION

It is therefore one object of the invention to provide an improved modular wall system for manually installed retaining walls.

In one embodiment, the invention provides a hollow retaining wall system with an interior space filled with a fill of loose filler material, wherein none of the components of the wall, including the fill, is embedded in the material to be retained. The filler material is separated from the material to be retained by components of the retaining wall. In this embodiment, the wall system includes facing blocks to be exposed in the finished wall, backer blocks to be stacked against the material to be retained, without embedding them in the material, and connectors to create the interior space between the facing and backer blocks, for receiving the filler material. Thus, the facing blocks, connectors and fill are all separated from the material to be retained by the backer blocks, which themselves are only stacked against the material to be retained, rather than embedded therein. Although the backer blocks in this assembly do not provide any anchoring function, they, as well as all other components of the present retaining wall, including the filler material, contribute to the overall mass of the wall and, thus, to the stability and retaining capacity of the retaining wall. This allows for the assembly of a retaining wall having sufficient retaining capacity for a predetermined material to be retained at a predetermined height, without the need for any anchoring structures embedded in the material to be retained. In addition to contributing to the overall weight of the retaining wall, the fill also can be used for locking the remaining wall components in place.

This retaining wall system provides for the construction of a retaining wall having a preselected total mass per unit length. The total mass is the combined mass per unit length of the backer blocks, facing blocks, connectors and fill. The connectors connect each facing block with at least one backer block in a spaced apart back to back arrangement, the connectors having a length for forming between the front and back wall portions an intermediate hollow space for filling with a filler material of a third mass constituting at least the remainder of the total mass.

In another embodiment, a modular retaining wall system is provided for the construction of a retaining wall having a preselected height and total mass, the system including backer blocks for engagement with material to be retained; facing blocks to be exposed in the installed condition of the wall system; and connectors for connecting each facing block with at least one backer block in a spaced apart back to back arrangement, the backer blocks and facing blocks when connected by the connectors being respectively stackable into a continuous rear wall portion of the preselected height and a first mass and a continuous front wall portion of the preselected height and a second mass, a sum of the first and second mass being less than the total mass; and the connectors having a length for forming between the continuous front and back wall portions an intermediate hollow space for filling with a filler material of a third mass constituting at least the remainder of the total mass.

The backer and facing blocks are stackable into respective continuous front and rear wall portions of the retaining wall, when connected by the connectors. In one embodiment, each wall portion has an insufficient width to function as a retaining wall itself. In another embodiment, the facing and backer blocks are even of insufficient width to respectively allow stacking into a front or rear wall portion of the selected height of the retaining wall. During assembly of the wall, the intermediate space between the backer and facing blocks is filled with loose filler material, such as earth, sand gravel, crushed stone, or the like to achieve a wall of a preselected mass.

The present inventors have surprisingly discovered that a reliable and effective retaining wall structure can be constructed without embedding any wall components in the material to be retained. The inventors have discovered that such a wall can even be built using blocks, which are of insufficient width and mass to function as retaining wall or freestanding wall themselves and providing the remaining mass of the wall by way of a loose filler material contained in between front and back wall portions. Despite the filler material being loose, to enable filling of the intermediate space between the front and back wall portions, the inventors have surprisingly discovered that the finished retaining wall has the same retaining capacity as a solid wall of equal mass per unit length. The backer and facing blocks according to the invention have a small width and, thus, are much thinner and lighter than conventional retaining wall blocks of equal coverage (length X height). As a result, the wall blocks are much easier to handle and install manually. Of course, backer and facing blocks which are comparable in weight to conventional retaining wall blocks can be produced, which will then provide a much larger coverage than conventional blocks.

The present inventors have also surprisingly discovered that a reliable and effective retaining wall structure can be constructed using connectors which have structures for interlocking with the filler material, such as ridges or transverse passages. Despite the filler material being loose, the interaction between the filler material and the interlocking structures on the connectors rigidly locks the wall components in place against the lateral pressure of the material to be retained. The degree of interlocking between the connectors and the filler material can be controlled by the degree of coarseness of filler material, with the rigidity of the retaining wall increasing with the coarseness of the filler material. The inventors of the present application have also surprisingly discovered that even without interlocking structures on the connectors the filler material can result in a retaining wall of much improved integrity and retaining capacity compared to walls made of stacked rows of full width blocks, since the filler material, especially more coarse material such as crushed stone, not only provides added mass, but provides additional interlocking between the stacked rows of facing and backer blocks, which counteracts the problem of row displacement observed in retaining walls of stacked rows of monolithic blocks.

The retaining wall system of this application is easily adapted to different building code requirements with respect to width and mass of the retaining wall, without any changes to the backer or facing blocks being necessary. The base width of the wall can be adjusted by selecting connectors of different length. The mass of the wall consists of the combined mass of the wall portions and the mass of the filler material. The required total mass of the wall for a given retaining capacity is achieved by selecting a connector length which generates sufficient spacing between the front and rear wall portions so that, for a filler material of given density, the mass of the filler material makes up the at least the difference between the total mass and the combined mass. In order to allow filling of the hollow wall and avoid loss of the loose filler material from the wall, each partial wall must be continuous and free of gaps. That means the facing and backer blocks are stacked end-to-end in the front and rear wall portions to avoid a leaking of the filler material.

The backer and facing blocks are preferably cast concrete blocks, such as wet cast or dry cast concrete blocks. In this description, the terms cast concrete block, or cast block, are intended to include both wet cast and dry cast concrete blocks. In one embodiment, the facing blocks are cast blocks with a patterned, decorative surface. In another embodiment, the facing blocks are dry cast concrete blocks with an embossed decorative front surface, more preferably with an embossed, patterned decorative front surface. The facing blocks may also be constructed as cast concrete blocks with a veneer of natural stone attached thereto.

The facing blocks and backer blocks each have a front and back surface and are stacked in a back to back orientation in the form of continuous first and second walls which are spaced apart connected by way of the connectors to form an overall hollow wall assembly. The connectors are preferably removably connectable to the back surface of the backer and/or facing blocks. Preferably, every facing block in the first wall is connected with at least one backer block in the second wall. The hollow wall assembly is then filled with a filler material of desired weight or density to achieve a retaining wall of a desired mass.

In another aspect, the invention provides a wall kit including at least a facing block having a back surface and a decorative front surface, at least a backer block having a back surface and a front surface, and a connector for connecting the facing and backer blocks in a back-to-back arrangement.

Preferably, each facing block and backer block has at least one retaining structure on its back surface, either in the form of a retaining recess in the back surface or a retaining protrusion protruding from the back surface and the connector has at least a pair of interlocking members each for engaging the retaining structure in one of the facing or backer blocks respectively, to connect the blocks in a back to back arrangement. The retaining recesses may be keyhole slots or dovetail slots and the connector preferably has a central web or rod with opposite, terminally positioned enlarged portions forming the first and second interlocking members respectively. Each interlocking member is preferably shaped and constructed for interlocking engagement with a retaining recess. In one embodiment, the retaining protrusions are dovetail shaped protrusions with an undercut for engagement by an interlocking member on the connector. However, any other construction of the retaining structures and interlocking members is possible which ensures reliable permanent or releasable interlocking of the interlocking members with the retaining structures.

In yet another aspect, the invention provides a modular wall system including individual stackable wall components in the form of the facing and backer blocks discussed above and connectors for connecting the wall components in a back to back arrangement. The facing and backer blocks may be of equal or different thickness and may have different lengths and widths. The facing and backer blocks preferably have the same base height or a multiple of the base height. The blocks of the preferred wall system all have graduated lengths, each length being a multiple of a base length or pitch which is preferably equal to a thickness or base width W of the facing blocks. Thus, the blocks may have lengths of 2W, 3W, 4W, 5W, 6W . . . . To facilitate the formation of walls with corners or ends, such as right angled corners, the back-to-back arrangement preferably has an overall thickness which is equal to a multiple of W.

The blocks of the modular wall system are stackable in continuous rows and each include at least one retaining recess in a back surface and each connector preferably has a body and opposing first and second interlocking members for respectively engaging the retaining recess in one of the blocks for interconnecting the blocks in the back-to-back arrangement. The resulting hollow wall assembly is then converted into a retaining wall by filling the intermediate space between the continuous and back-to-back first and second walls with loose filler material such as crushed stone, gravel or soil, or setting materials, such as concrete. The retaining grooves in the facing and backer blocks are preferably spaced apart by 1W to facilitate connection of the blocks at a corner and for providing a preselected breaking point for the block at intervals of 1W. A special corner assembly can be used to reinforce the corner connection, or special corner connectors can be used.

In an alternate embodiment, the length of the connectors is variable to permit the selection of a desired spacing between the first and second partial walls and, thus, of the overall wall width and mass. In another embodiment the spacing of the retaining recesses in the facing and/or backer blocks is selected to be less than W, to permit placement of fixed length connectors at an angle other than 90° to the wall and the blocks.

The wall in accordance with the invention can be built in situ, and preferably uses only the facing and backer blocks as wall components and the intermediate connectors. The connectors are preferably constructed with multiple connecting ends to engage at least a pair of blocks in a back-to-back arrangement. The connecting ends can be joined by interconnecting webs. The connectors are dimensioned to occupy as little as possible of the space between the back-to-back block walls to thereby maximize the amount of fill which can be placed in the space between the back-to-back blocks. The connectors are preferably constructed of a material which provides sufficient flexibility for interlocking engagement of the connectors with the blocks, even when the connector is not perfectly aligned with the complementary retaining structure in the block, while resisting longitudinal extension. Thus, the connectors are preferably flexible but non-extendible.

The wall of the present application can be assembled straight or curved. Curved hollow walls made of a pair of spaced apart parallel and continuous wall portions, provide the additional challenge that due to the curvature of the wall, the outer portion wall is longer than the inner portion wall, which leads to a mismatching of the blocks in the inner and outer portion wall of the curved hollow wall. Moreover, maintaining the inner and outer portion wall continuous is important for avoiding loss of the loose fill. Misalignment of the facing and backer wall portions in a curved wall also creates challenges with interconnecting the facing and backer wall portions, since the retaining structures in respectively opposing blocks are no longer aligned. This problem is addressed by providing one of the facing and backer blocks with retaining structures spaced apart by one pitch (1W), to allow for the assembly of a wall end or corner, and the other of the facing and backer blocks with retaining structures spaced apart by less than 1W, or by making the connectors of a dimensionally stable, but flexible material, or both. Dimensionally stable yet flexible means the connectors are flexible, to allow interconnection with retaining structures on the facing or backer blocks which retaining structures are not perfectly aligned with the connector, while maintaining a fixed length. In other words, the connectors are flexible but not extendible in length. The backer blocks may have rounded ends to ensure an end-to-end engagement of the backer blocks without intermediate gaps, even in curved installations. The backer and facing blocks may also have a T-shaped horizontal cross-section in order to facilitate the stacking of the facing and backer blocks in a curved arrangement. In a preferred embodiment, the facing blocks have vertical retaining grooves in their rear surface which are spaced apart by 1W and the backer blocks have retaining grooves which are spaced apart by ½W. Alternatively, all blocks can have retaining structures in the form of vertical grooves spaced apart by ½W.

In still another embodiment, the invention provides a kit for forming a wall. The kit includes a number of facing blocks with a total coverage area of X and a number of backer blocks having the same coverage area. Preferably, the kit includes X facing blocks, and an equal number of backer blocks and connectors for connecting the facing and backer blocks in a back-to-back arrangement. The facing and backer blocks when connected by the connectors are stackable into front and back wall portions, respectively. The blocks of each kit may be molded in a single mold frame to facilitate manufacture, packaging and transport.

In one embodiment, the modular retaining wall system further includes cap blocks for covering a top of the retaining wall. In this embodiment, the modular retaining wall system preferably further includes coping support connectors between a top row of the facing blocks and a top row of the backer blocks in the wall, the coping support connectors in addition to the pair of connecting ends including a support for supporting at least one of the cap blocks in the installed condition.

In another embodiment, the invention provides a method for assembling a retaining wall having a preselected height and total mass per unit length, comprising the steps of obtaining a plurality of facing blocks respectively having a back surface and a front surface, the facing blocks being cast concrete blocks with a patterned decorative front surface and a known mass; obtaining a plurality of backer blocks respectively having a back surface and a front surface, the backer blocks being cast concrete blocks having a known mass; determining a first mass per unit length of a continuous wall of stacked facing blocks of the selected height; determining a second mass per unit length of a continuous wall of stacked backer blocks of the selected height; determining a required volume of a filler material of known density needed per until length of the wall to provide a mass of filler material equal to at least a difference between the total mass per unit length and the sum of the first and second mass per unit length; stacking the facing and backer blocks in a back-to-back orientation to form a continuous front wall portion of facing blocks and having the preselected height and a continuous rear wall portion of backer blocks having the preselected height; during stacking of the facing and backer blocks, connecting the back surface of each facing block in the front wall portion with the back surface of a least one backer block in the rear wall portion with a connector for connecting the front and rear wall portions in the back-to-back orientation and forming an interior space for receiving the filler material, a length of the connectors being selected for the interior space having a volume at least equal to the required volume; and filling the interior space with the required volume of the filler material to form the retaining wall of the preselected total mass.

In another embodiment, the invention provides a method for forming a corner of first and second intersecting retaining walls in accordance with the invention. The method includes the steps of placing at least one of the backer blocks of the first wall at the corner within the interior space of the second wall. Preferably, the method includes the further step of placing at least one of the backer blocks of the second wall at the corner within the interior space of the first wall. Most preferably, the steps of placing the at least one backer block of the first wall and placing the at least one backer block of the second wall are carried out for each horizontal row of backer blocks. In a variant of the method, at the corner and in each row of backer blocks, the row of backer blocks of one of the first and second walls is continuous with the backer block placed within the interior space of the other of the first and second walls.

BRIEF DESCRIPTION OF THE DRAWINGS

Preferred embodiments of the invention will now be further described by way of example only and with reference to the attached drawings, wherein

FIG. 4*b* shows the wall filled with gravel;

DETAILED DESCRIPTION

Figure 1:
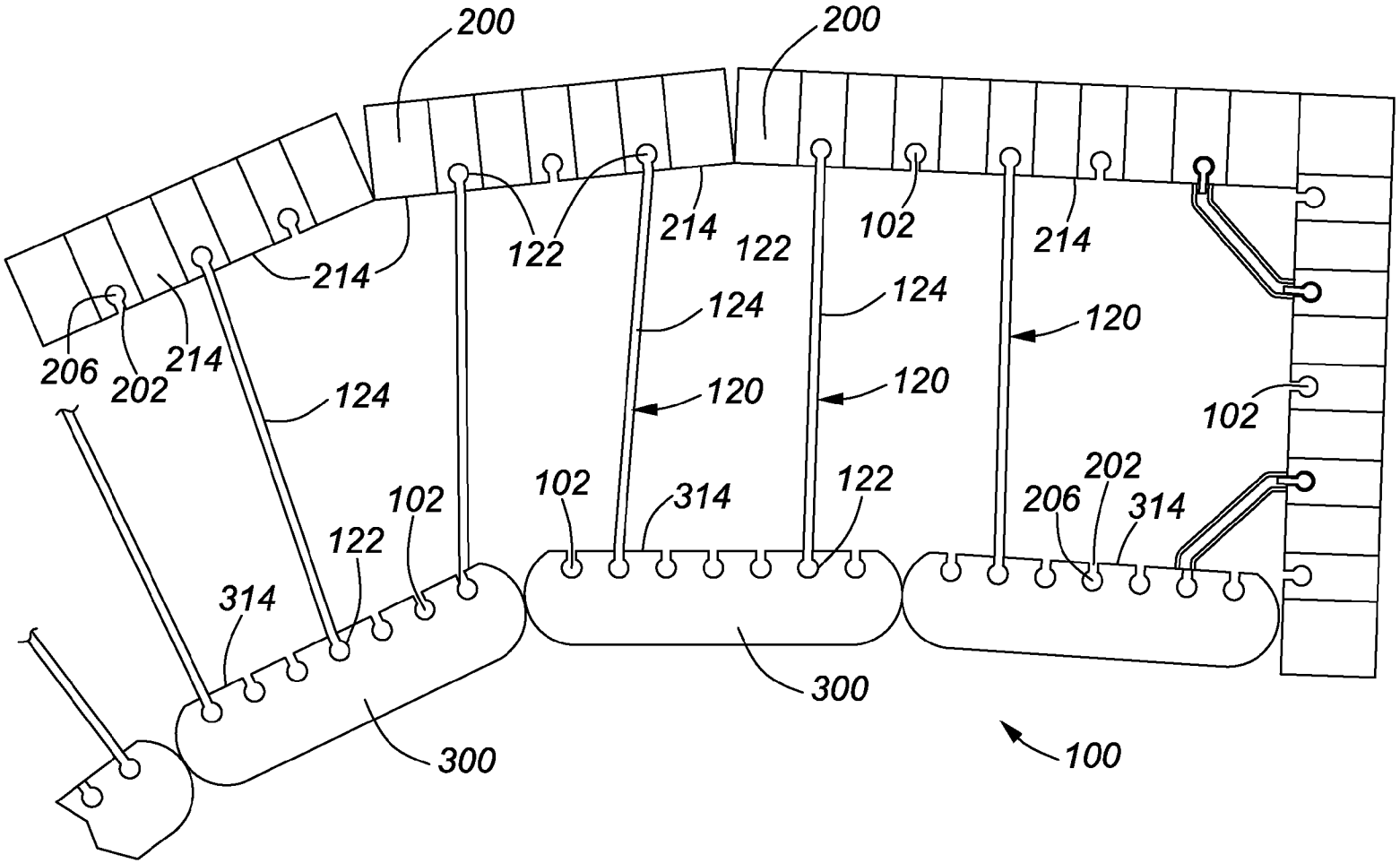
FIG. 1 is a schematic top view of a modular wall as disclosed, including facing and backer blocks connected back-to-back to form a hollow retaining wall.

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation.

FIG. 1 and FIGS. 6*a* to 6*e* illustrate the method in accordance with the invention of constructing a modular wall 100, such as a retaining wall, by connecting pairs of wall blocks, namely facing blocks 200 and backer blocks 300 in a back-to-back arrangement with an intermediate space filled with a filler material 500. The facing blocks 200 have a decorative surface 210, in the illustrated embodiment. Each facing block 200 is connected by way of connectors 120, with at least one backer block. The facing blocks 200 and backer blocks 300 in the illustrated embodiment have rear faces 214 and 314 which are provided with a plurality of retaining structures, in this embodiment keyhole slots 102 for engagement by interlocking members of the connectors 120. The preferred connectors 120, which are discussed in more detail with reference to FIGS. 8 and 9*a*-9*b* have at least a pair of spaced apart parallel, interlocking members 122 interconnected by an intermediate rod or web 124. The interlocking members 122 each engage and are reliably held in a keyhole slot 102 provided in the rear face 214 or 314 of the wall blocks. The wall is preferably made of stacked wall blocks as illustrated in the attached Figures. For ease of use, the connectors 120 are preferably symmetrical, which means the interlocking members 122 are identical in cross-section and size, but non-symmetrical variants with interlocking members 122 of different diameter and cross-sectional shape can also be used.

Figure 12C:
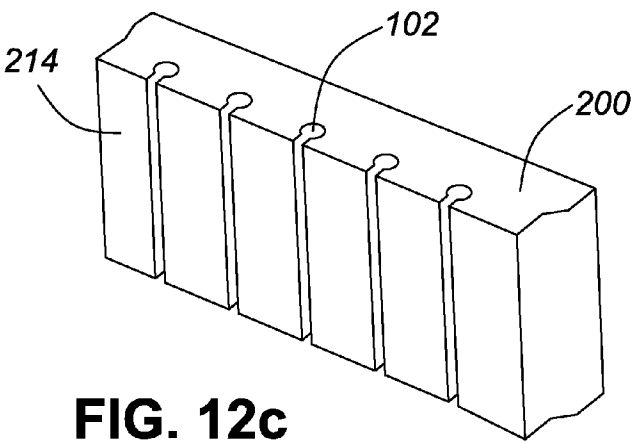
FIGS. 12*a* to 12*d* are front and rear perspective views of embossed face and split face facing blocks as disclosed.
Figure 12D:
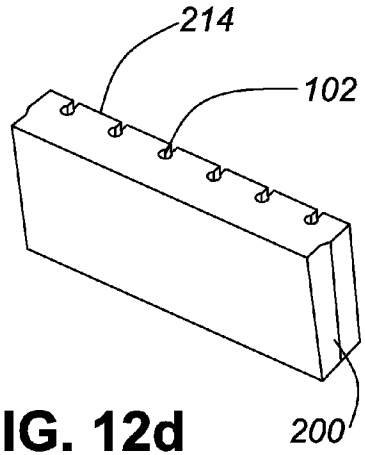
Figure 12A:
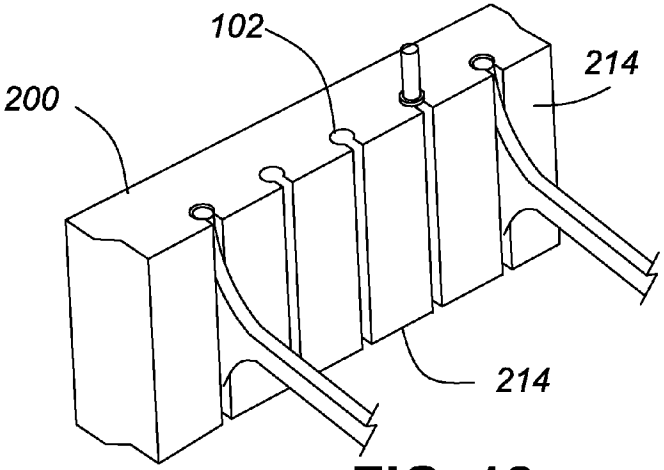
Figure 12B:
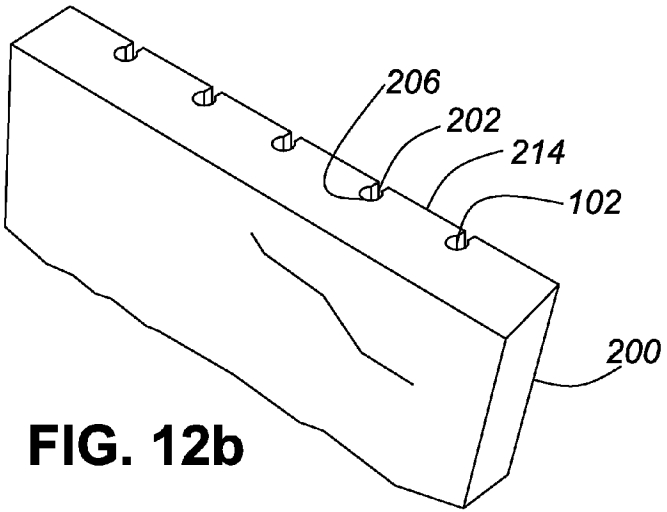

FIGS. 12*a* and 12*b* illustrate an exemplary facing block 200 for use in a wall in accordance with the invention. The facing block 200 is a cast concrete block, preferably a dry cast block, which was compressed in the top to bottom direction during manufacture and has a front surface 212 and a back surface 214. However, the facing block 200 can also have a split face front surface 212, or an embossed decorative surface 212, more preferably an embossed, patterned surface. In a facing block 200 provided with an embossed or patterned front surface 212, the front surface is the top surface during molding. The facing block 200 has multiple spaced apart parallel keyhole slots 102, in its back surface 214 (bottom surface during molding of a dry cast block). Each keyhole slot 102 has a slot portion 202 penetrating the back surface 214 of the facing block 200 and a cylindrical bore portion 206 connected thereto. The interlocking members 122 of the connectors 120 are respectively inserted into the keyhole slot bore portion 206 to mount the facing blocks 200 in a back-to-back arrangement with the backer blocks 300 (see FIGS. 1 and 2). The facing block 200 is preferably sized and shaped to permit stacking into a continuous wall portion. However, the width of the facing blocks 200 is insufficient for the stacked facing blocks to function as a retaining wall. The width may even be so small that stacking the facing blocks into any wall is difficult without connecting them to backer blocks. The facing blocks 200 preferably all have a base width W and the keyhole slots 102 are preferably spaced apart by W or a multiple of W.

Figure 11A:
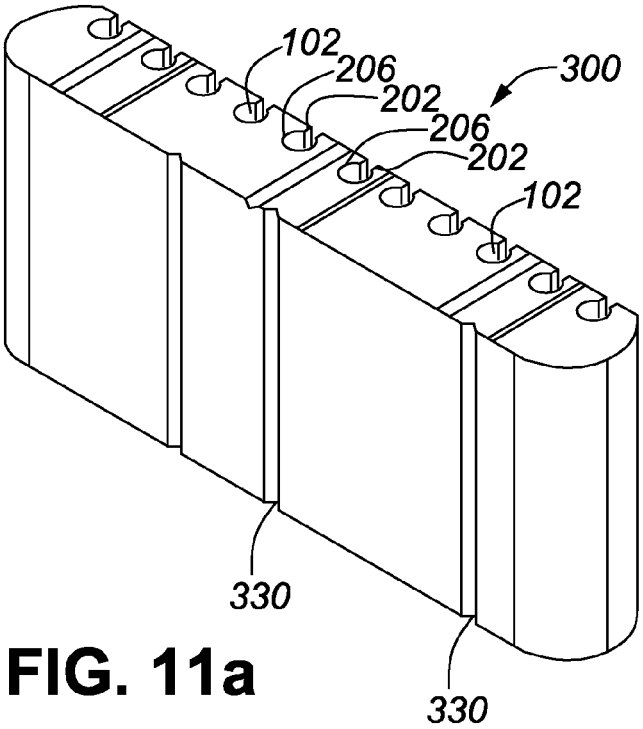
FIGS. 11*a* to 11*c* are front and rear perspective views of different backer blocks as disclosed.
Figure 11C:
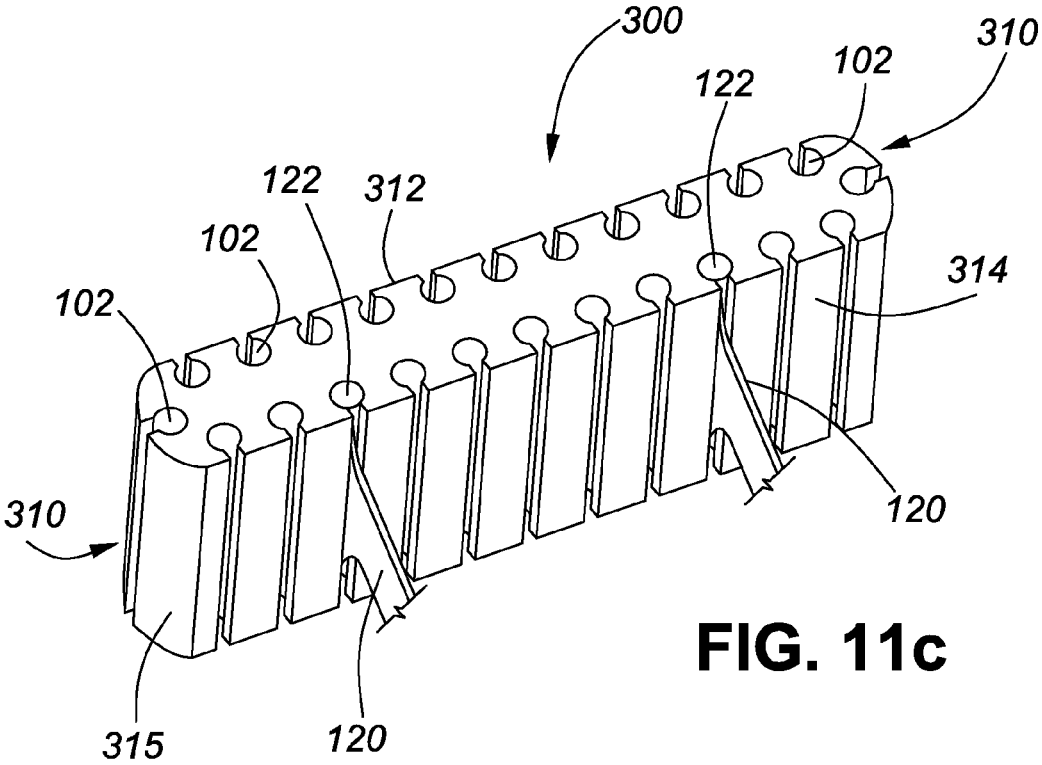
Figure 11B:
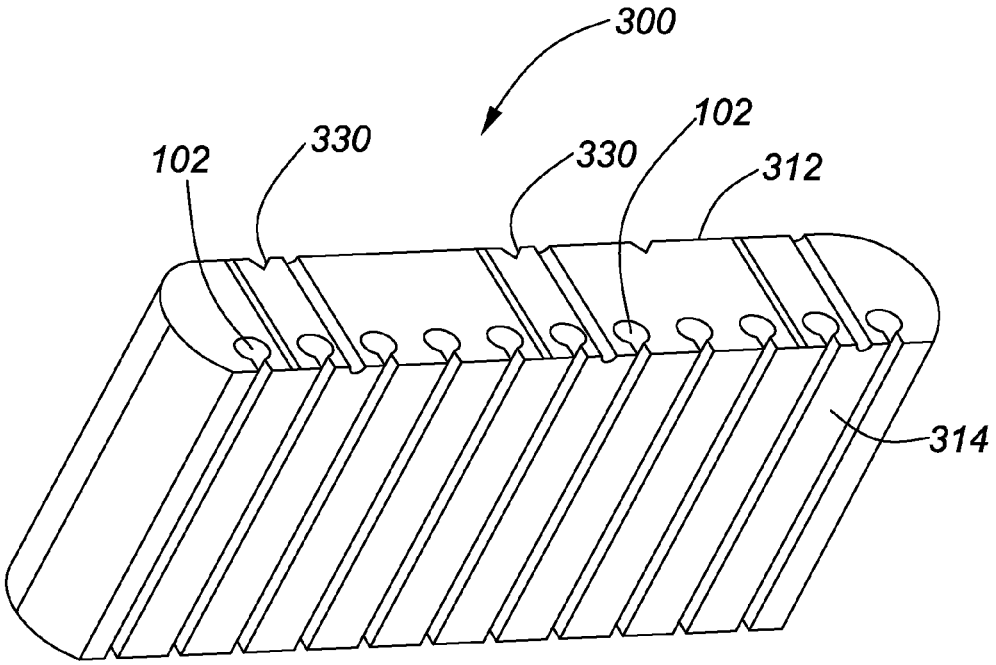

FIGS. 11*a* to 11*c* illustrate exemplary backer blocks 300 which may be used in a wall in accordance with the invention. In this example, the backer block 300 is a cast concrete block, preferably a dry cast concrete block, which was compressed in the top to bottom direction during manufacture and has a front surface 312 and a back surface 314. Other types of cast concrete blocks may also be used, which may be manufactured in a standard mold frame or a big board mold. The backer block 300 of FIGS. 11*a* and 11*b* has in its back surface 314 multiple spaced apart parallel retaining structures, in this embodiment keyhole slots 102. However, retaining structures in the form of keyhole shaped recesses or keyhole slots 102 can be provided on the front and back surfaces 312, 314 of the backer block, as well as in the end surface 315. Each keyhole slot 102 has a slot portion 202 penetrating the back surface 314 of the backer block 300 and a cylindrical bore portion 206 connected thereto (see FIG. 11*a*). The interlocking members 122 of the connectors 120 are respectively inserted into the bore portion 206 to mount the backer blocks 300 in a back-to-back arrangement with the facing blocks 200 (see FIGS. 11*c* and 1 and 2). The backer block 300 is preferably sized and shaped to permit stacking into a continuous wall portion. However, the width of the backer blocks 300 is insufficient for the stacked backer blocks to function as a retaining wall. The width may even be so small that stacking the backer blocks into any wall is difficult without connecting them to the facing blocks.

To facilitate the construction of curved walls, the backer block 300 preferably has shaped ends, such as rounded ends 310, or stepped ends, which allow placement of the backer blocks 300 end to end and at an angle to one another without any spacing between the ends 310. This means a curved wall made with the modular wall system of this application has a continuous back surface and no spaces or gaps, as in conventional retaining walls, which increases the overall mass and, thus, the retaining capacity and stability of the wall. In order to ensure that the backer blocks 300 can always be stacked to form a continuous wall and still each be connected to the facing blocks 200 by at least two connectors 120, the backer blocks 300 preferably have a larger number of keyhole slots 102 than the facing blocks 200. The spacing of the keyhole slots 102 in the backer blocks 300 may be less than the base width W of the facing blocks to facilitate the assembly of curved, continuous backer block walls. The spacing of the keyhole slots 102 in the backer blocks 300 may be ½W or less. This facilitates the stacking of the backer blocks 300 into a wall with no intermediate gaps or spaces, even in curved walls. Alternatively, the keyhole slots 102 in the backer blocks 300 may be spaced at W, or a multiple thereof, with the keyhole slots 102 and the facing blocks 200 being spaced at less than W, or ½W. In still another alternative, all keyhole slots 102 in all blocks are spaced at ½W.

The backer block 300 in its front surface 312 also preferably includes a set of vertical notches 330 to facilitate breaking of the block into smaller parts without the need for cutting equipment. As seen in FIGS. 11*a* and 11*b*, the notches 330 are preferably placed at ¼, ½ and ⅔ of the length of the block. Of course, the notches 330 can be placed at any desired location in the front surface 312. The backer block 300 is preferably sized and shaped to permit stacking into a continuous wall portion. However, the width of the backer blocks 300 is insufficient for the stacked backer blocks to function as a retaining wall.

FIGS. 3*a*, 3*b*, 4*a*, 4*b*, 5*a* to 5*c* and 6*a* to 6*e* illustrate modular walls in accordance with this application and their method of assembly. The decorative facing blocks 200 and the backer blocks 300 are arranged spaced apart parallel with their back surfaces 214 and 314 facing one another. Connectors 120 are then inserted into the keyhole slots 102 to connect the facing and backer blocks in the back-to-back orientation. Each facing block 200, preferably a facing block intended for providing a decorative finish on a wall or wall block, is provided with a decorative facing surface. The modular wall 100 is preferably made of a multitude of backer blocks 300 stacked in rows to form a rear wall portion 301 and a multitude of facing blocks 200 stacked in rows to form a front wall portion 201, which wall portions are spaced apart parallel and connected in a back-to-back orientation by the intermediate connectors 120. All of the backer blocks 300 and facing blocks 200 are of a width insufficient for the first or second portions wall to individually function as a retaining wall. The facing blocks 200 have a base width W and multiple parallel keyhole slots 102 which are spaced apart by W, whereas the keyhole slots 102 in the backer blocks 300 may be spaced apart by less than W. Preferably, for the facing blocks 200, the spacing is W or a multiple of W and the spacing of the keyhole slots 102 in the backer blocks 300 is less than W preferably ½W. Keyhole slots 102 may also be spaced at ½W in both the facing and backer blocks 200, 300.

Figure 13A:
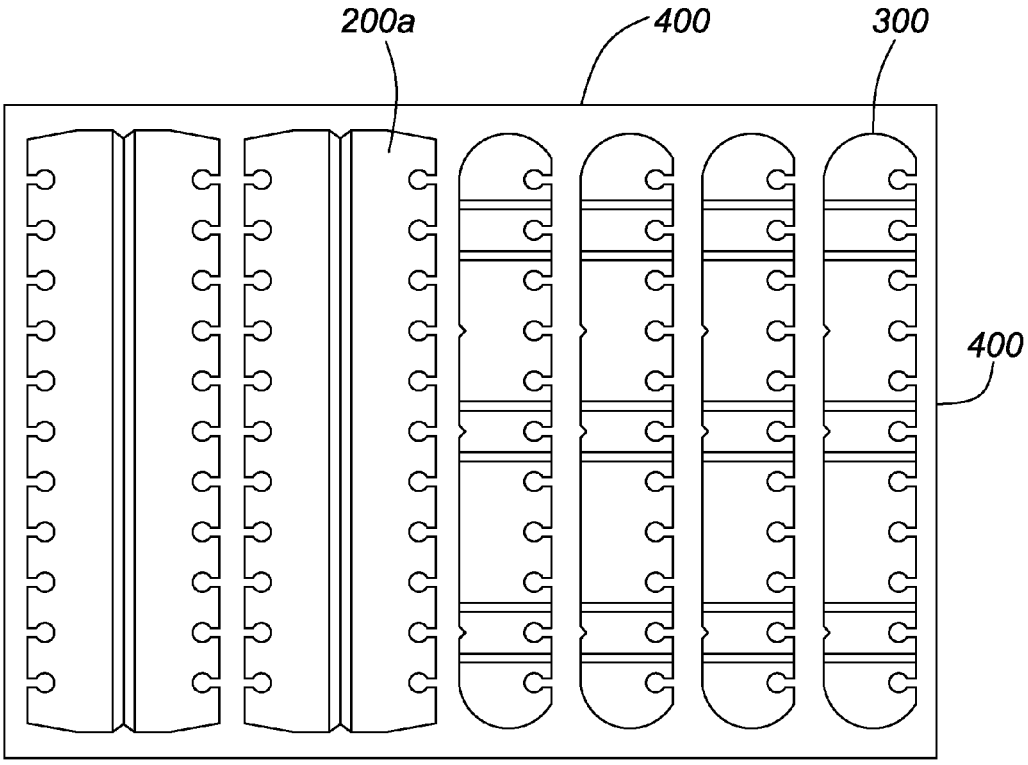
FIGS. 13*a* to 13*c* are a schematic illustrations of a mold frame arrangement for the molding of the facing and backer blocks for a wall kit.
Figure 13C:
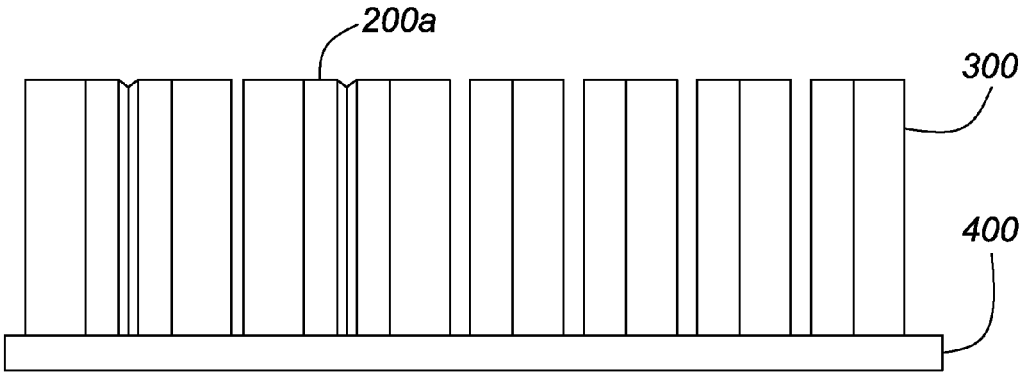
Figure 13B:
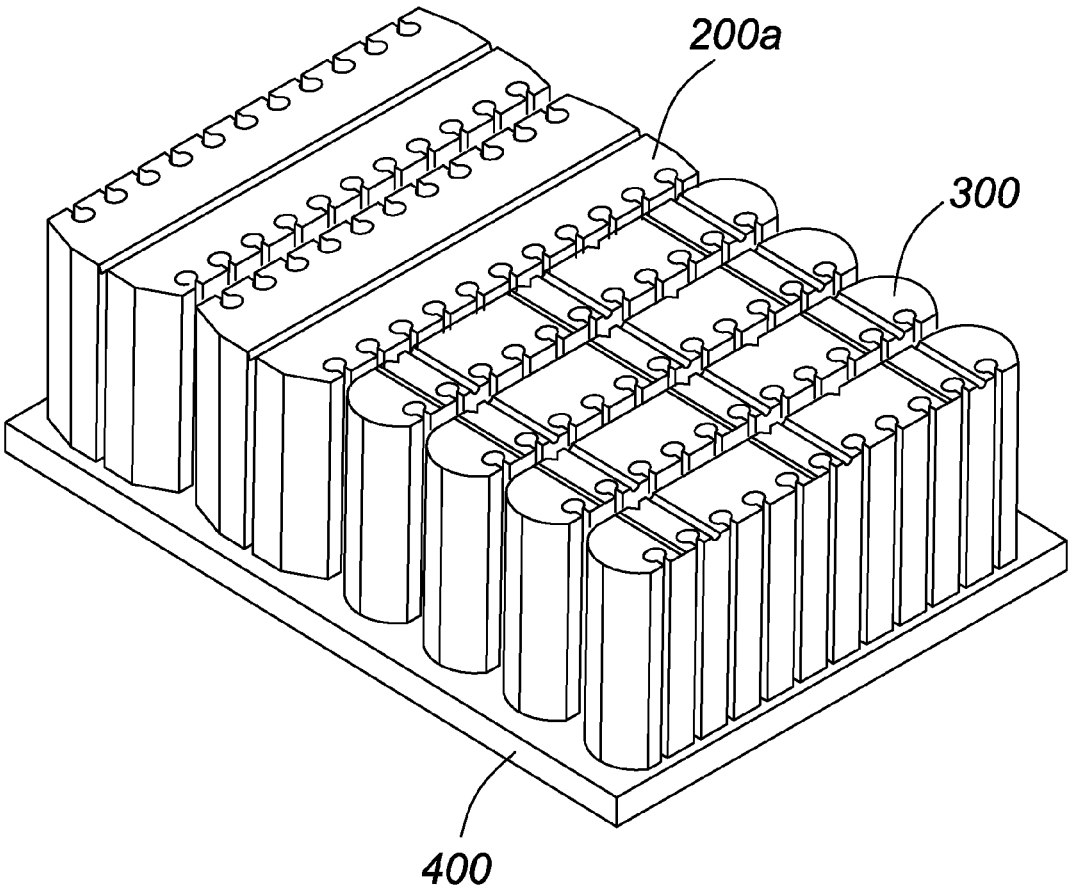
Figure 14B:
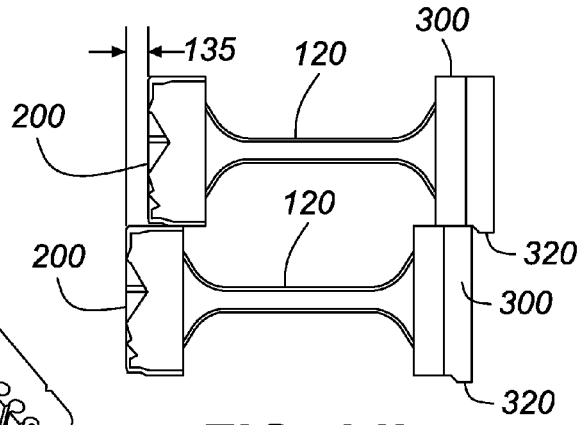
FIGS. 14*a* to 14*f* show different retaining walls as disclosed including structures to create a setback for consecutive rows.
Figure 14A:
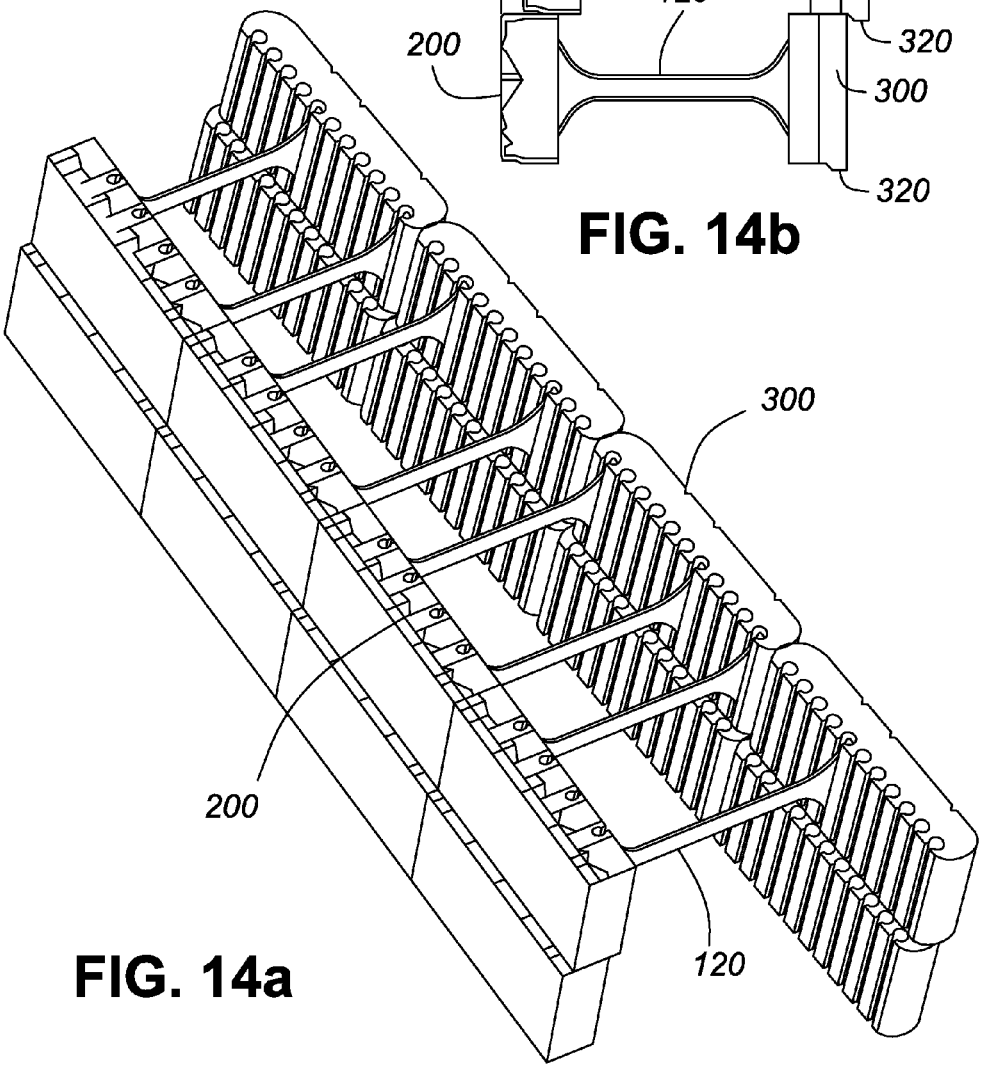
Figure 14C:
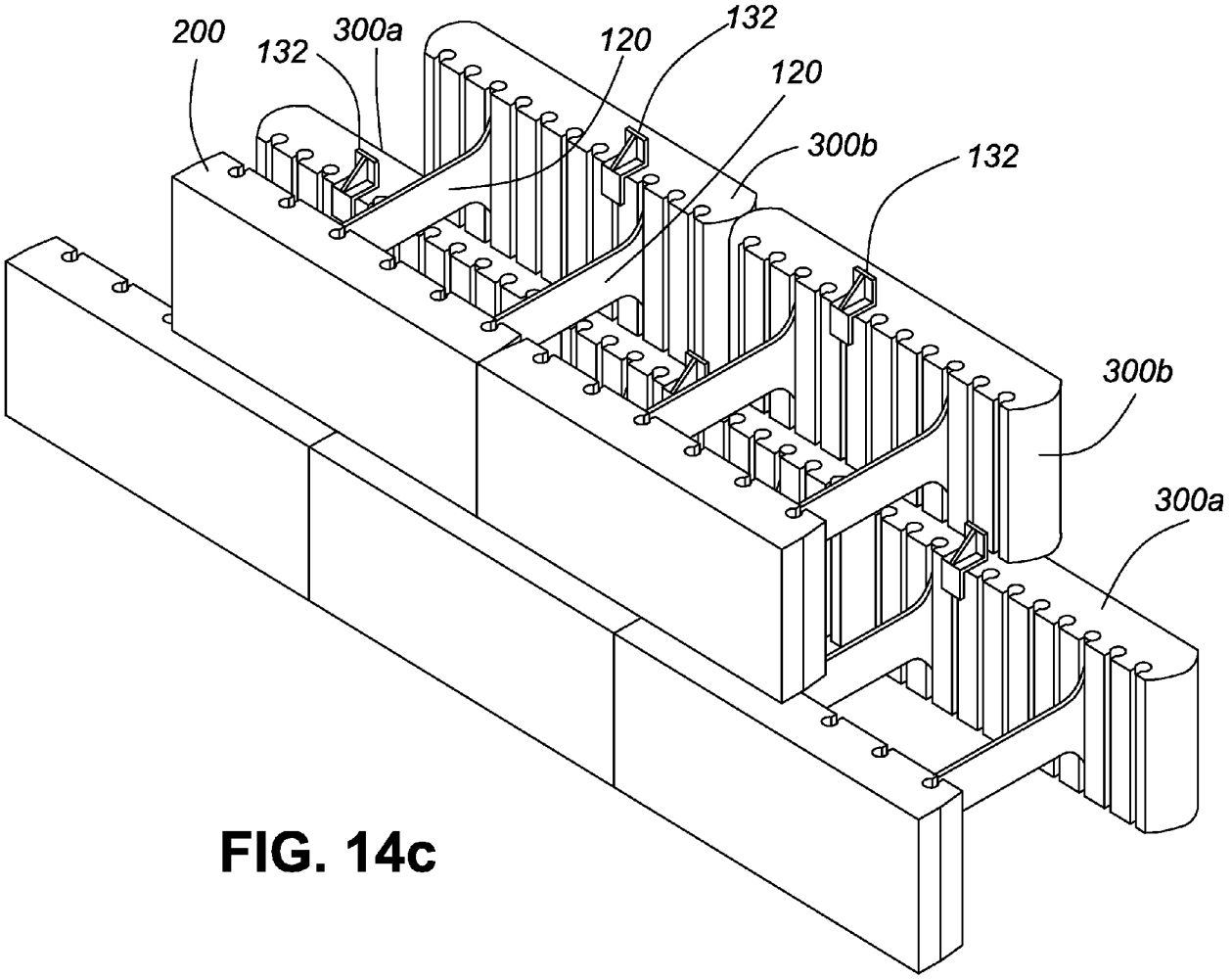
Figure 14D:
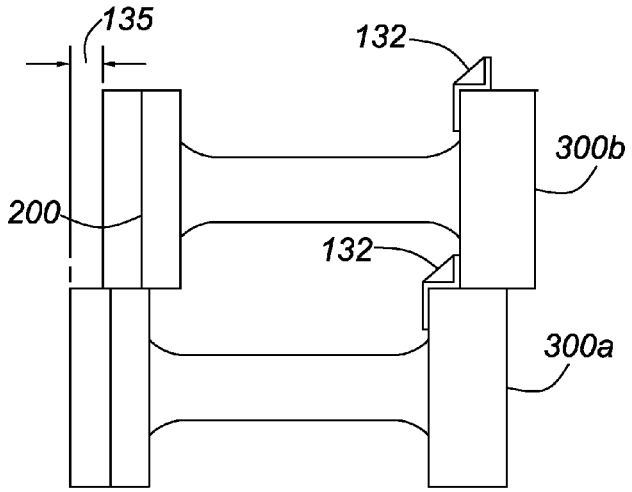
Figure 14F:
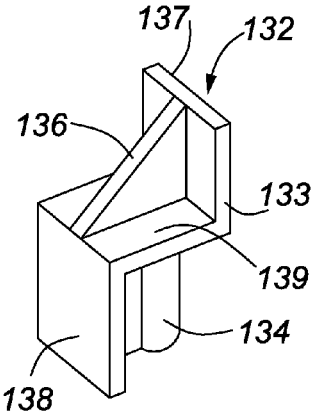
Figure 14E:
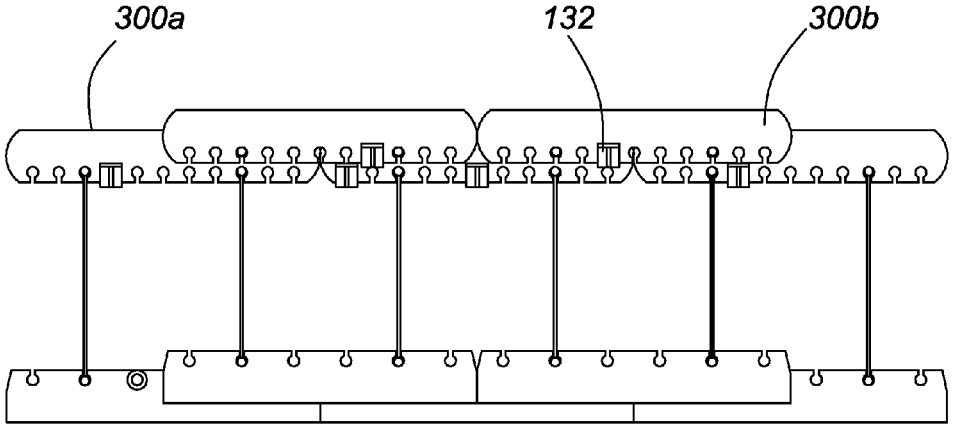

In one embodiment, the invention provides a kit for forming a retaining wall. The kit includes X facing blocks 200 and an equal number of backer blocks 300 and connectors 120 for connecting the facing and backer blocks in a back-to-back arrangement, for forming a hollow retaining wall. The facing and backer blocks are all stackable for forming a wall portion, but are of insufficient width for the wall portion to form a retaining wall. The blocks of each kit may be molded in a single mold frame 400 as shown in FIGS. 13*a-c*, to facilitate manufacture, packaging and transport. Molding an equal number of facing and backer blocks in the same mold frame allows the stacking of the blocks produced from each frame as consecutive layers on a pallet, thereby giving the installer of the blocks always access to the right number of facing and backer blocks at all times during installation. Preferably, the facing blocks 200 are split face blocks and are molded in pairs and subsequently split. This allows the casting of 8 blocks in each standard frame 400, two back-to-back facing block pairs 200*a* and four separate backer blocks 300, while otherwise only 7 blocks of 7 cm thickness could be cast.

The interconnection of the back-to-back facing and backer blocks is preferably carried out on a row by row basis, as each row of facing and backer blocks is finished, so that the connectors need not be forced through the keyhole slots of more than one block. In the alternative, only the insertion of the connectors into one partial wall is done on a row by row basis. However, this will require moving facing blocks for the other partial wall along several connectors, which may increase the time required for installation of the complete wall.

Facing blocks of different sizes can be used in the same wall as shown in FIGS. 20*a* to 21*c*. As will be apparent from the drawings, in order to facilitate the close fitting of facing blocks of different sizes, the height of all facing blocks is a multiple of a base height H, normally the height of the smallest blocks. The length of the facing blocks is a multiple of the base width W of the facing blocks, in order to ensure a close fit of all blocks in corners or at ends of the wall. The base width and length of the backer blocks preferably follows the same rules.

Jumper blocks can be included in the wall, which are larger in size than the remaining blocks and possibly rotated by 90°. When jumper blocks of the same principle construction as the surrounding blocks are used, which are rotated by 90°, the facing block back-to-back thereto is preferably installed immediately after placement of the jumper block and before the rows of blocks around the jumper block are finished. Sliding of the facing block onto the connector in the jumper block may no longer be possible once the connectors of the adjoining blocks are installed, due to their orientation perpendicular thereto. However, where jumper blocks are used which have keyhole slots oriented 90° to those of regular blocks, installation of the facing block back-to-back onto the jumper block can be carried out in the ordinary course of installation since the slots in the jumper block are then parallel to those in the surrounding blocks. In addition, connectors can be used which have a pair of connecting members oriented at 90° to one another, which assists in connecting blocks that are rotated by 90° or blocks which have vertical and horizontal connecting recesses. For added stability of the decorative wall, the connectors can be inserted into the keyhole slots so that they each engage a pair of facing blocks in vertically adjacent rows of facing blocks and thereby not only connect the first and second walls, but also the stacked rows. The alignment of consecutive horizontal rows of blocks can be offset to the back in order to create a slightly backwardly slanted retaining wall. This can be achieved with the setback structures or connectors shown in FIGS. 14*a* to 14*f*, or FIGS. 24*a* to 24*d*.

The wall in accordance with the invention can be built in situ, and preferably uses only the facing blocks 200, the backer blocks 300, the connectors 120 and the filler material 500. Connectors of different construction are illustrated in FIGS. 7, 8, 9*a* and 9*b*, and 24*a* to 24*d*. The connectors 120 preferably all have the same basic construction with at least a pair of interlocking members 122 to engage at least a pair of blocks in a back-to-back arrangement and an intermediate connector body 124 in the form of a web or rod. The connectors can include multiple connecting members joined by multiple intermediate connector bodies 124, such as interconnecting webs, for example oriented in a crossing arrangement to provide lateral stability to the back-to-back arrangement. The connectors 120 can be made of any material sufficiently strong to reliably connect the facing and backer blocks 200, 300 of the partial walls. The connectors are preferably made of any material which will be resistant to deterioration upon exposure to the elements, soil, gravel and the like. The most preferred material is plastic, although non-corroding metal alloys or metal connectors with a non-corroding surface finish can also be used. The exact construction of the connectors 120 and their connecting ends 122 can vary widely and can be achieved through machining of materials (such as bending and welding) or with molding techniques (such as injection molding or extruding). Although the form or shape of the connecting ends 122 can vary widely, they must be of sufficient size and/or of an appropriate shape to allow insertion into the bore portion 206 of the keyhole slot 102, while preventing pulling of the connecting end 122 through the slot portion 202 of the keyhole slot 102. For the assembly of curved walls, the connectors also are preferably constructed of a material which allows lateral flexibility of the connectors so that a misaligned insertion of the connectors into the retaining structures of the facing and backer blocks is possible, while ensuring longitudinal dimensional stability. In other words, the connectors are preferably flexible, but non-extensible.

Figure 8:
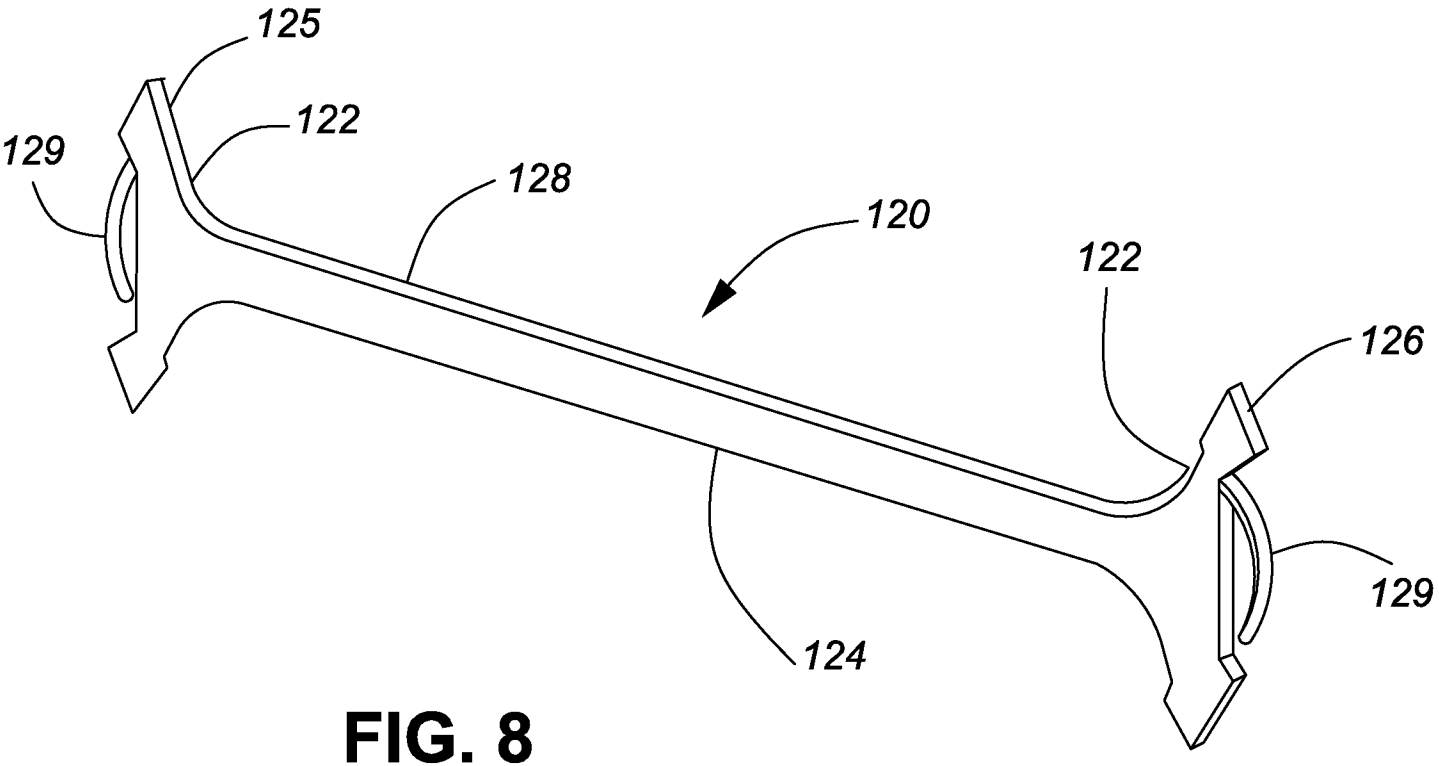
FIG. 8 shows a web type connector for use in a modular retaining wall as disclosed.

FIG. 8 illustrates a rod type connector 120 in accordance with the application. The rod type connector includes a pair of connecting ends 122, made of a bent rod with two or more undulations, welded to a rod shaped interconnecting body 124.

Figure 9A:
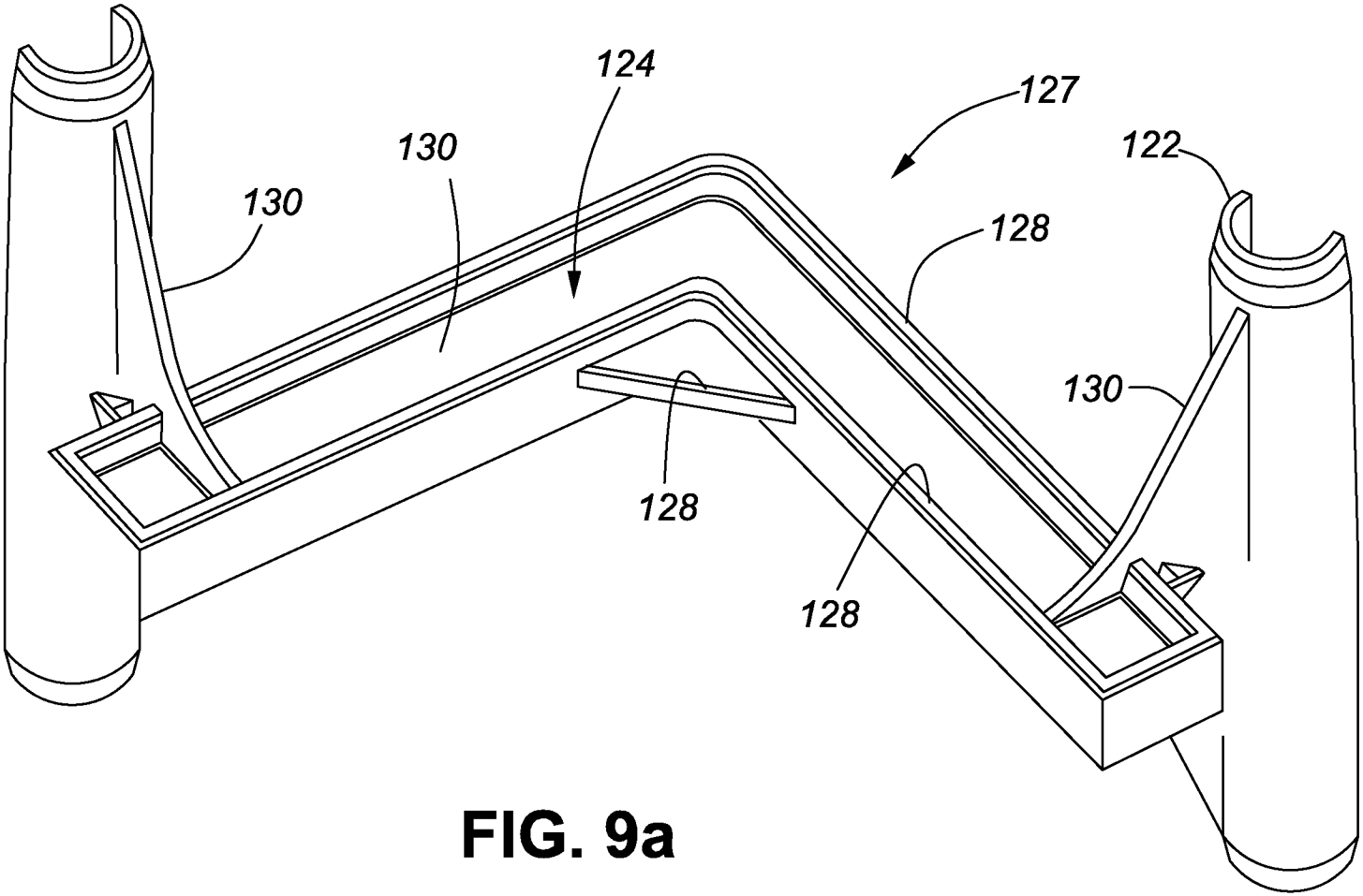
FIGS. 9*a* to 9*b* show different web type connectors and corner connectors for use in a modular wall as disclosed.
Figure 9B:
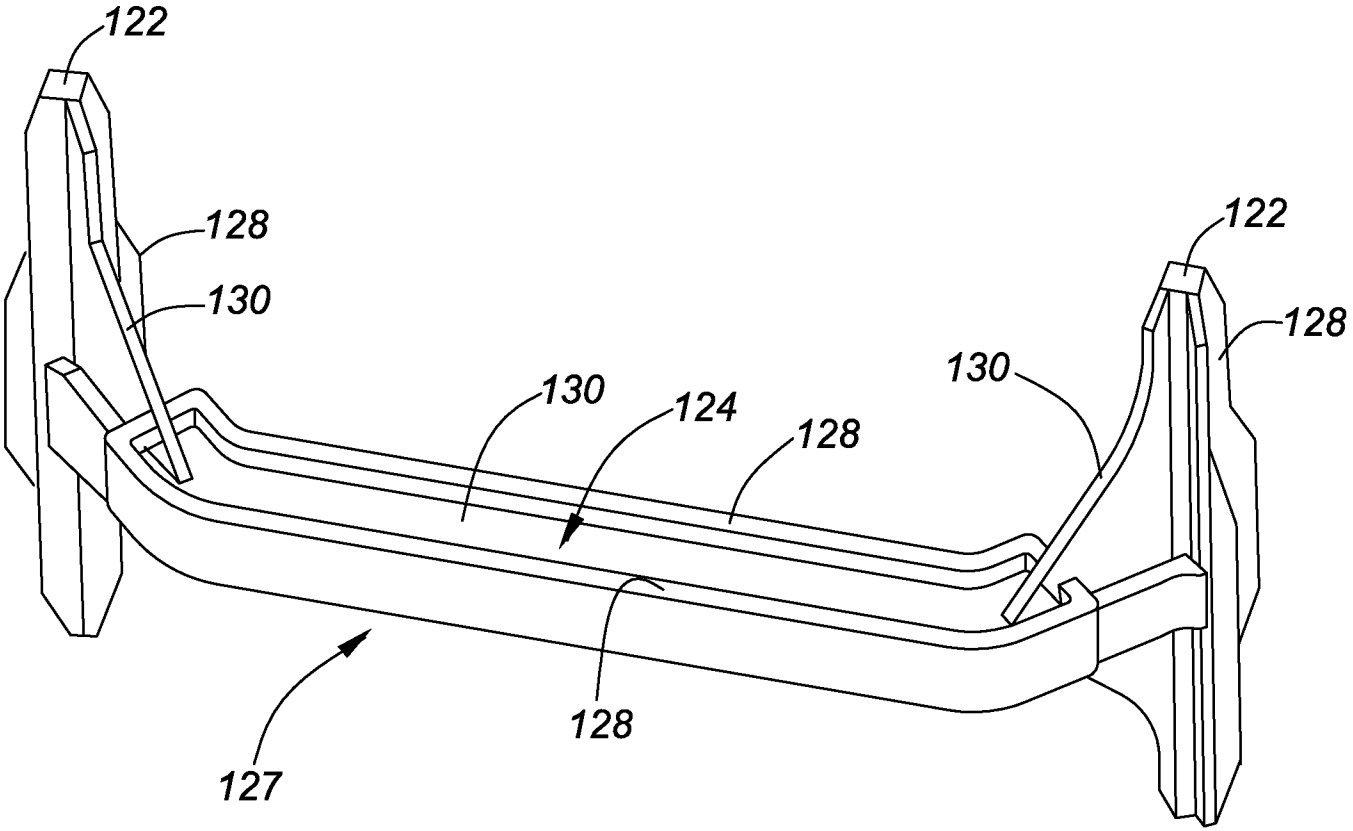

FIGS. 9*a*-9*b* illustrate embodiments of an injection molded type connector 120 in accordance with the application, which is preferably of symmetrical construction to facilitate its use in the decorative wall of the invention in different orientations. The connector 120 includes a planar web 124 with opposite ends 125, 126 and a stem portion 122 at each of the ends. The stem portion 122 is preferably cylindrical, for interfacing with the keyhole slots 102 in the facing or backer blocks, but can be of any shape with allows engagement with the retaining recess in a facing or backer block and prevents the connector being pulled out of the retaining recess. Although the connectors 120 shown in FIGS. 9*a* to 9*b* include interlocking members 122 in the form of generally cylindrical stems intended for being mounted to the facing blocks 200 by sliding them along the keyhole slots 102, connectors with stems of different cross-section can also be used, the only requirement being that the stems have a shape and thickness which prevents the connection being pulled through the slot portion 202 of the keyhole slot in which it is engaged. Reinforcing flanges 128 are preferably provided on the web 124 and the interconnecting members 122 preferably have flexible or spring biased locking members 129 which lock the stems in the bore portion 206 of the keyhole slot 102 to maintain the connectors 120 stationary in the blocks until the hollow wall 100 is filled with the loose filler material.

Different types of injection molded or extruded corner connectors 127 are shown in FIGS. 8, 9*a* and 9*b*. The extruded corner connectors 127 are especially economically manufactured. All corner connectors 127 have at least two interconnecting members 122 and an interconnecting body 124 which may include multiple webs 130 and reinforcing flanges 128. Furthermore, connector and retaining groove combinations other than those particularly exemplified can be used without deviating from the present invention. For example connectors of the snap in type can be used (see FIG. 10). Although corners can be formed in the modular retaining wall of this application by using these corner connectors, a different corner assembly method, which does not involve the use of specialized connectors is also part of this invention and will be described further below with reference to FIGS. 23*a* to 23*d*.

Figure 21A:
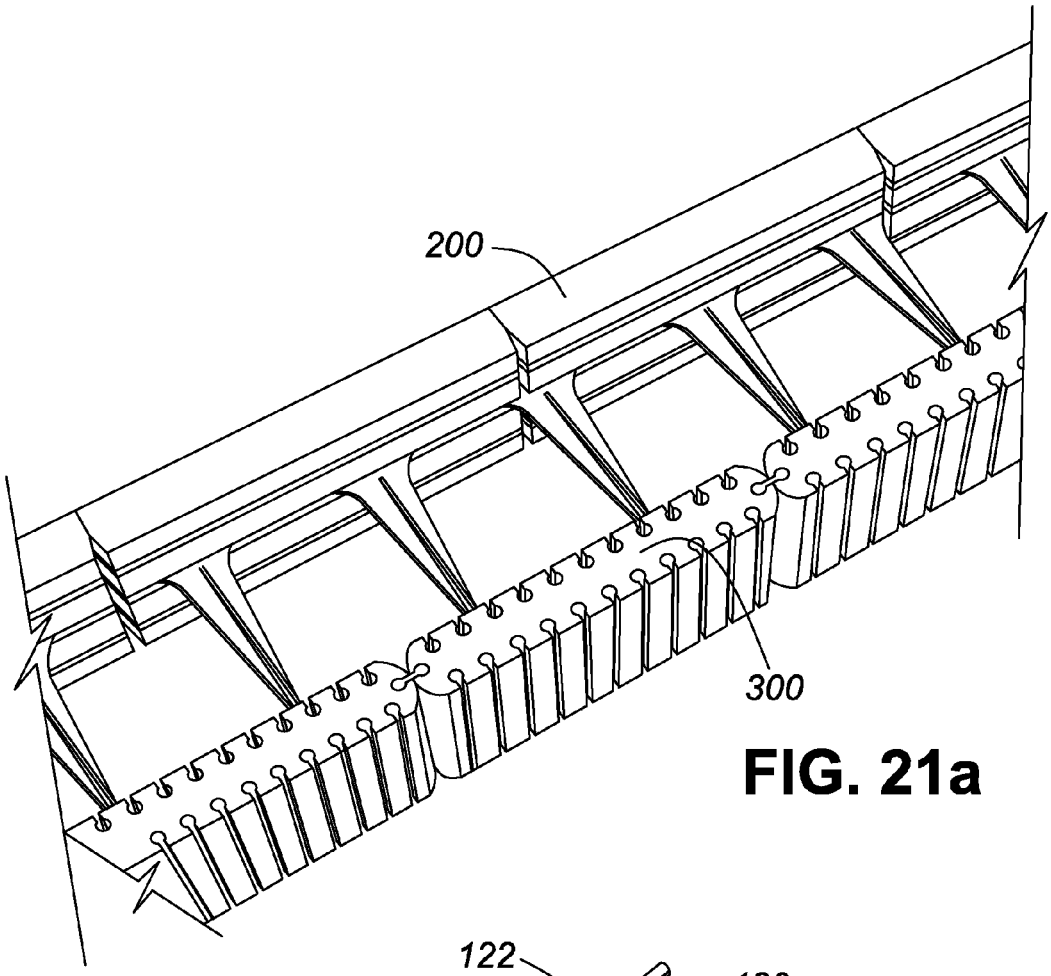
FIGS. 21*a* to 21*e* illustrate different orientations of the interlocking between the connectors and the blocks.
Figure 21B:
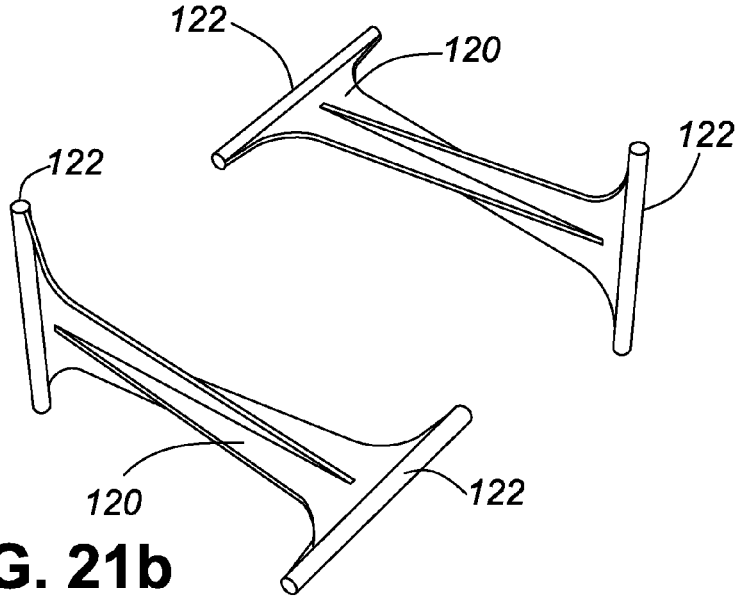
Figure 21C:
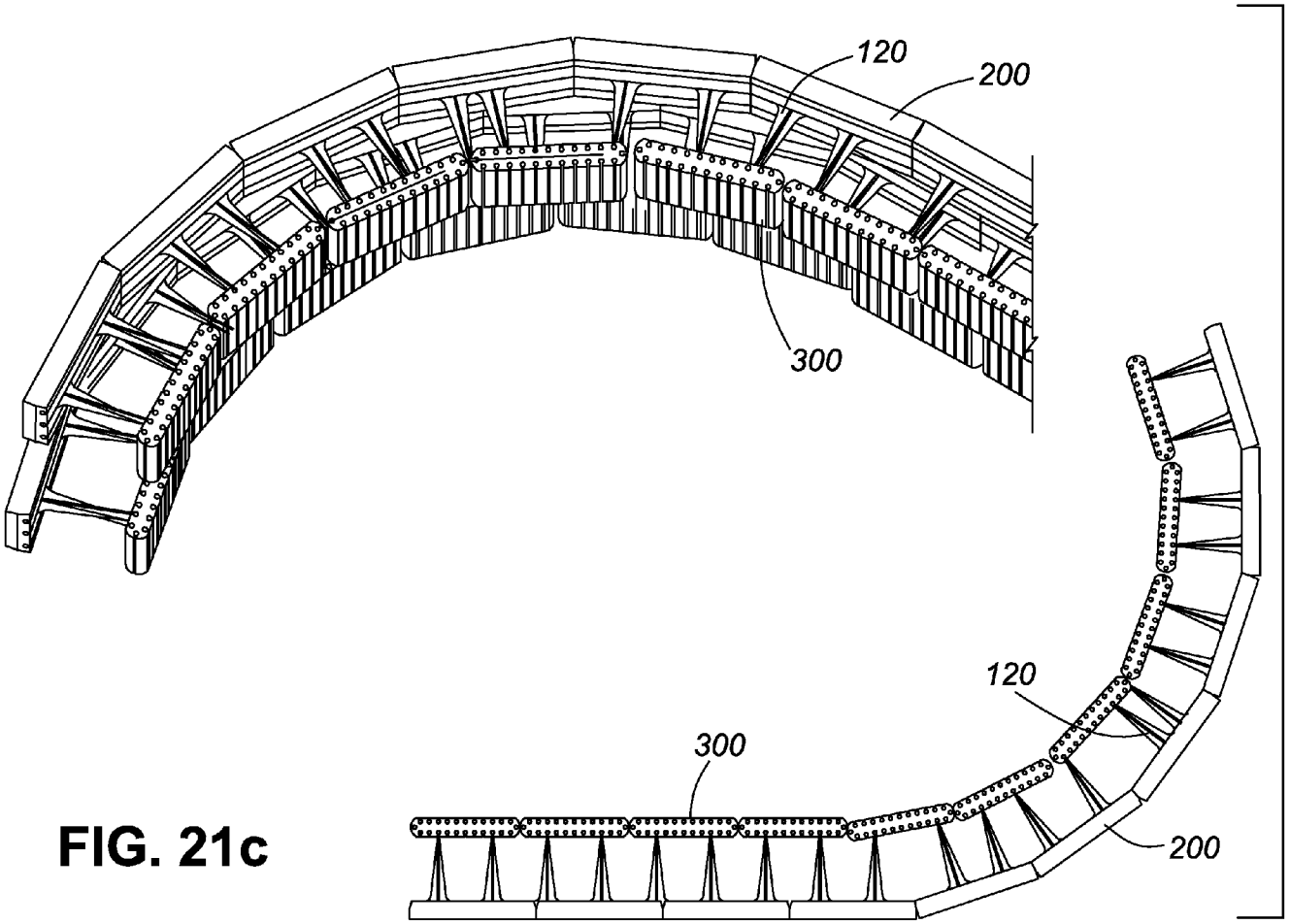
Figure 21D:
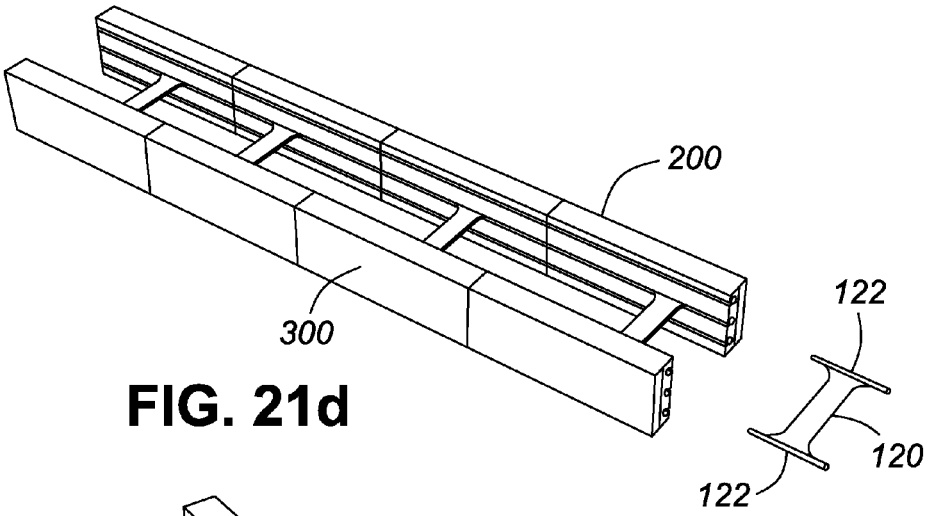
Figure 21E:
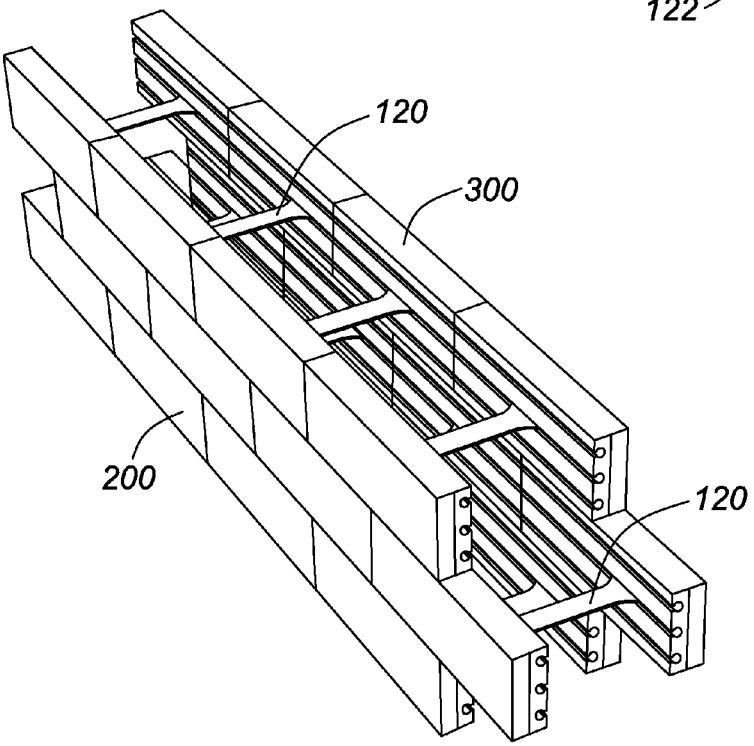

The keyhole slots 102 in the facing and backer blocks 200, 300 will now be discussed in more detail with reference to FIGS. 1, 11*a* to 11*c* and FIGS. 12*a* and 12*b*. Each keyhole slot 102 has a slot portion 202 penetrating the rear surface 214, of a facing block 200 or the rear, front or end surface 314, 312 or 315 of a backer block 300 and a cylindrical bore portion 206 connected thereto. The cylindrical bore portion 206 is sized and shaped for receiving one of the interconnecting members 122 of the connectors. The slot portion 202 is sized and shaped for receiving the interconnecting body 124 of the connector 120, the width of the slot portion 202 being less than the size (diameter) of the connecting end 122 in order to prevent the connector 120 being pulled out of the keyhole slot 102 through the slot portion 202. For maximum flexibility in connecting the facing and backer blocks 200, 300 to one another, the blocks 200, 300 preferably have at least a pair of keyhole slots 102 in the rear surface 214, 314. When multiple keyhole slots 102 are provided, the slots are preferably parallel and equidistantly spaced on the rear surface 214, 314 of the facing and backer blocks 200, 300 or the front surface and end surface 312, 315 of the backer blocks. The slots are preferably oriented vertically or horizontally and centered on the blocks when in the installed condition. Although other orientations of the slots are possible those orientations may make assembly of the decorative wall more challenging. The keyhole slots 102 preferably extend completely across the rear surface 214, 314 of the facing and backer blocks 200, 300 or the front or end surface 312, 315 of the backer blocks. Facing and backer blocks 200, 300 with retaining structures in the form of recesses or keyhole slots 102 which extend vertically in the installed condition of the blocks are shown in FIGS. 12*a* to 12*d*. Backer blocks 300 and facing blocks with retaining recesses extending horizontally in the installed condition of the blocks are shown in FIGS. 21*a*, 21*d* and 21*e* respectively.

Figure 10:
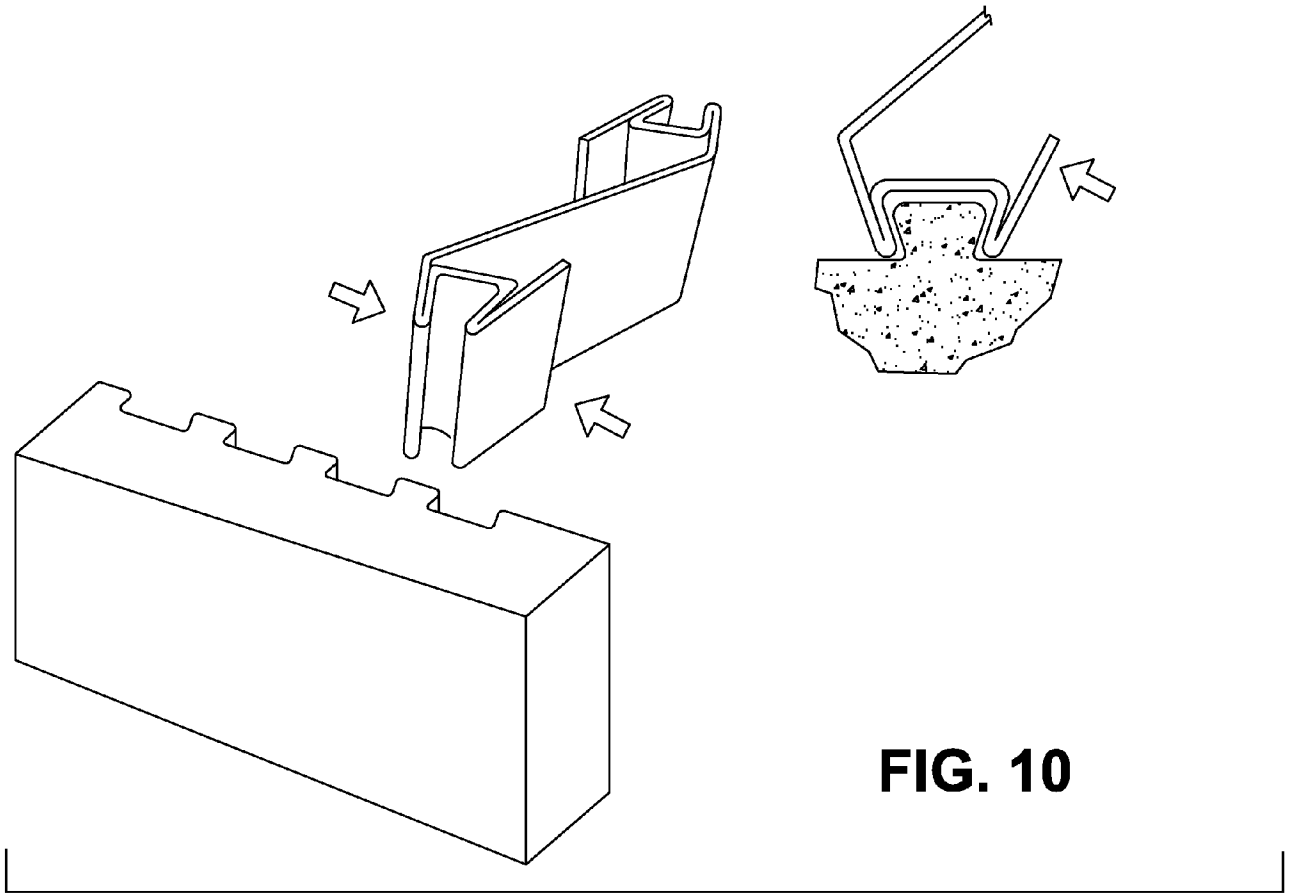
FIG. 10 shows a block with dovetail shaped retaining protrusions and a spring steel connector with clip shaped interlocking members for elastic and removable engagement with the retaining protrusions.

Of course, it will be readily apparent to the art skilled person that a retaining structure other than keyhole slots can be provided in the blocks 200, 300 as long as a reliable interlocking engagement between the retaining structure and the connectors respectively used is ensured. For example, the retaining structure can be in the form of a slot or bore and the connector can be a compressible/expandable connector, which is insertable into the slot or bore and locks in the slot or bore when fully inserted in order to reliably retain the connector in the slot. Alternatively, the retaining structures can be dovetail shaped slots and the connectors can have complementary connecting ends, or vice versa. In yet another alternative, the retaining structure is a protrusion 150 on the rear surface 214, 314 of a facing or backer block 200, 300 as schematically illustrated in FIG. 10. The illustrated protrusion 150 is dovetail shaped for engagement with connector 120 provided with clip shaped connecting ends 122.

Figure 2:
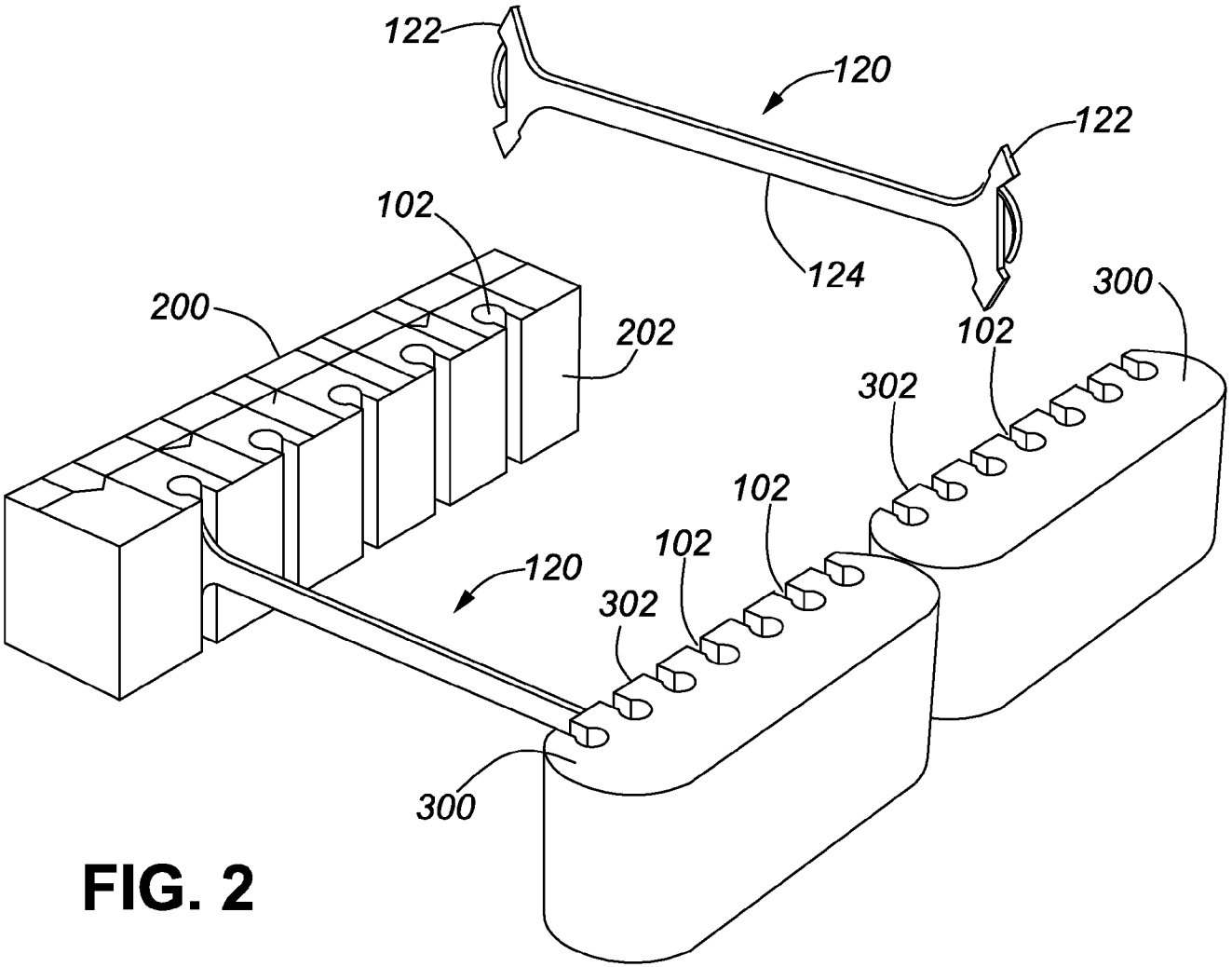
FIG. 2 is a perspective view of facing and backer blocks connected with a connector for use in a wall as disclosed.
Figure 3A:
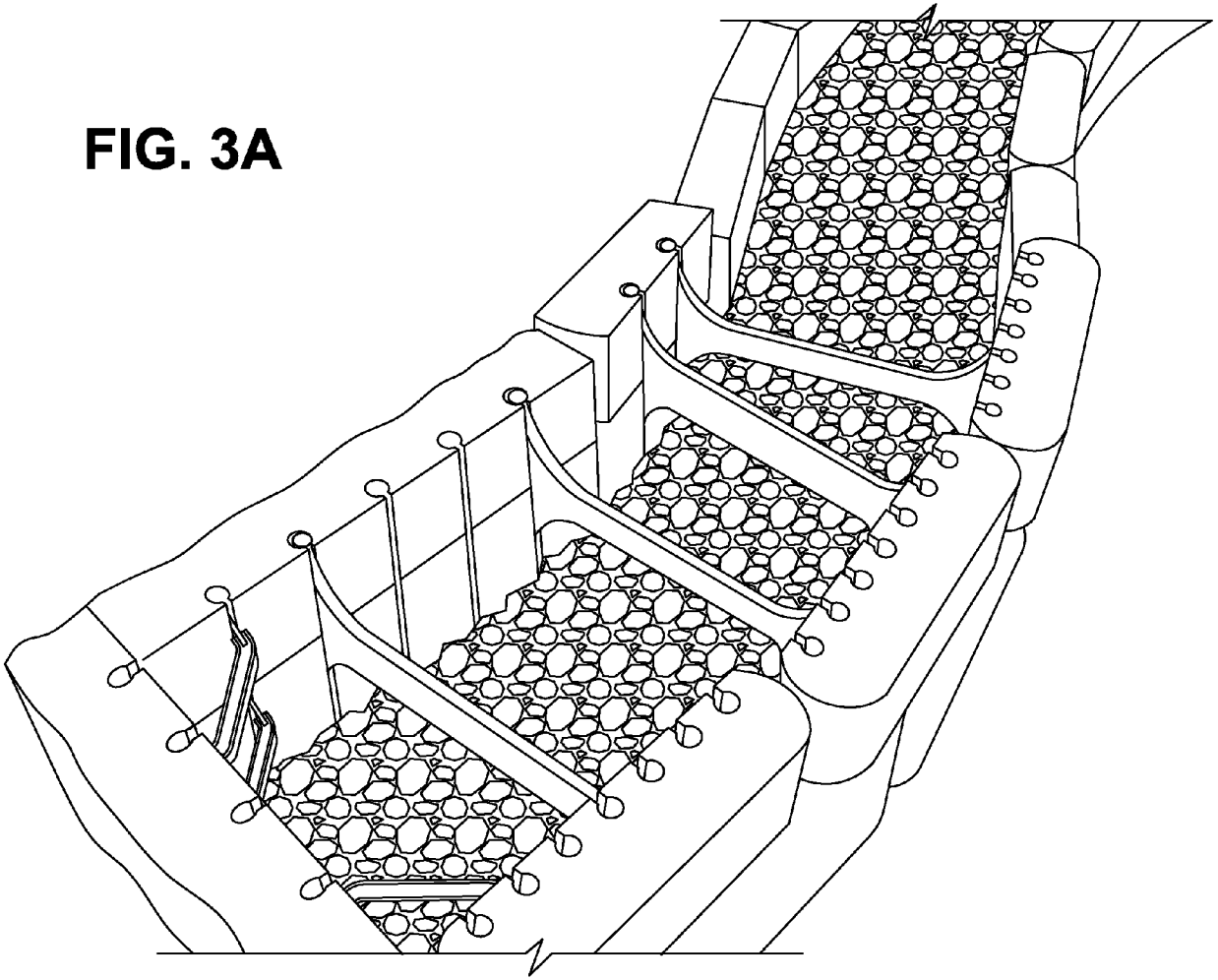
FIGS. 3*a* and 3*b* are perspective views of the decorative wall of FIG. 1 with facing and backer blocks connected in a back-to-back arrangement, and filled with gravel.
Figure 3B:
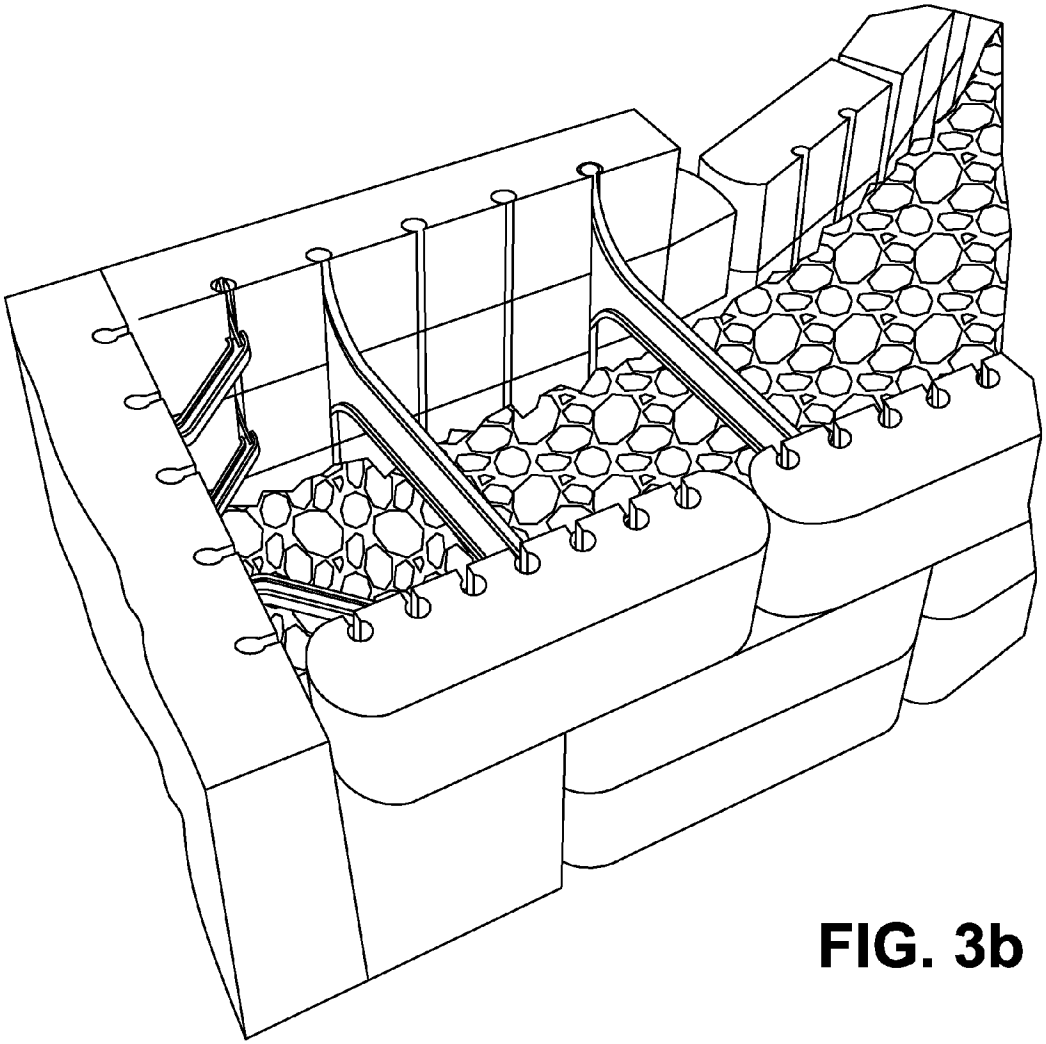
Figure 4A:
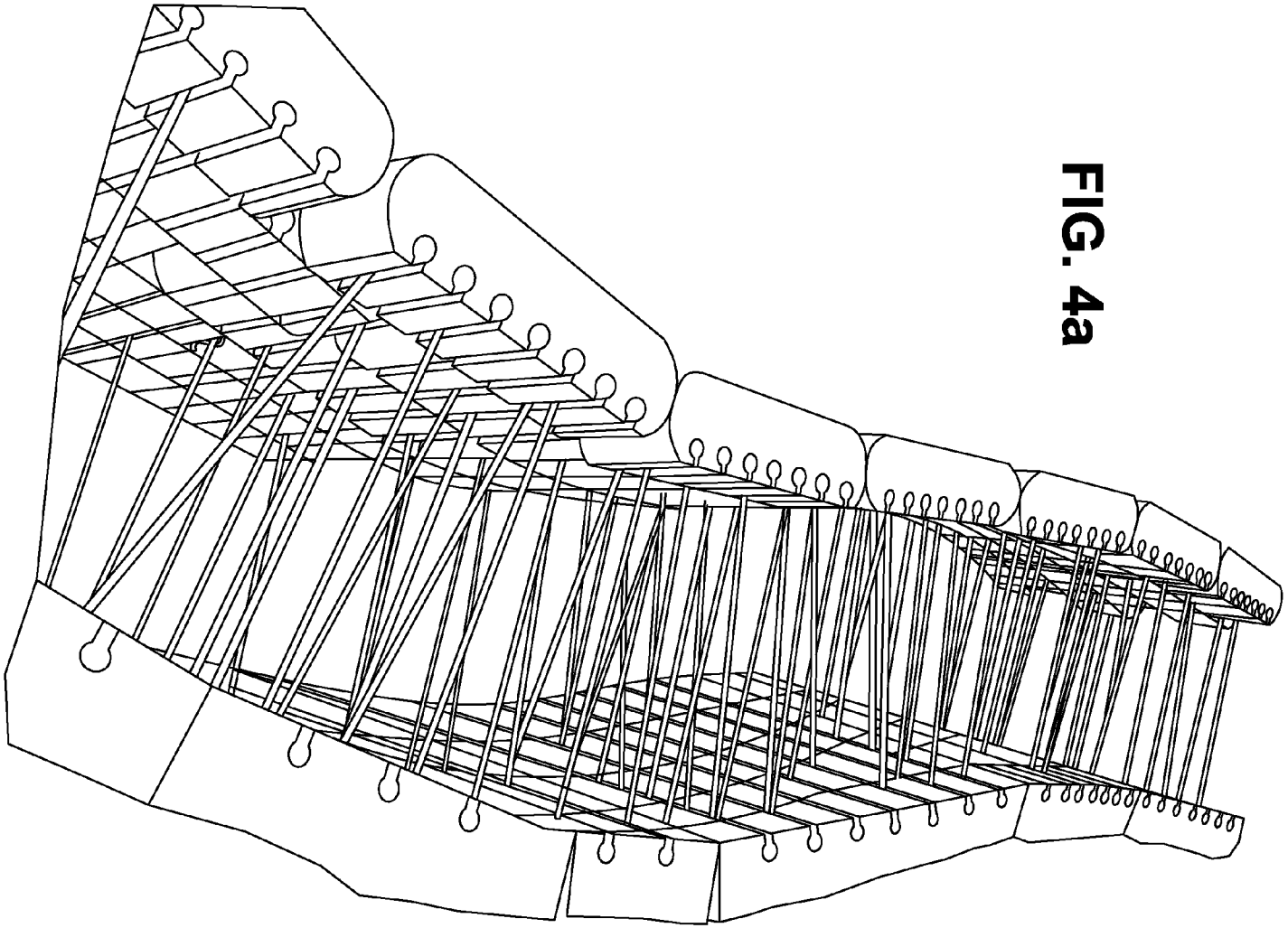
FIGS. 4*a* and 4*b* are perspective views of a different exemplary modular wall including different connectors, whereby
Figure 4B:
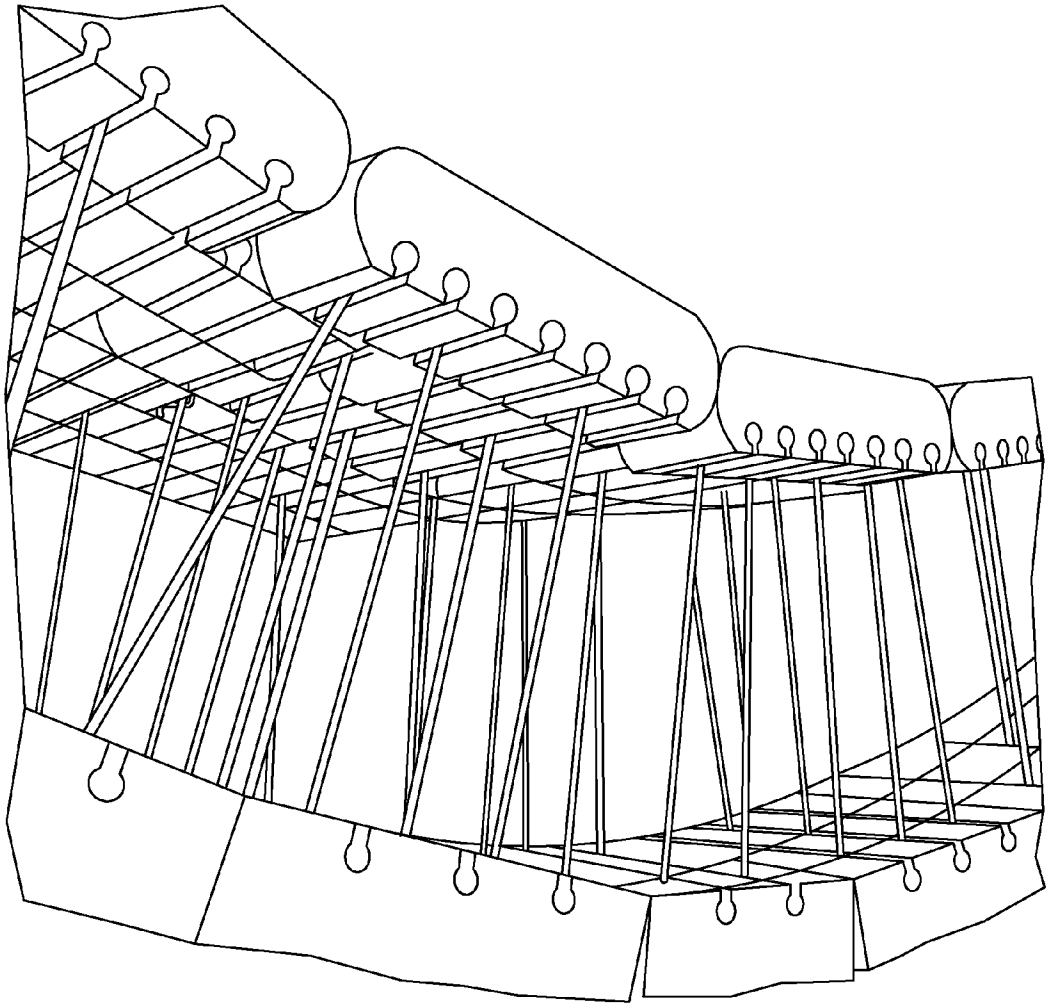
Figure 5A:
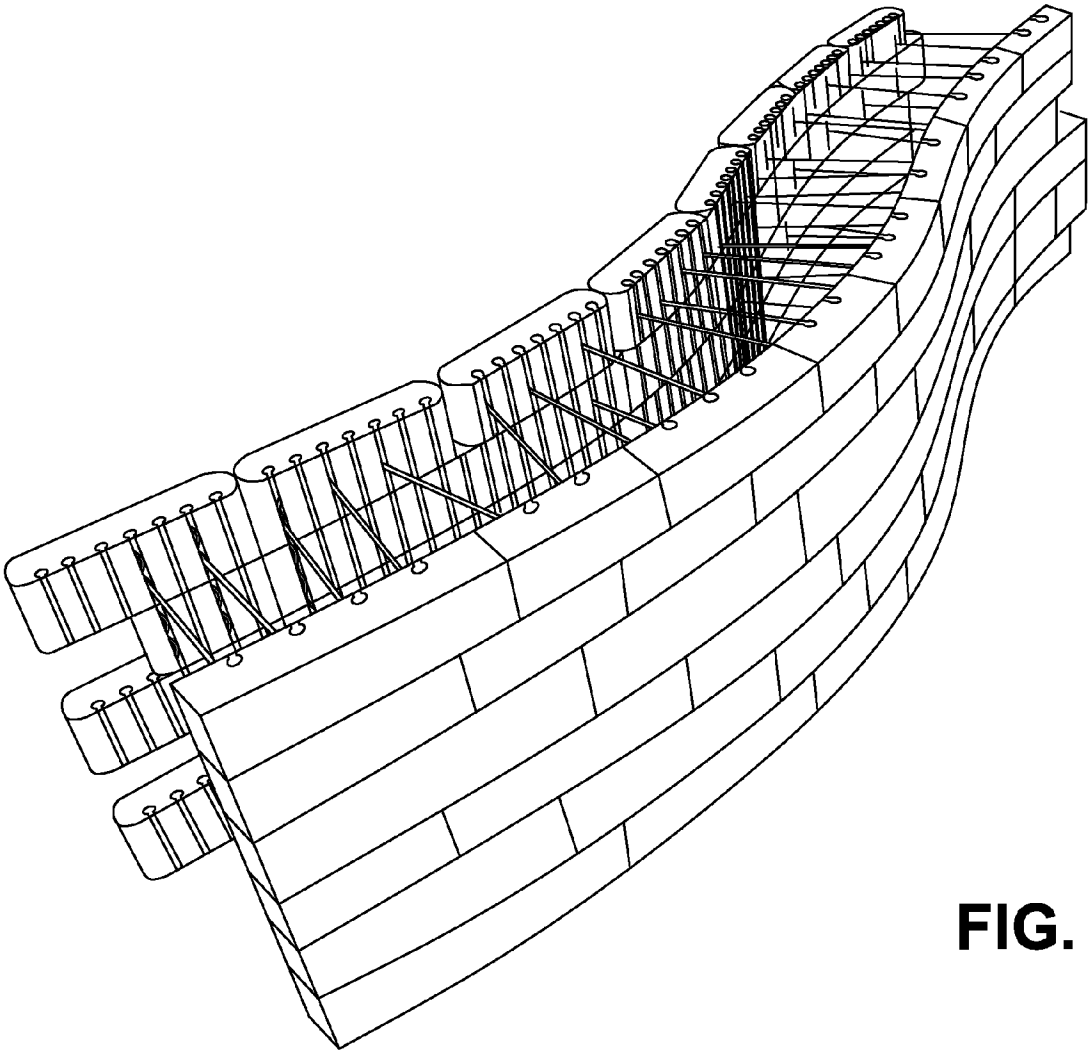
FIGS. 5*a* and 5*b* are front and rear views of the wall of FIG. 4*a*.
Figure 5B:
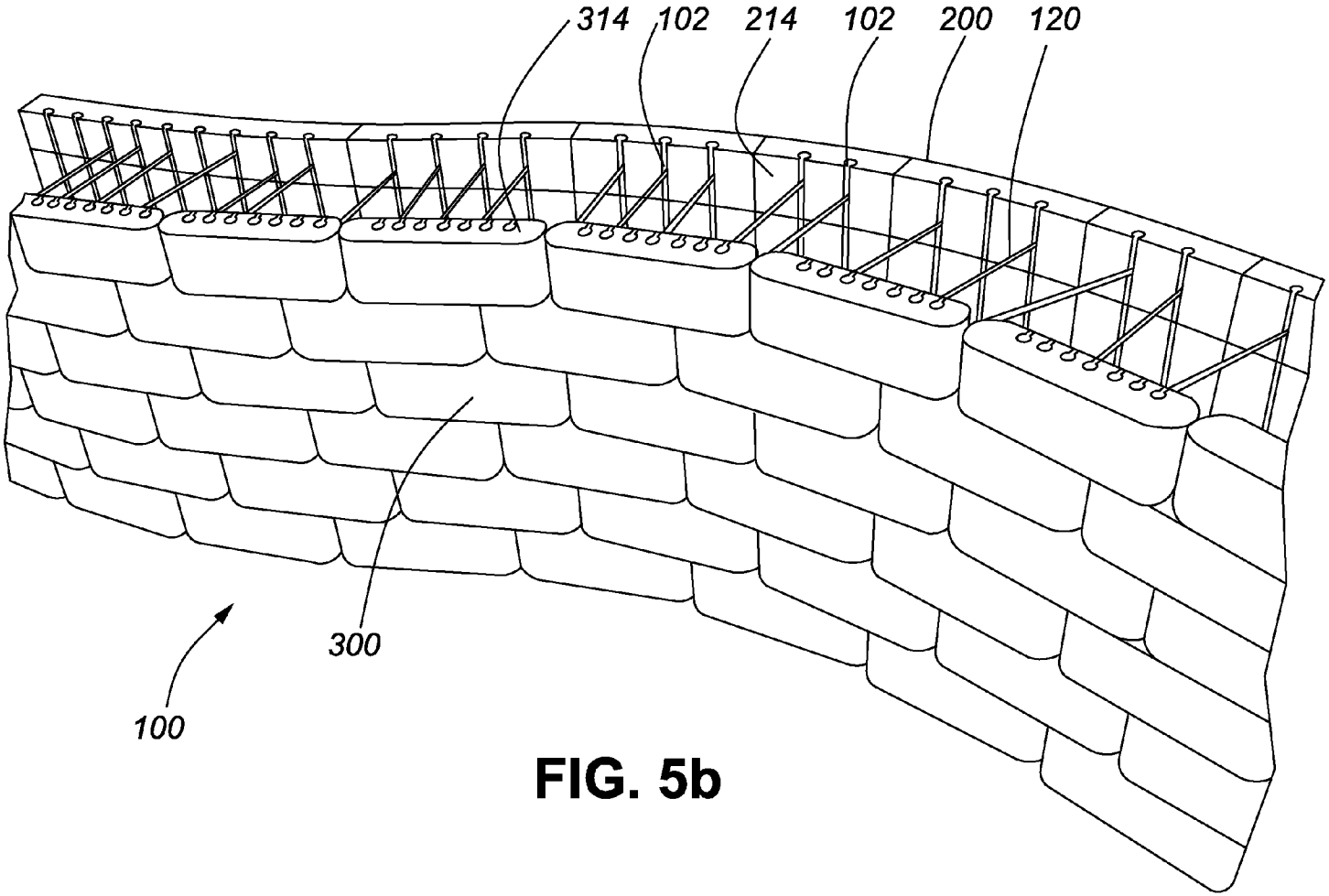
Figure 5C:
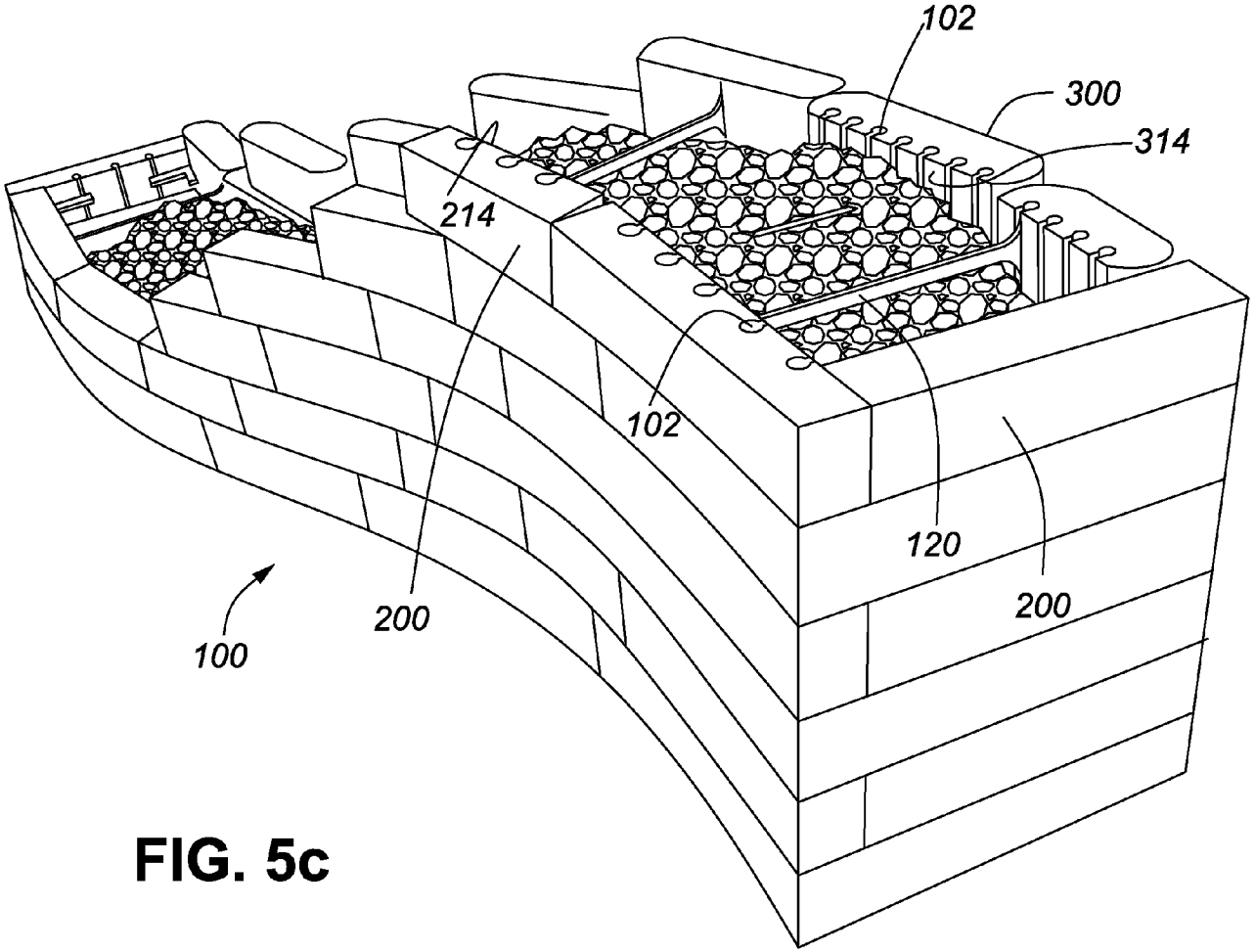
FIG. 5*c* is an end view of the wall of FIG. 3*a*.
Figure 6A:
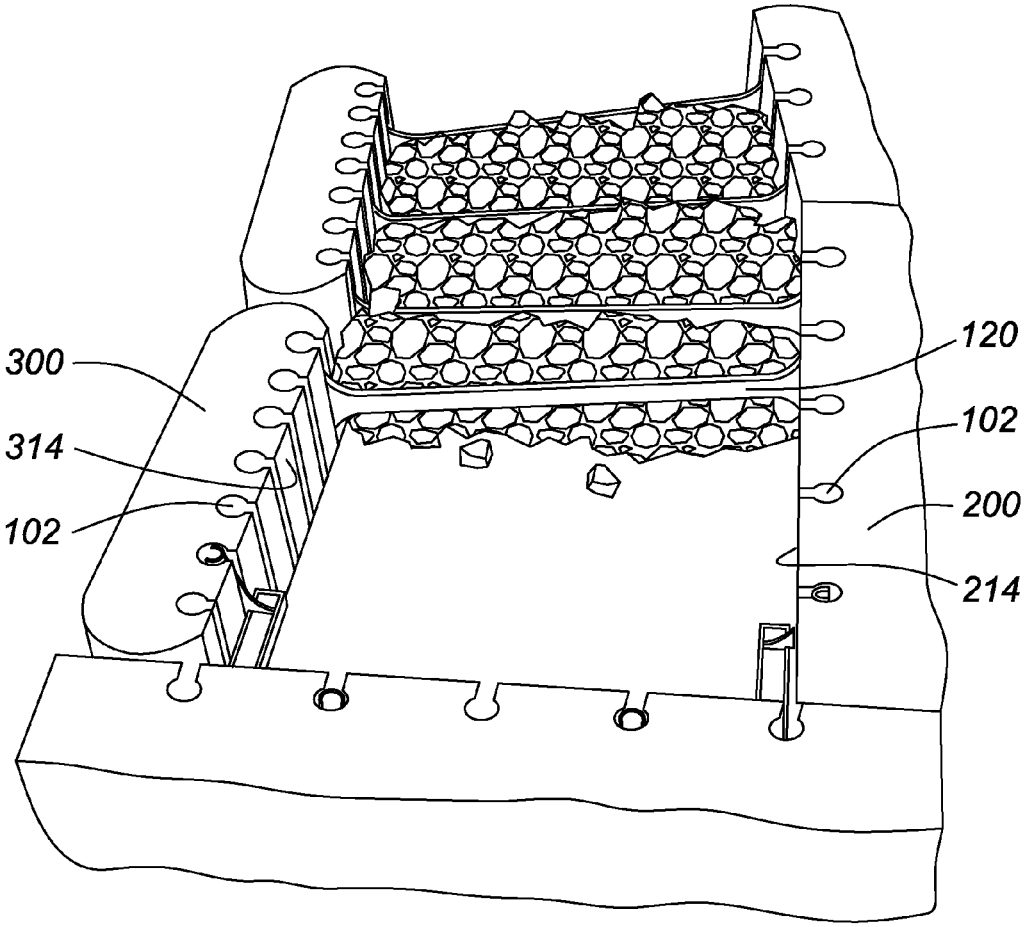
FIGS. 6*a* to 6*e* illustrate different steps in the assembly of a modular wall as disclosed.
Figure 6B:
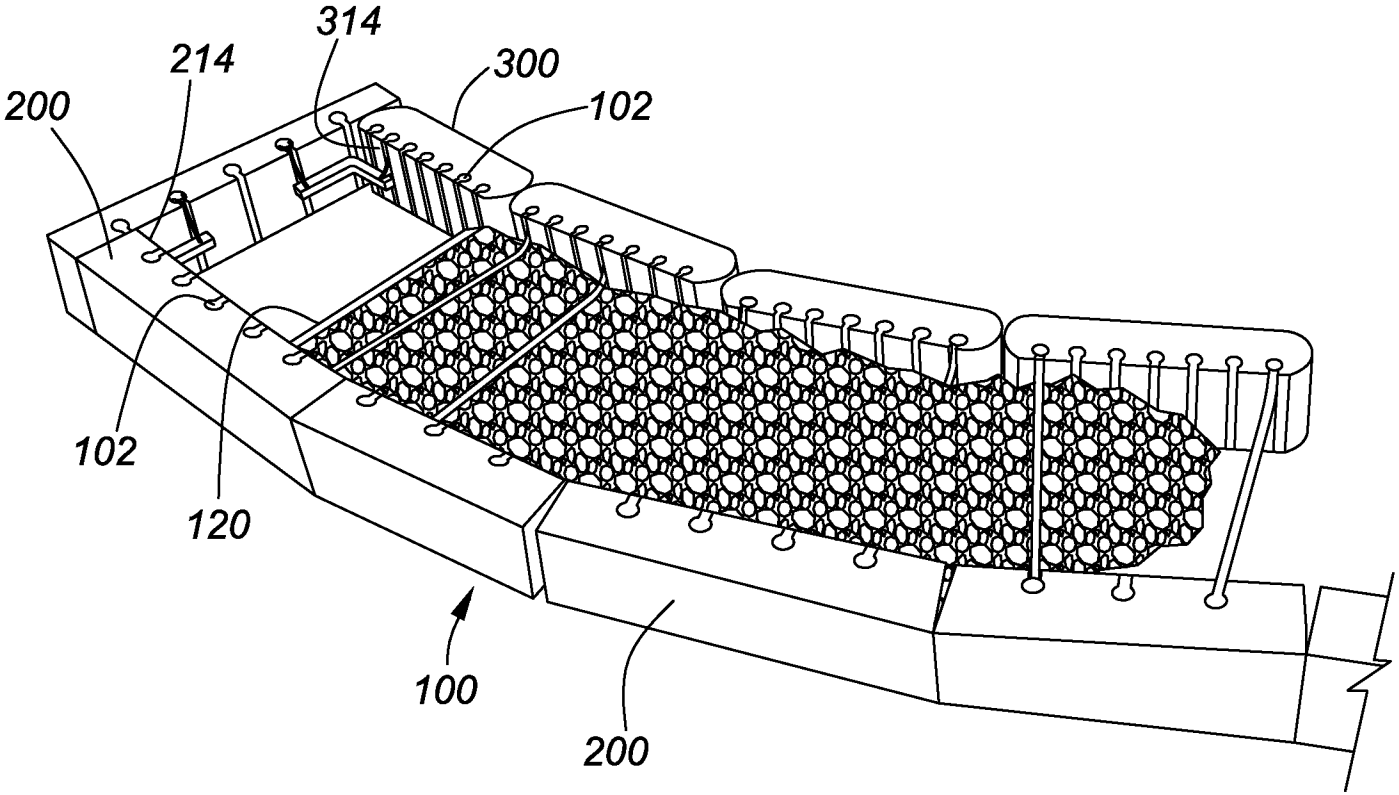
Figure 6C:
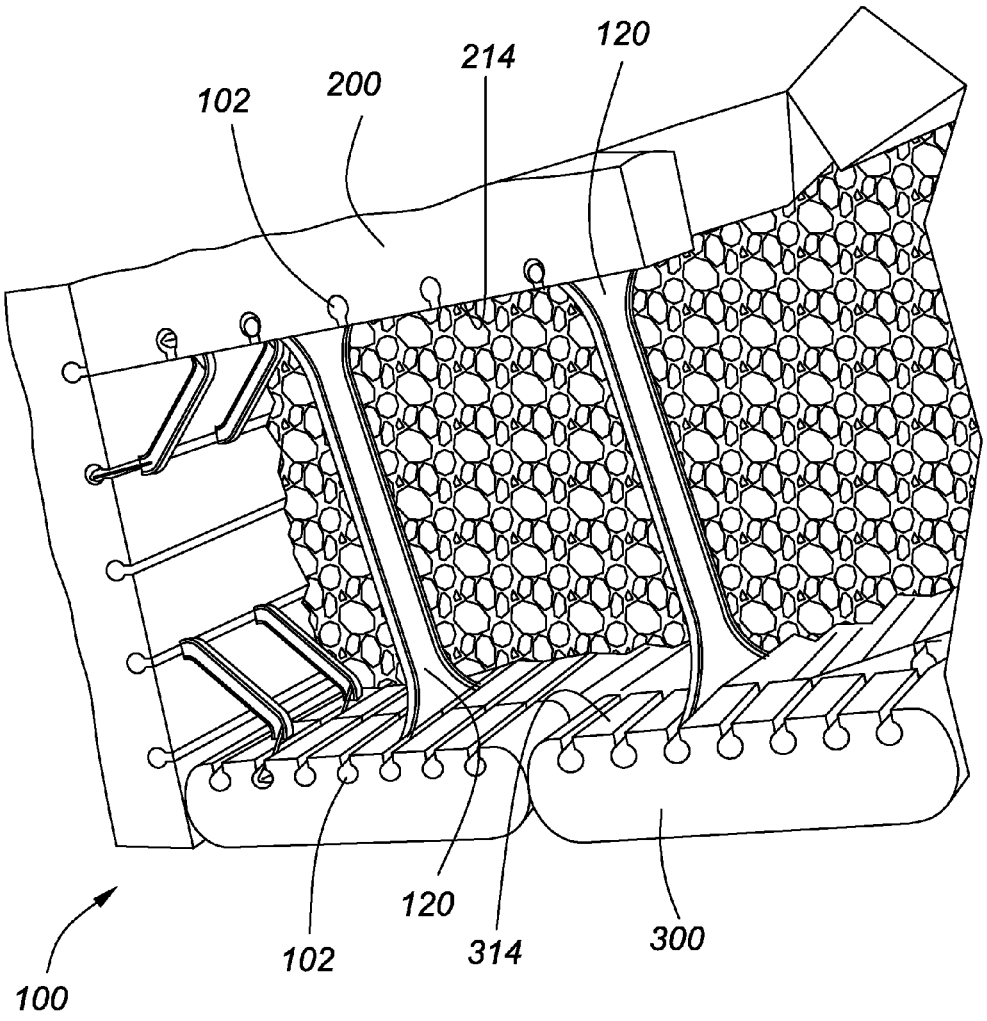
Figure 6D:
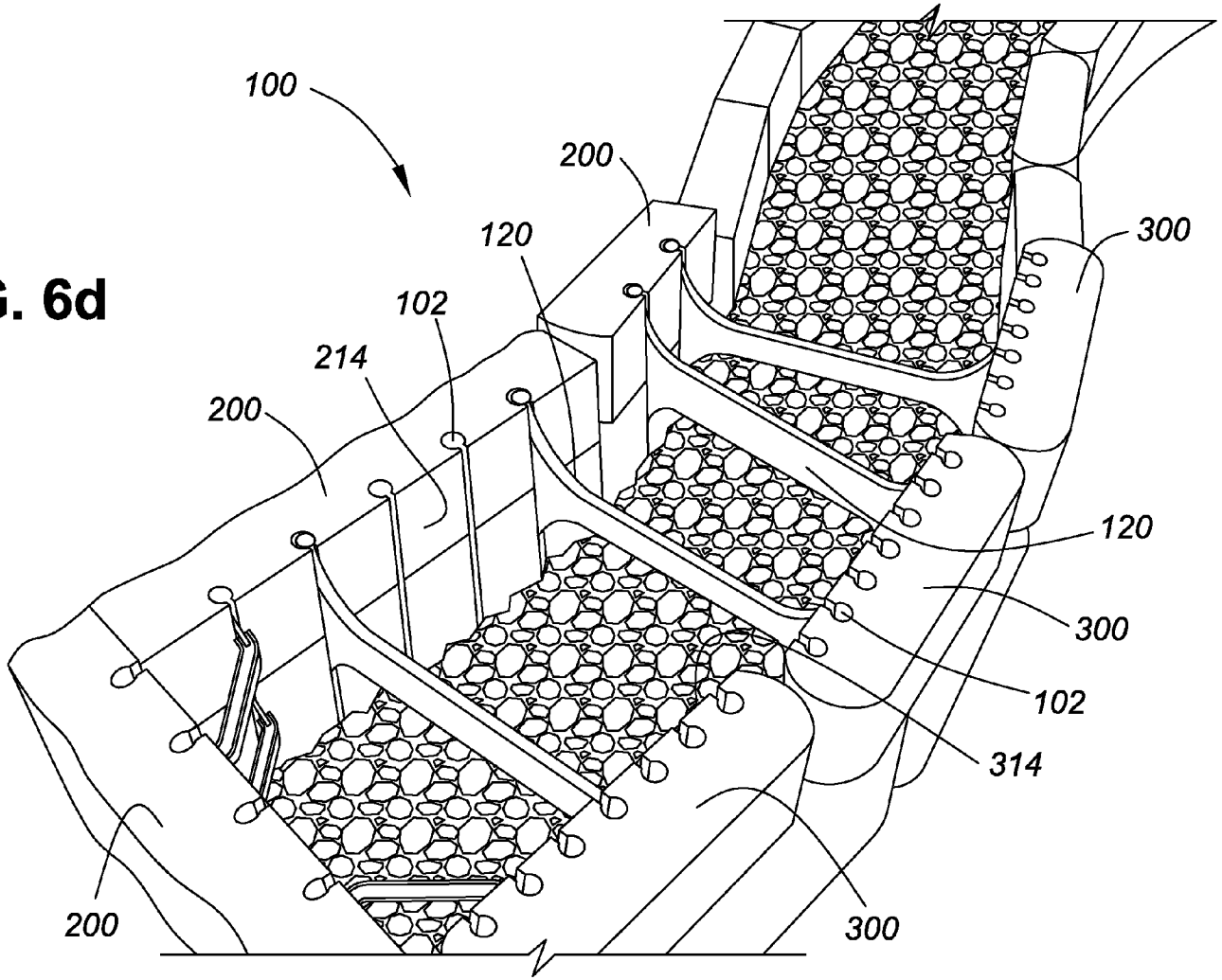
Figure 6E:
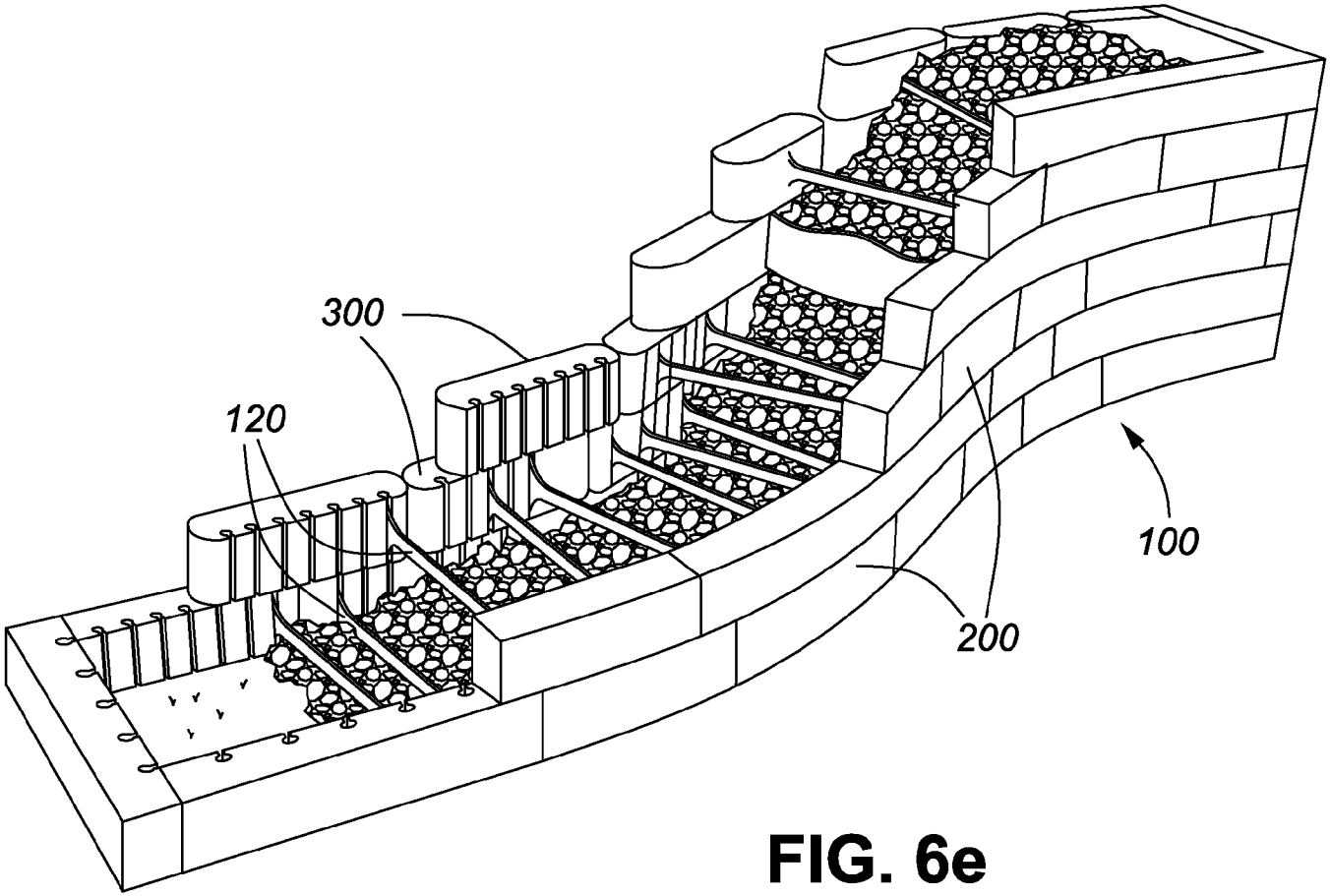
Figure 7:
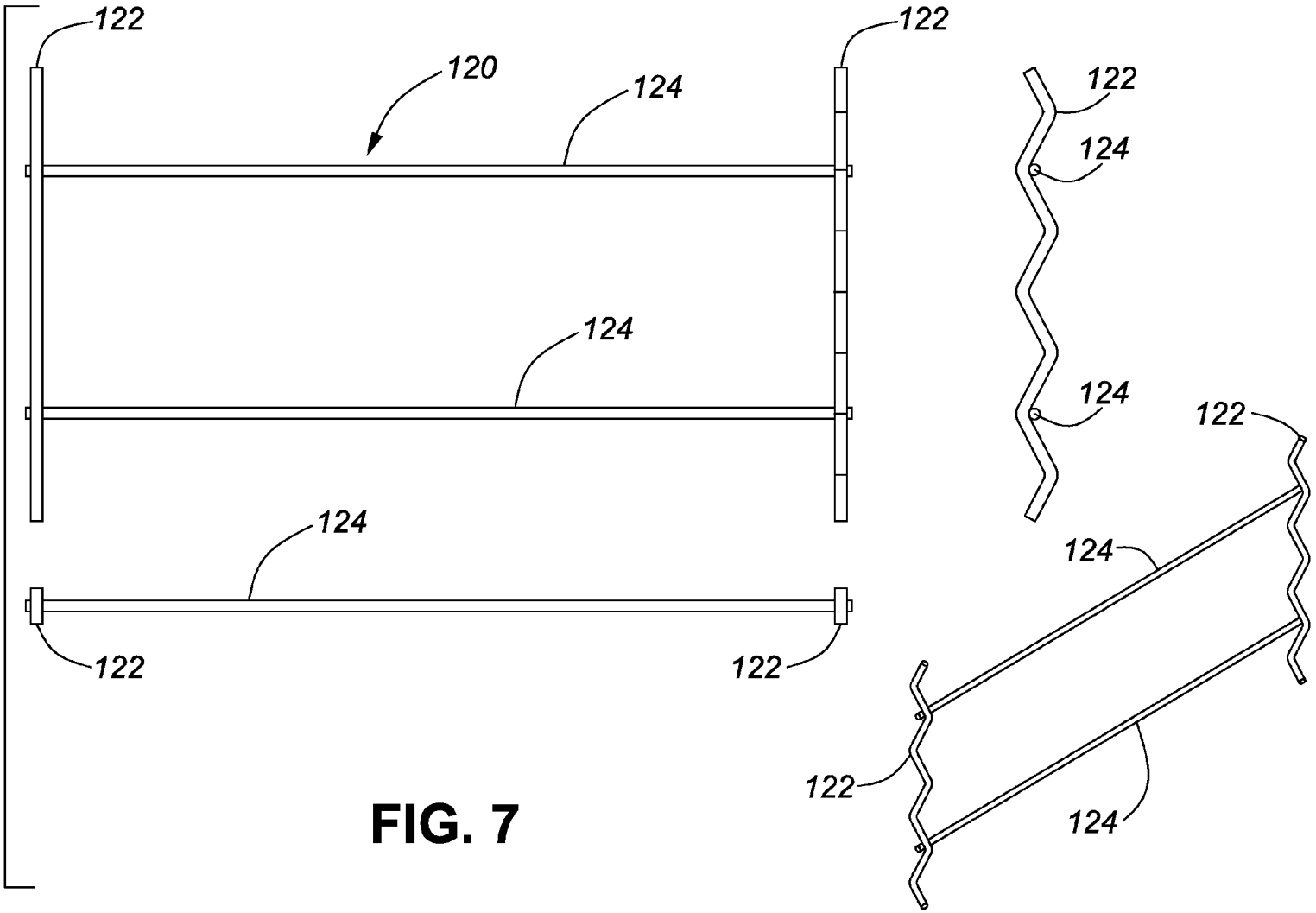
FIG. 7 shows a rod type connector for use in a modular wall as disclosed.

FIG. 1 schematically illustrates an exemplary corner arrangement of a modular wall in accordance with the invention, wherein an end of the wall is formed with facing blocks 200. As is apparent, the facing blocks 200 are stacked to form the corner and special corner connectors 125 are used. The corner connectors 125 can extend diagonally as shown in FIG. 1 or be L-shaped and extend along the corner as shown in FIGS. 5*c*, 6*a* and 6*b*.

The facing blocks 200 are preferably provided with a bevel or step at their lateral ends in order to allow for a closer fit of the facing blocks in curved wall applications (see FIG. 1). The curvature of the wall can then be adjusted by using facing blocks of different length, longer blocks being used in the outer partial wall of the decorative wall. However, the same effect can be generated with stepped ends, or blocks with a T-shaped cross-section in horizontal cross-section. Generally, the shorter the blocks, the tighter the radius that can be created.

FIGS. 14*a* to 14*f* show different retaining walls as disclosed including structures to create a setback for consecutive rows. FIGS. 14*c* to 14*f* illustrate the use of setback plugs 132 which are inserted into the keyhole slots 102 of the consecutive rows of backer blocks 300 to create a backward setback 135 (see FIGS. 14*b* and 14*d*) of consecutive rows. This setback 135 is achieved in the embodiment of FIGS. 14*a* and 14*b* by providing each backer block 300 with a downwardly extending setback nose 320 at a bottom edge of the front surface 312 of the block. The setback 135 is achieved in the embodiment of FIGS. 14*c* to 14*f* with a setback plug 132 having a Z shaped body 133 having a first leg 137 for engagement of the rear surface 314 of a first backer block 300*a* and an offset second leg 138 for engagement of the rear surface 314 of a second backer block 300*b* stacked on top of the first backer block 300*a* and a central web 139 creating the offset between the legs 137, 138 and, thus, the offset 135 between successive rows of backer blocks 300. The setback plug 132 further includes an interlocking member 134 for engagement of the keyhole slot 102 and may also include a stiffening web 136 for support of the second leg 138.

Figure 15A:
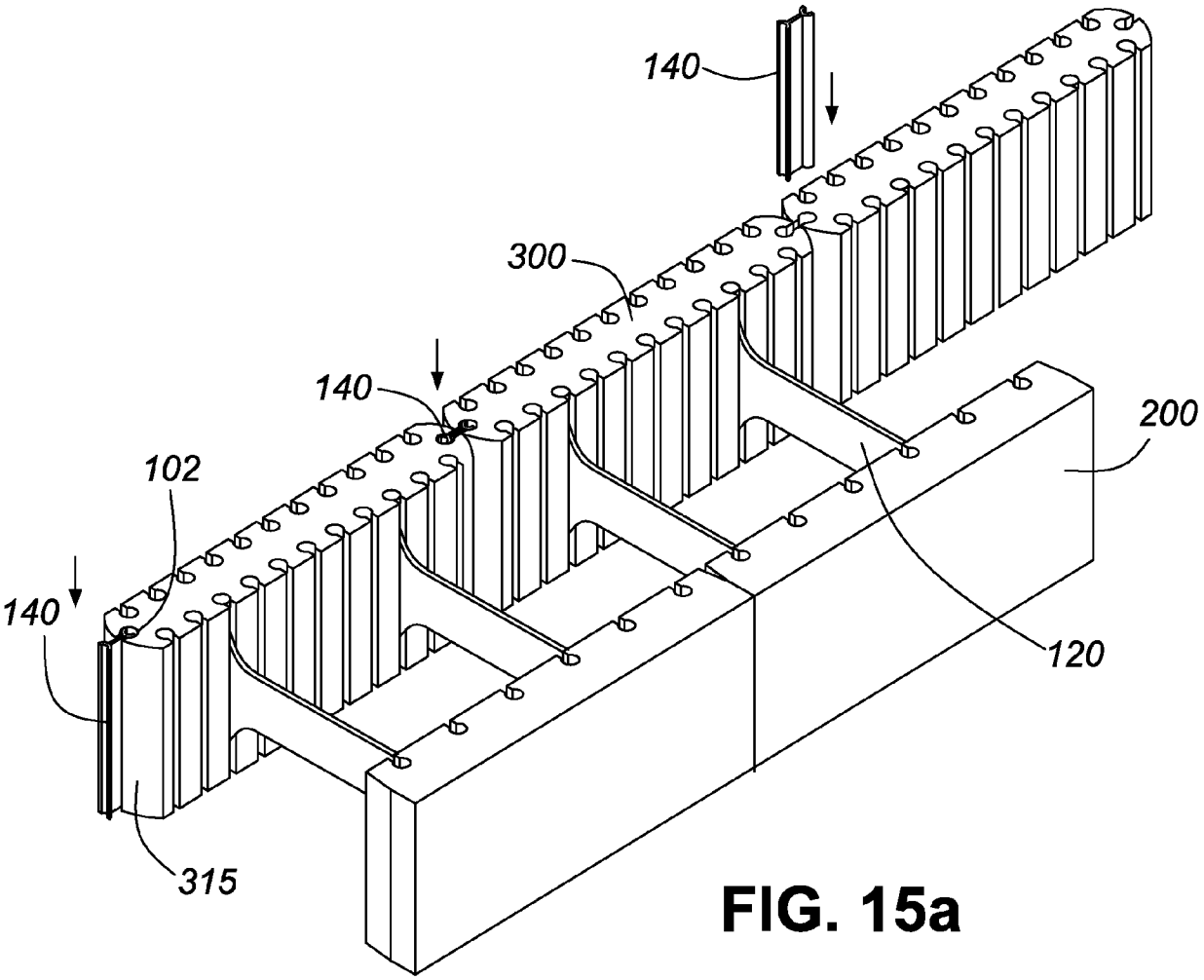
FIGS. 15*a* to 15*c* illustrate an end-to-end connection of the backer blocks.
Figure 15B:
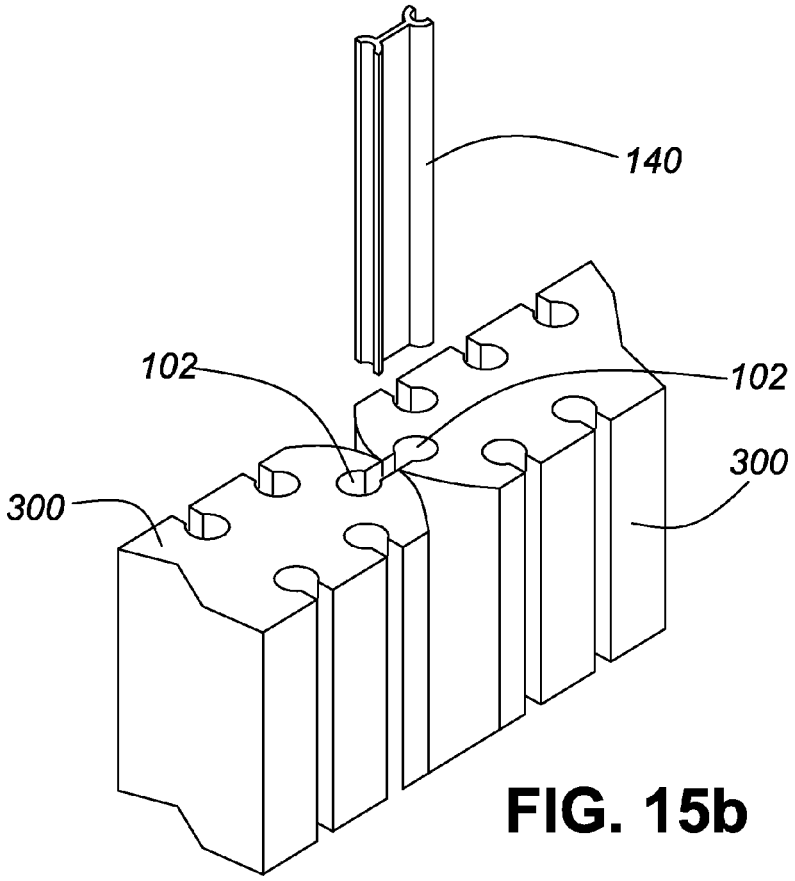
Figure 15C:
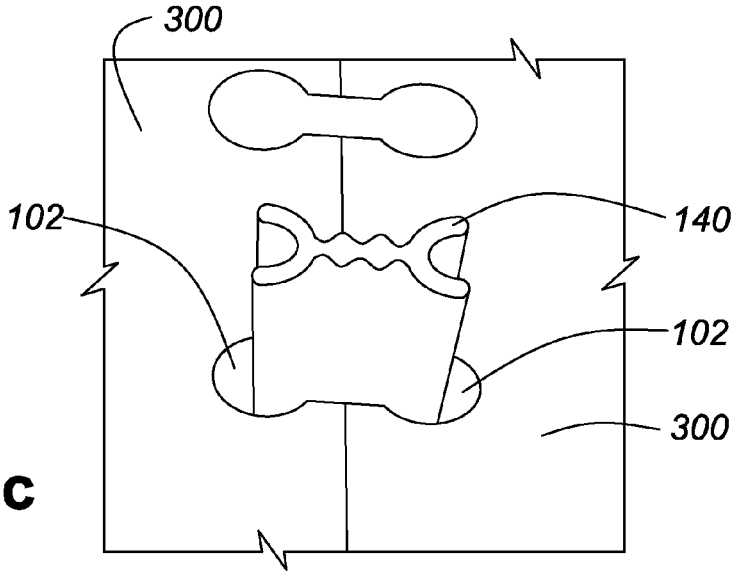

To ensure a proper end-to-end placement of the backer blocks 300 and to reliably form a continuous rear wall portion of backer blocks, the ends of the backer blocks 300 can be connected by end connectors 140 inserted into keyhole slots 103 provided in the end surfaces 315 of the backer blocks 300, as illustrated in FIGS. 15*a* to 15*c*. The term continuous wall portion as used here refers to a wall portion made with stacked blocks (facing or backer blocks) which are stacked end-to-end with little or no intermediate spacing so that loss of the loose filler material in the intermediate space between the front and rear portion walls is prevented. It is understood that the finer the filler material the tighter the required end-to-end fit of the blocks.

Figure 16A:
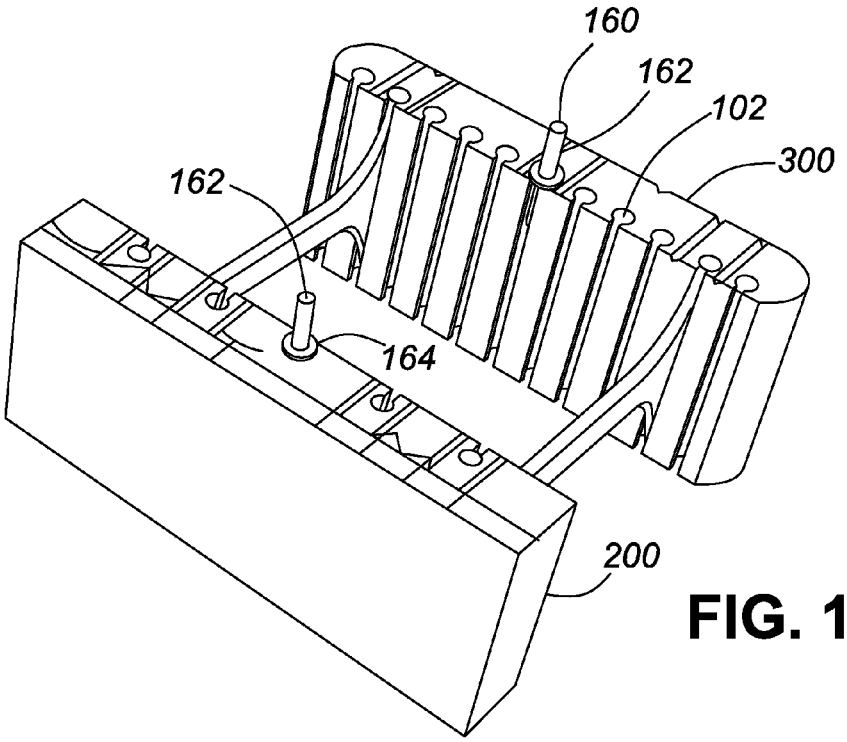
FIGS. 16*a* and 16*b* illustrate the principle of vertically interlocking or connecting successive rows of facing or backer blocks.
Figure 16B:
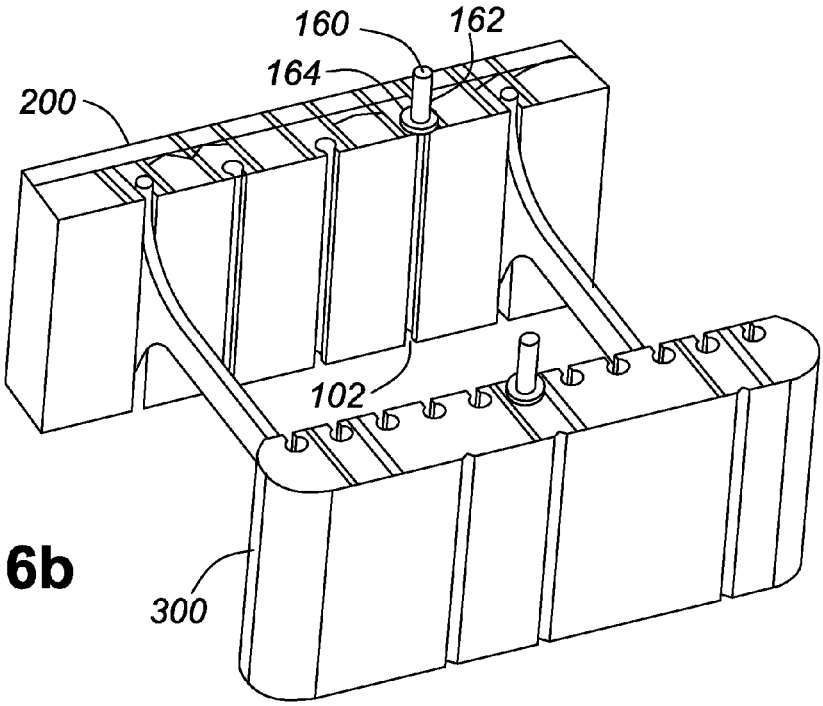

FIGS. 16*a* and 16*b* illustrate different principles of vertically interlocking or connecting successive rows of facing or backer blocks. Connecting studs 160 can be used which have a generally cylindrical body 162 for insertion into the bore portion 206 of the keyhole slots 102 of vertically adjacent blocks 200, 300. A central flange 164 on the body 162 is sandwiched between the vertically adjacent blocks in the installed condition, which prevents sliding of the connecting stud 160 in the bore portion 206.

Figure 17A:
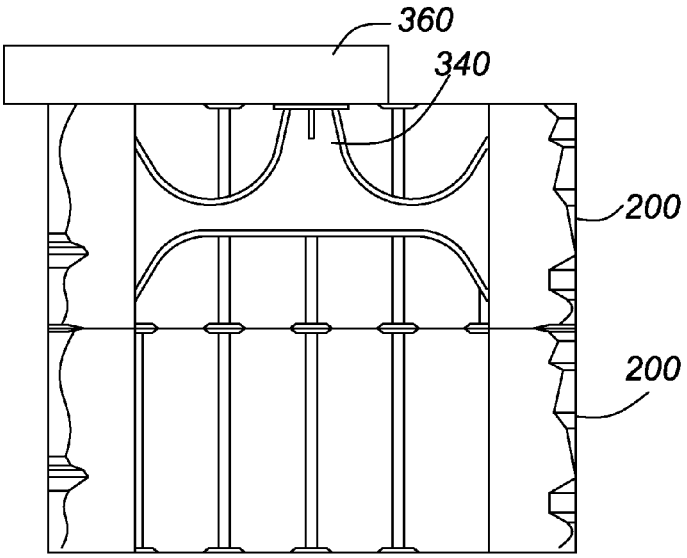
FIGS. 17*a* to 17*c* illustrate the principle of supporting a coping or wall cap having a depth smaller than the wall assembly, using a specialized connector.
Figure 17B:
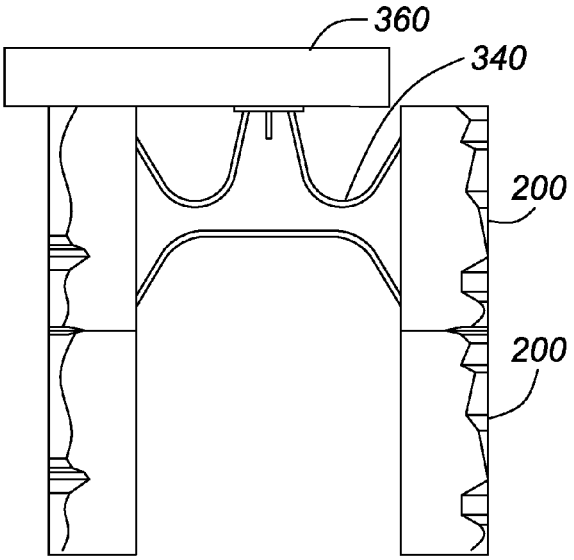
Figure 17C:
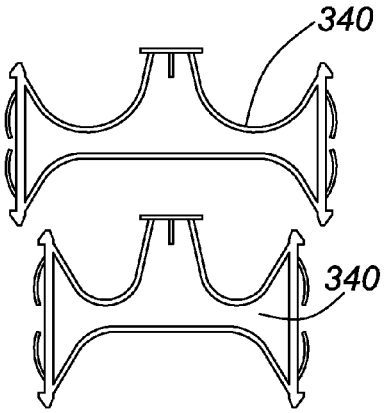

FIGS. 17*a* to 17*c* illustrate the principle of supporting a coping or wall cap 360 having a depth smaller than the wall assembly, using a specialized connector 340.

Figure 18A:
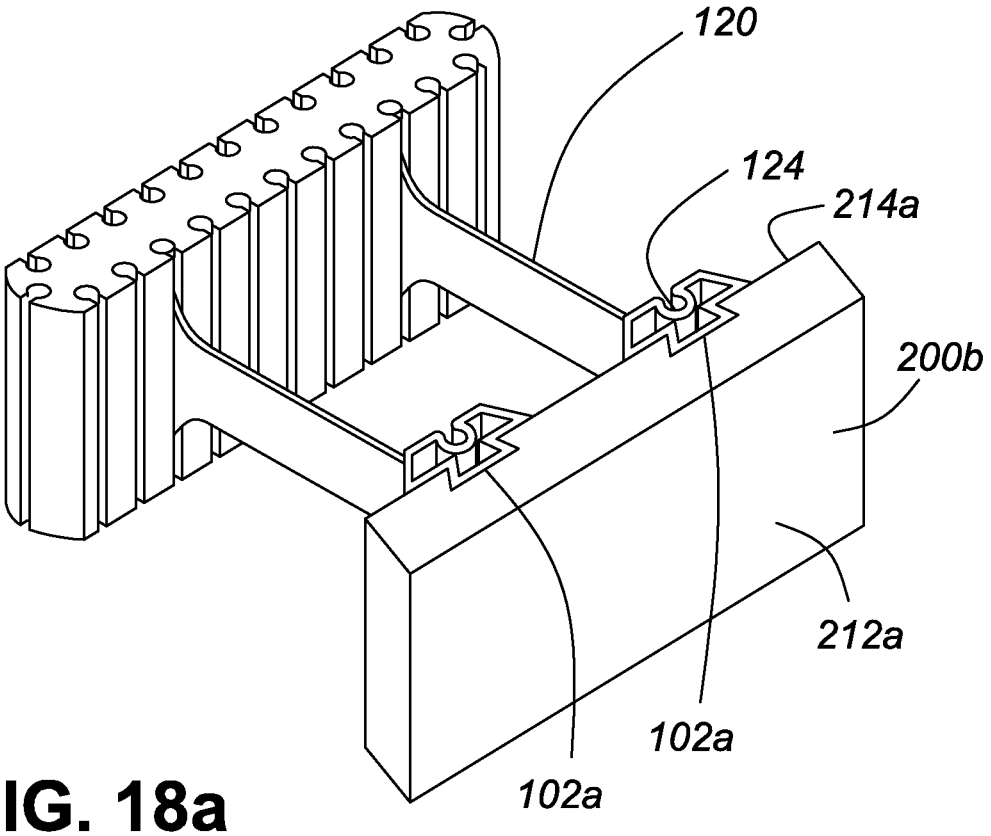
FIGS. 18*a* and 18*b* illustrate a specialized facing block and its incorporation into a wall as disclosed.
Figure 18B:
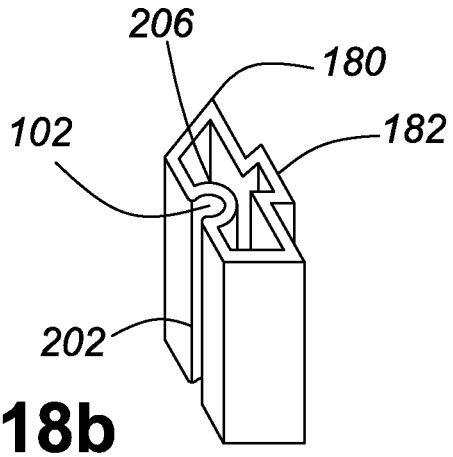

FIGS. 18*a* to 18*b* illustrate special facing blocks 200*b* and 200*c* for use in a wall in accordance with this application. The facing block 200*b* can be of natural or synthetic material, such as wood, steel, stone, etc., but is preferably a slab of natural stone which has a front surface 212*a* and a back surface 214*a*. The facing block 200*b* has multiple spaced apart parallel dovetail shaped retaining slots 102*a* cut into its back surface 214*a*. Each retaining slot 102*a* receives a connector 180 with a dovetail shaped protrusion 182 to engage the retaining slot 102*a* and a keyhole slot 102 for receiving the connecting portion 122 of a connector 120. The keyhole slot has a slot portion 202 and a cylindrical bore portion 206 connected thereto. The facing block 200*b* is preferably sized and shaped to permit stacking into a continuous wall. However, the width of the facing blocks 200*b* is insufficient for the stacked facing blocks to function as a retaining wall.

Figure 19A:
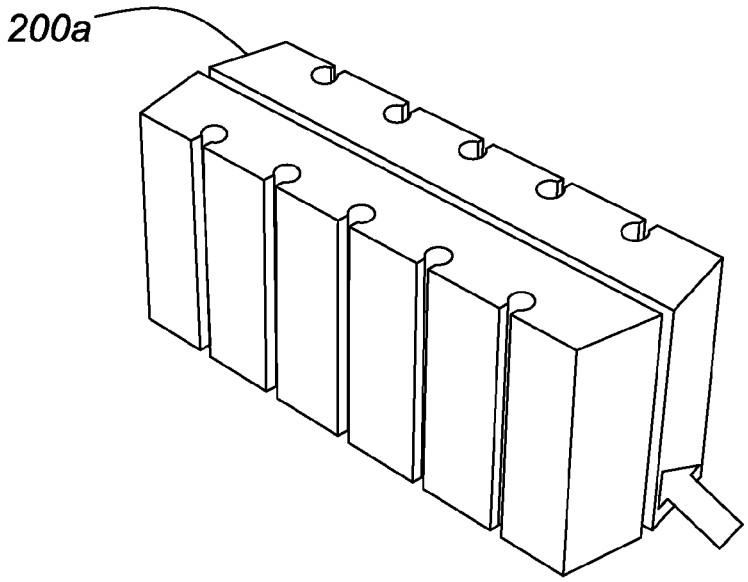
FIGS. 19*a* to 19*c* illustrate a decorative freestanding wall made with hardsplit facing blocks.
Figure 19B:
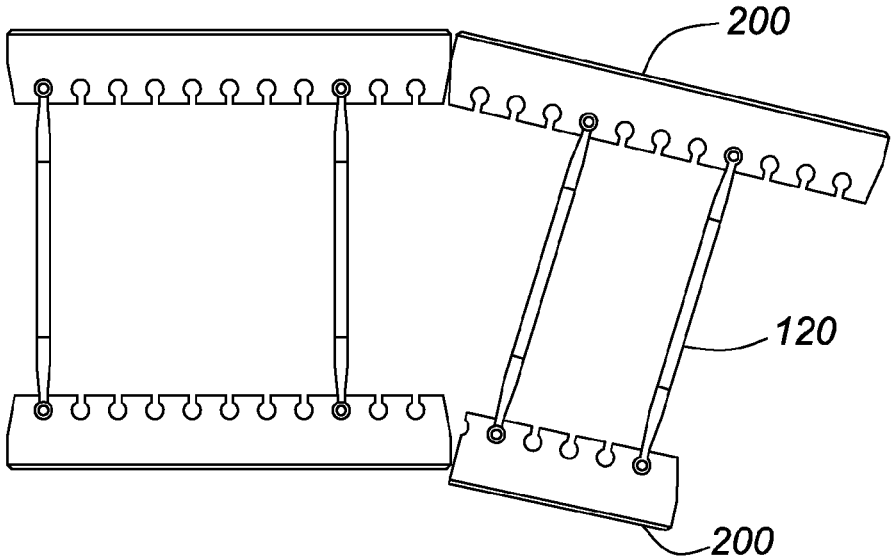
Figure 19C:
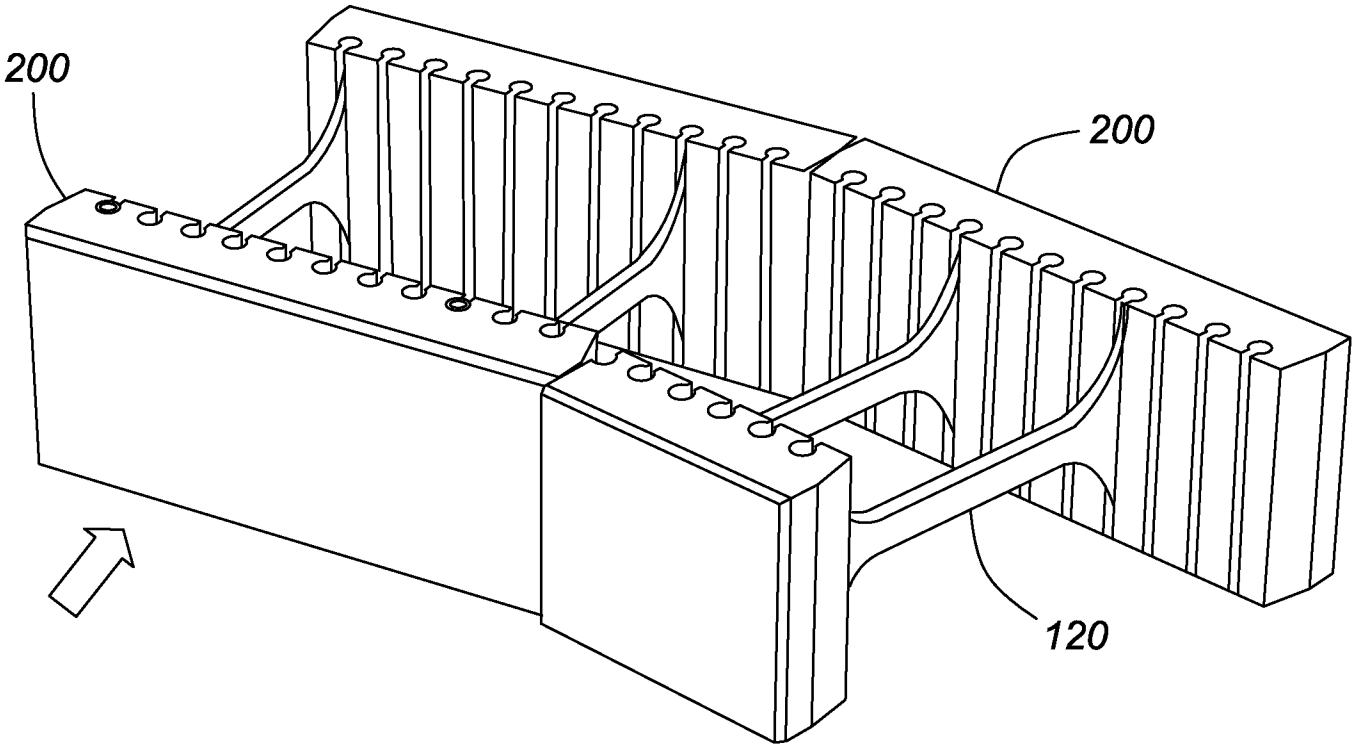

FIGS. 19*a* to 19*c* illustrate a decorative freestanding wall made with hardsplit facing blocks.

Figure 20A:
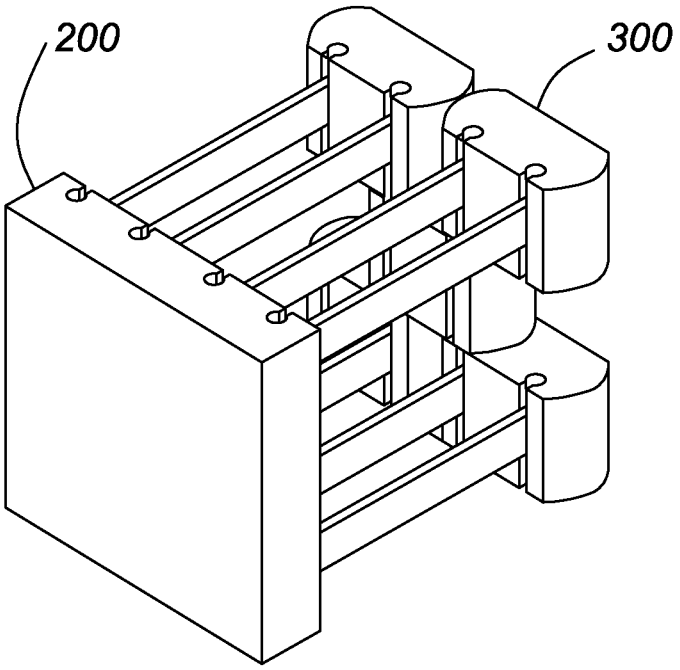
FIGS. 20*a* and 20*b* illustrate a wall system with facing and backer blocks of different sizes.
Figure 20B:
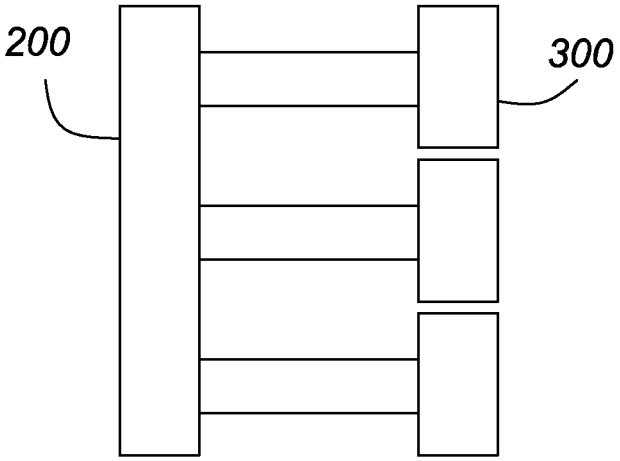

FIGS. 20*a* and 20*b* illustrate a concrete panel wall system with facing and backer blocks of different sizes.

FIGS. 21*a* to 21*e* illustrate different orientations of the interlocking between the connectors 120 and the blocks 200, 300, wherein the connectors can have interlocking members 122 at opposite ends of the connector body 124 which are oriented at 90° to one another. The keyhole slots 102 in the facing blocks 200 and/or the backer blocks 300 can be extending in horizontal or vertical direction in the installed condition of the blocks.

Figure 22B:
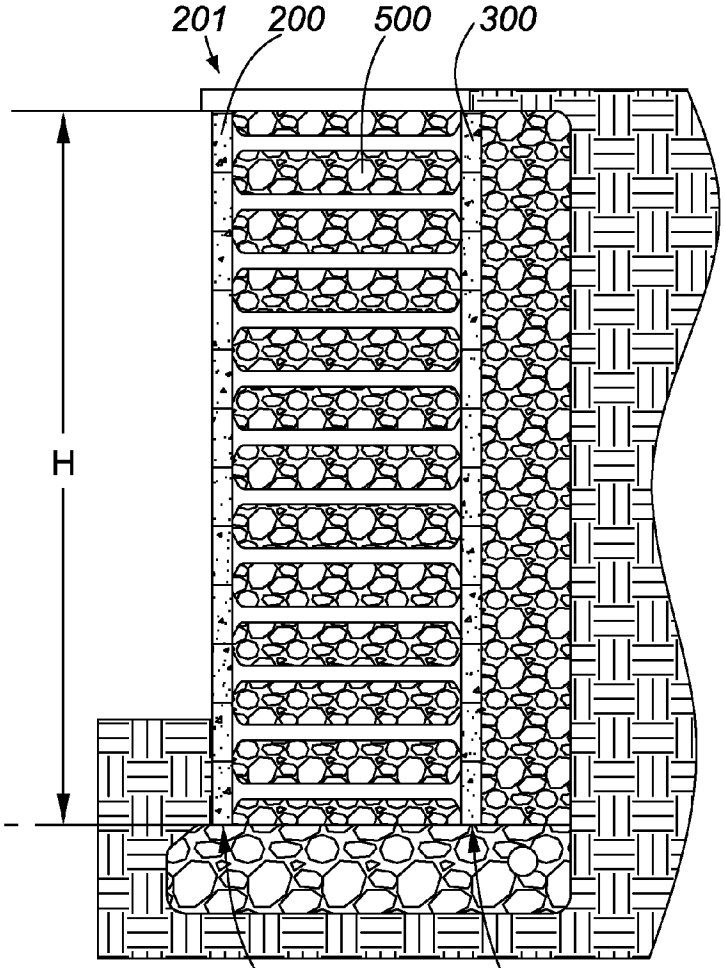
FIGS. 22*a* and 22*b* illustrate schematically the relationship between total mass of the retaining wall and the length of the connectors.
Figure 22A:
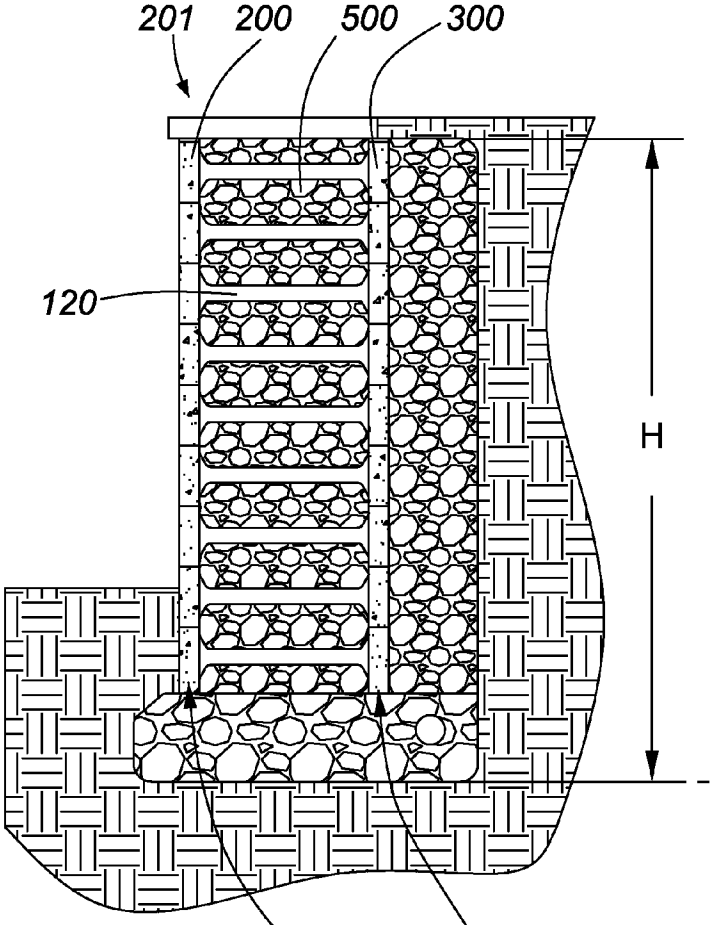

The invention also provides an assembly method for assembling a modular retaining wall in accordance with the invention the wall a preselected height H and total mass per unit length. FIGS. 22*a* and 22*b* respectively show retaining walls of different height and mass, made of identical facing blocks 200 and backer blocks 300, but using connectors 120 of different length and different amounts of the same filler material. The mass of the different walls is determined solely by the length of the connectors and the amount of the filler material. The method includes the steps of obtaining a plurality of the facing blocks 200, each having a known mass, obtaining a plurality of the backer blocks 300, each having a known mass, stacking the facing and backer blocks in a back-to-back orientation to form a continuous front wall portion 201 of facing blocks and having the preselected height H and a continuous rear wall portion 301 of backer blocks having the preselected height H, connecting the front and rear wall portions 201, 301 during stacking of the facing and backer blocks by connecting the back surface 214 of each facing block 200 in the front wall portion 201 with the back surface 314 of a least one backer block 300 in the rear wall portion 301 with a connector 120 for connecting the front and rear wall portions in the back-to-back orientation for forming an interior space for receiving a filler material 500 of known density, and filling the interior space with the filler material. The filler material is a loose filler material loose filler material, such as earth, sand gravel, crushed stone, or the like, which can be easily poured into the intermediate space and have a known density. Most preferred are free-running materials, such as gravel, crushed stone, or the like to reliably and completely fill the intermediate space.

In order to achieve a preselected total mass, the method of the invention includes the further steps of determining a first mass per unit length of the front wall portion 201, determining a second mass per unit length of the rear wall portion 301, determining a required volume of the filler material 500 needed per until length of the wall to provide a mass of filler material equal to at least a difference between the total mass per unit length and the sum of the first mass and second mass per unit length, and selecting the length of the connectors so that the interior space has a volume at least equal to the required volume. With this method, retaining walls of any desired height and mass can be achieved, always using the identical facing and backer blocks components which can be installed manually. More importantly, this method allows the construction of retaining walls of a height and mass previously not possible with manually installed monolithic retaining wall blocks, whether solid or hollow.

In one embodiment of the method, facing blocks are used which are cast concrete blocks with a back surface and a patterned decorative front surface, preferably dry cast concrete blocks with an embossed, patterned decorative front surface. In this embodiment, the backer blocks are also cast concrete blocks, preferably dry cast concrete blocks.

In another embodiment, the invention provides a method for forming a corner assembly in a modular retaining wall in accordance with the invention, as will be discussed in more detail in the following with reference to FIGS. 23*a* to 23*d*. The term corner in this context defines an area of intersection or overlap between a pair of first and second intersecting walls, which meet at a point. In the illustrated corner assembly which includes the first and second intersecting walls 100*a* and 100*b*, each intersecting wall is built in accordance with the invention and has facing blocks 200, backer blocks 300 and interconnecting connectors 120 to define an intermediate space I for filling with loose filler material (not shown for illustration purposes). For the formation of the corner assembly, the method includes the steps of placing, at the corner, at least one of the backer blocks of the first intersecting wall within the intermediate space of the second wall. Preferably, the method further includes the step of placing, at the corner, at least one of the backer blocks of the second wall within the intermediate space of the first wall.

In one embodiment of the corner assembly method, the steps of placing the at least one backer block of the first wall and placing the at least one backer block of the second wall are carried out for each horizontal row of backer blocks.

Figure 23A:
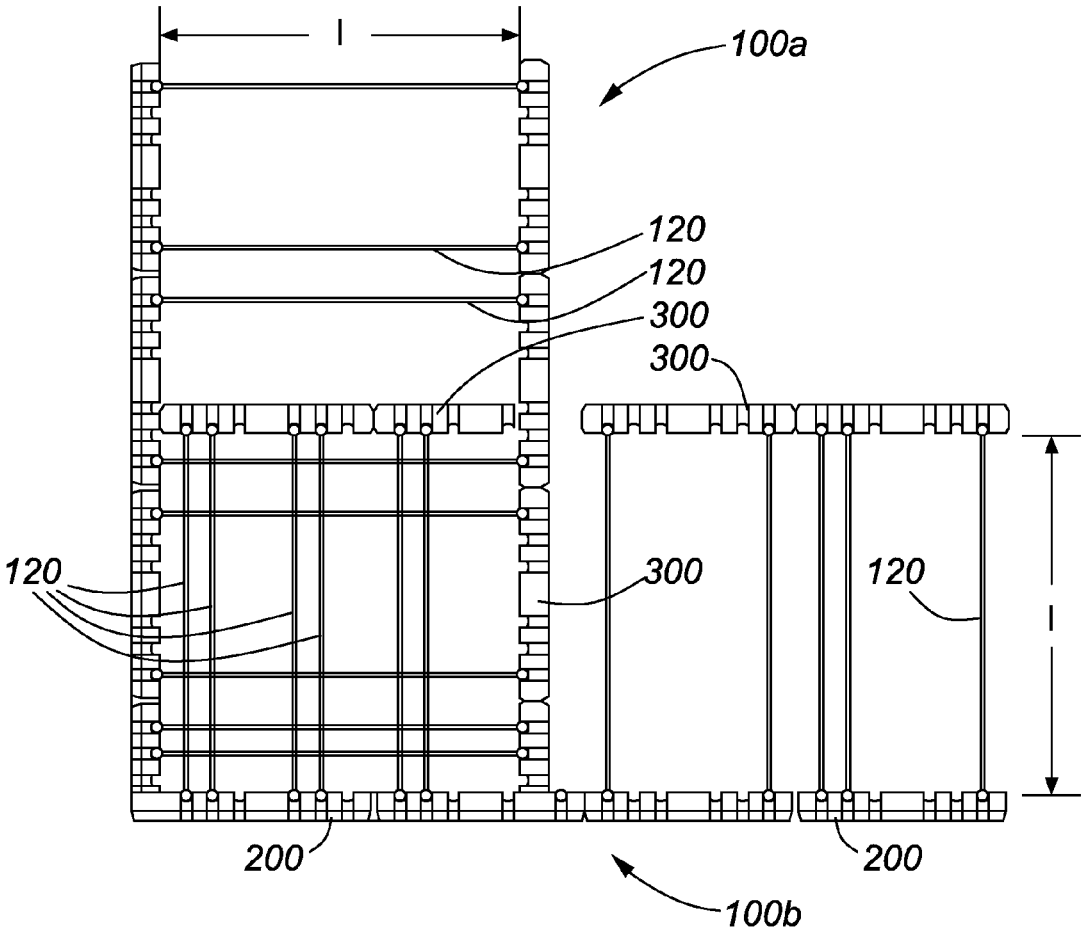
FIGS. 23*a* to 23*d* illustrate schematically a corner assembly for the retaining wall of the invention.
Figure 23B:
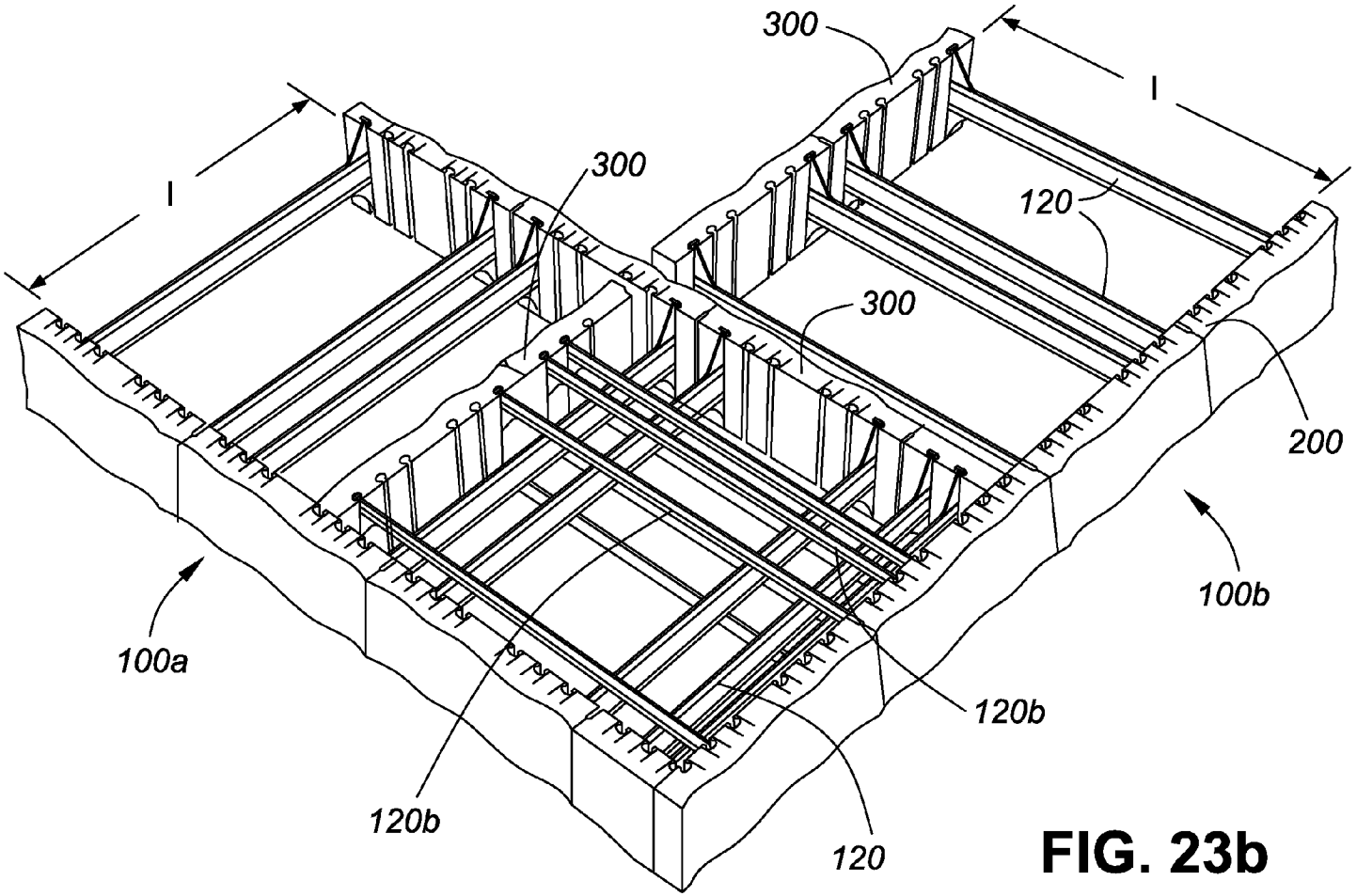
Figure 23C:
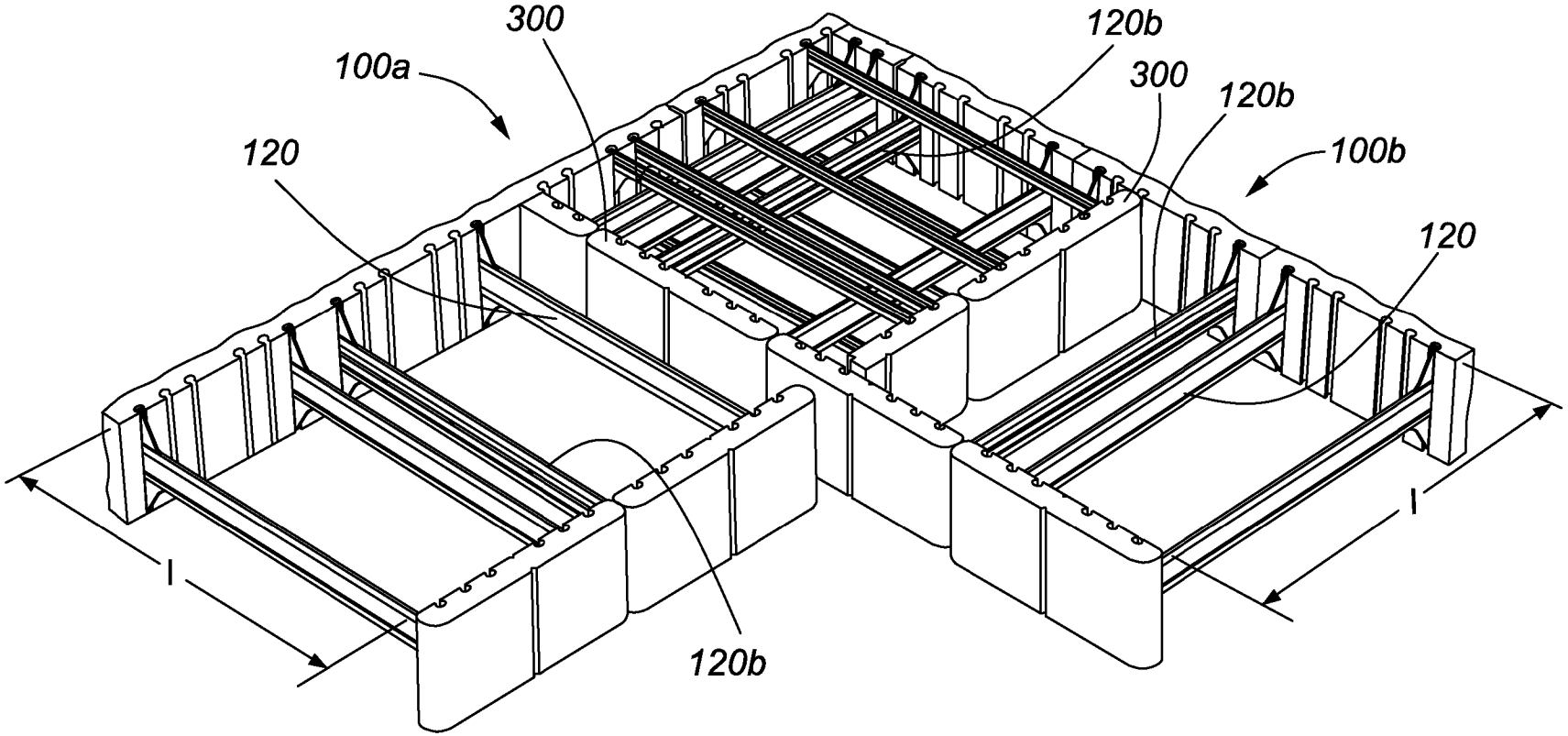
Figure 23D:
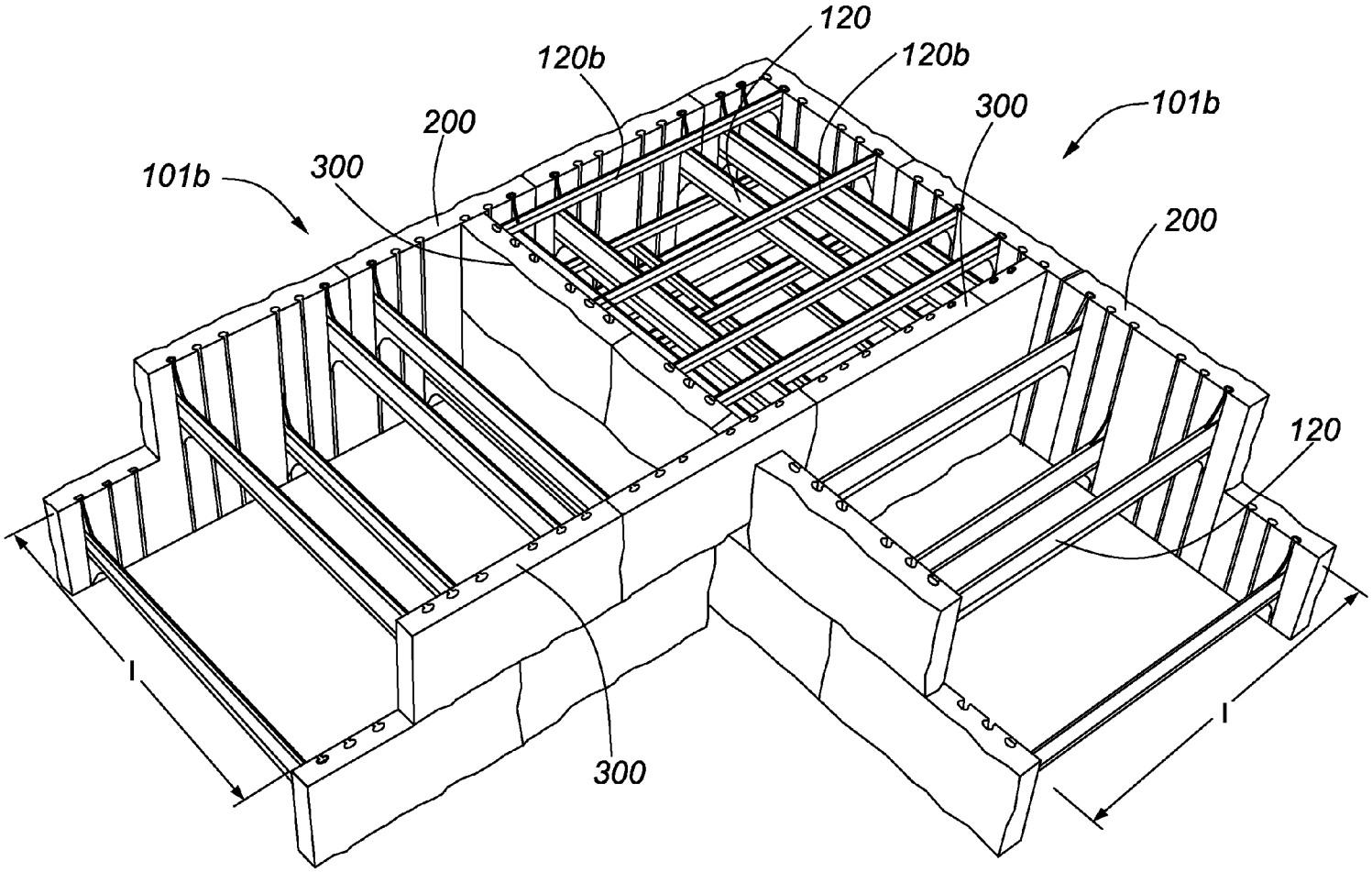
Figure 24A:
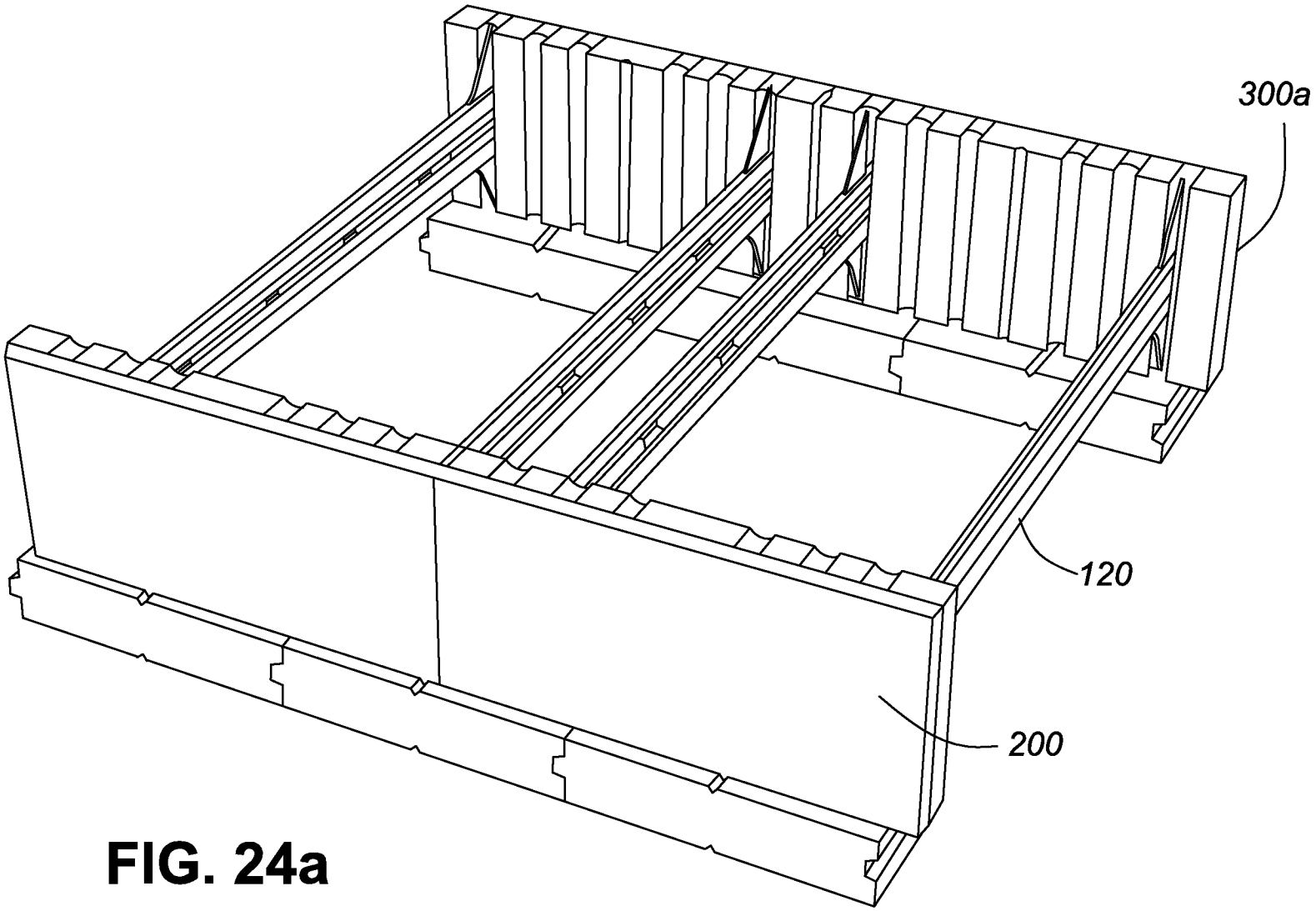
FIGS. 24*a* to 24*d* illustrate a retaining wall with setback.
Figure 24B:
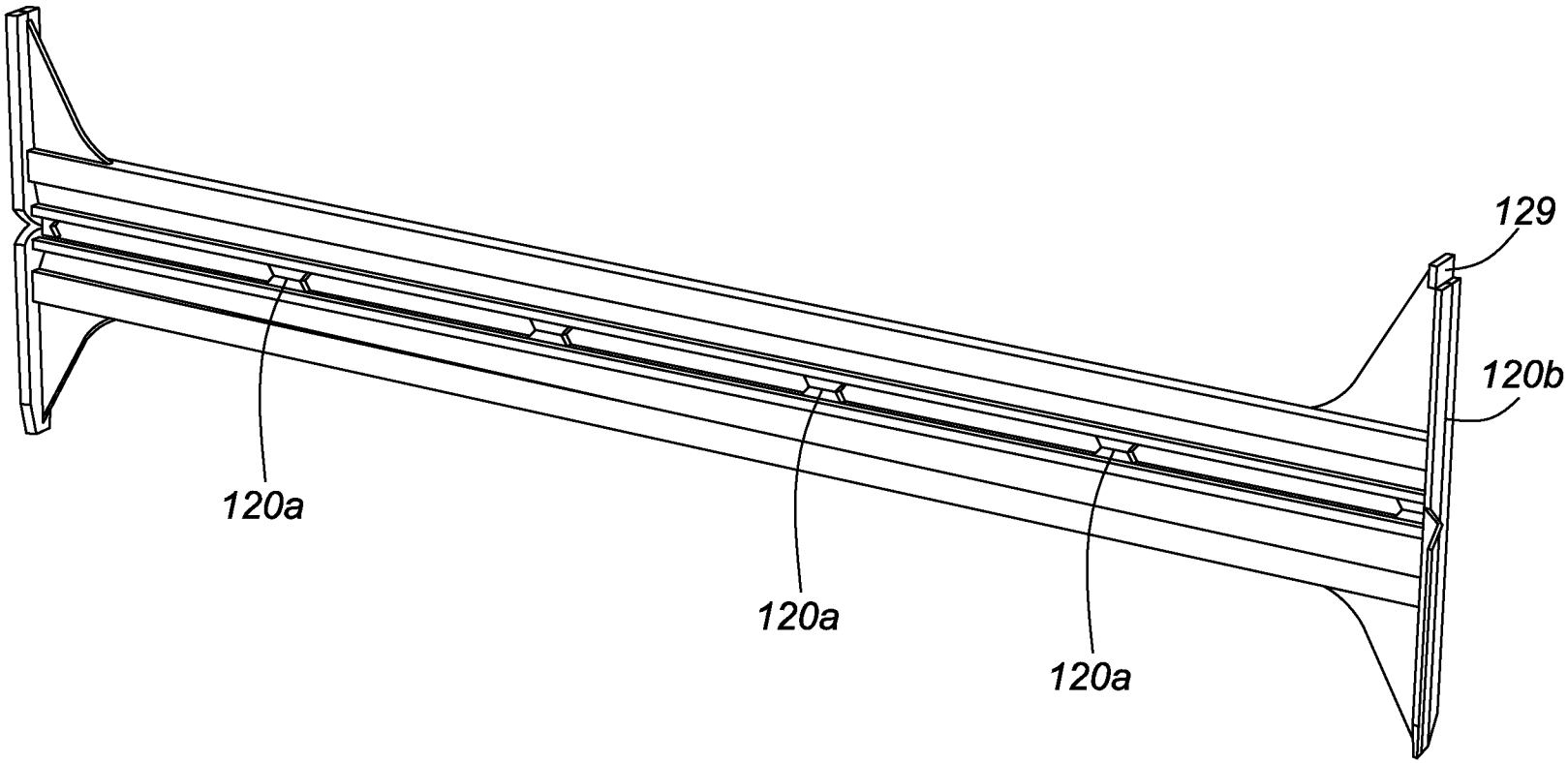

In another embodiment of the corner assembly method, in each row of backer blocks, the row of backer blocks of one of the first and second walls is continuous with the backer block placed within the intermediate space of the other of the first and second walls at the corner. This is illustrated in FIGS. 23*a* and 23*b*, wherein one of the intersecting walls has a continuous row of backer blocks (circled area) which extends all the way to the back surface of the facing block row in the other intersecting wall. The row of backer blocks which is continuous at the corner is preferably alternated between the first and second intersecting walls for consecutive horizontal rows of backer blocks, as illustrated in FIGS. 23*c* and 23*d*. In order to avoid special interference between the intersecting connectors 120 from the first and second intersecting walls at the corner, the connectors are either offset in height so that the connecting ends 122 respectively engage consecutive rows of facing and backer blocks, or special connectors 120*b* are used which can be broken in half. Such a connector 120*b* is shown in FIG. 24*b*, which connector can be split by bending along the connecting tabs 120*a*.

Figure 24C:
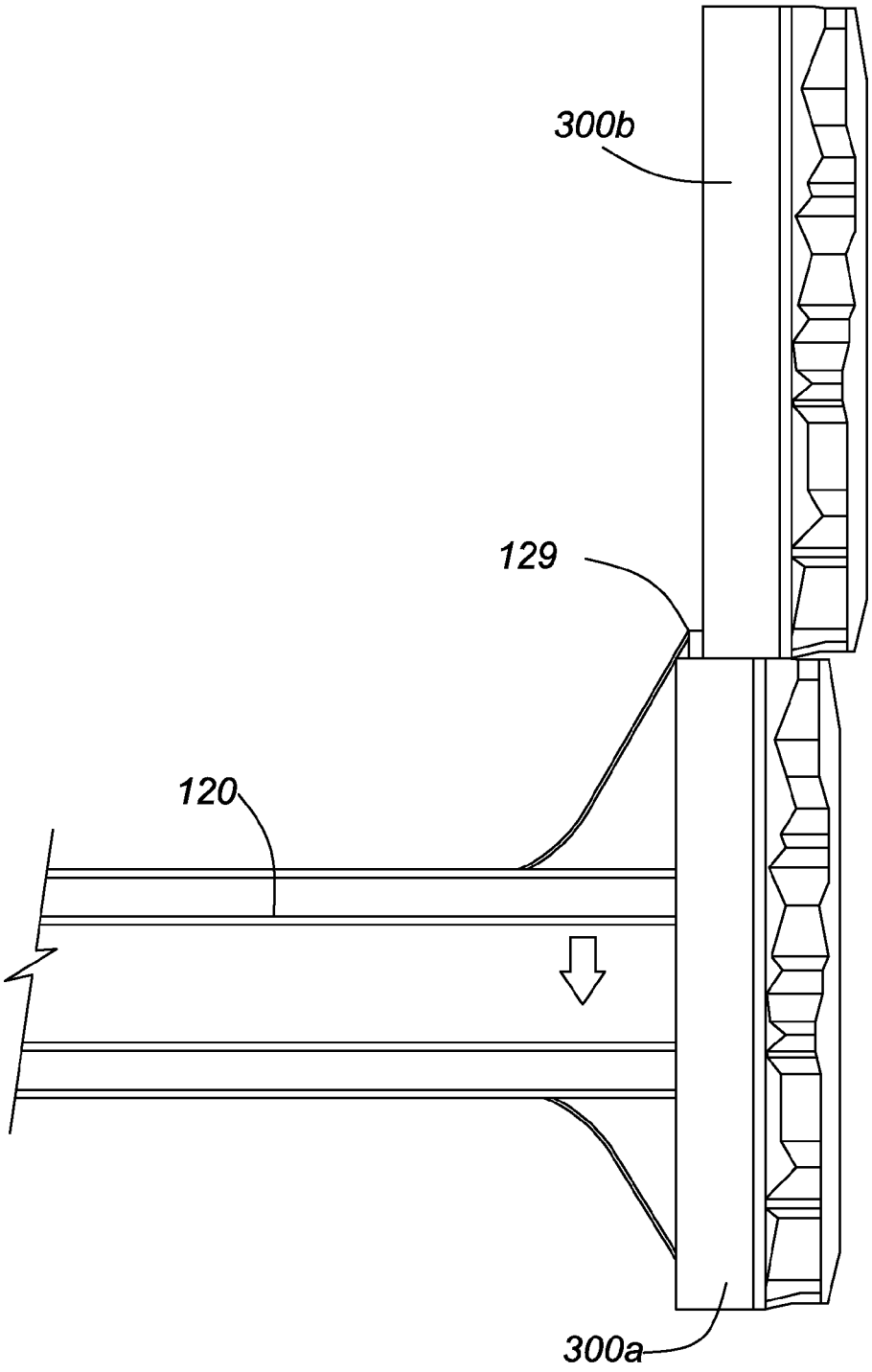
Figure 24D:
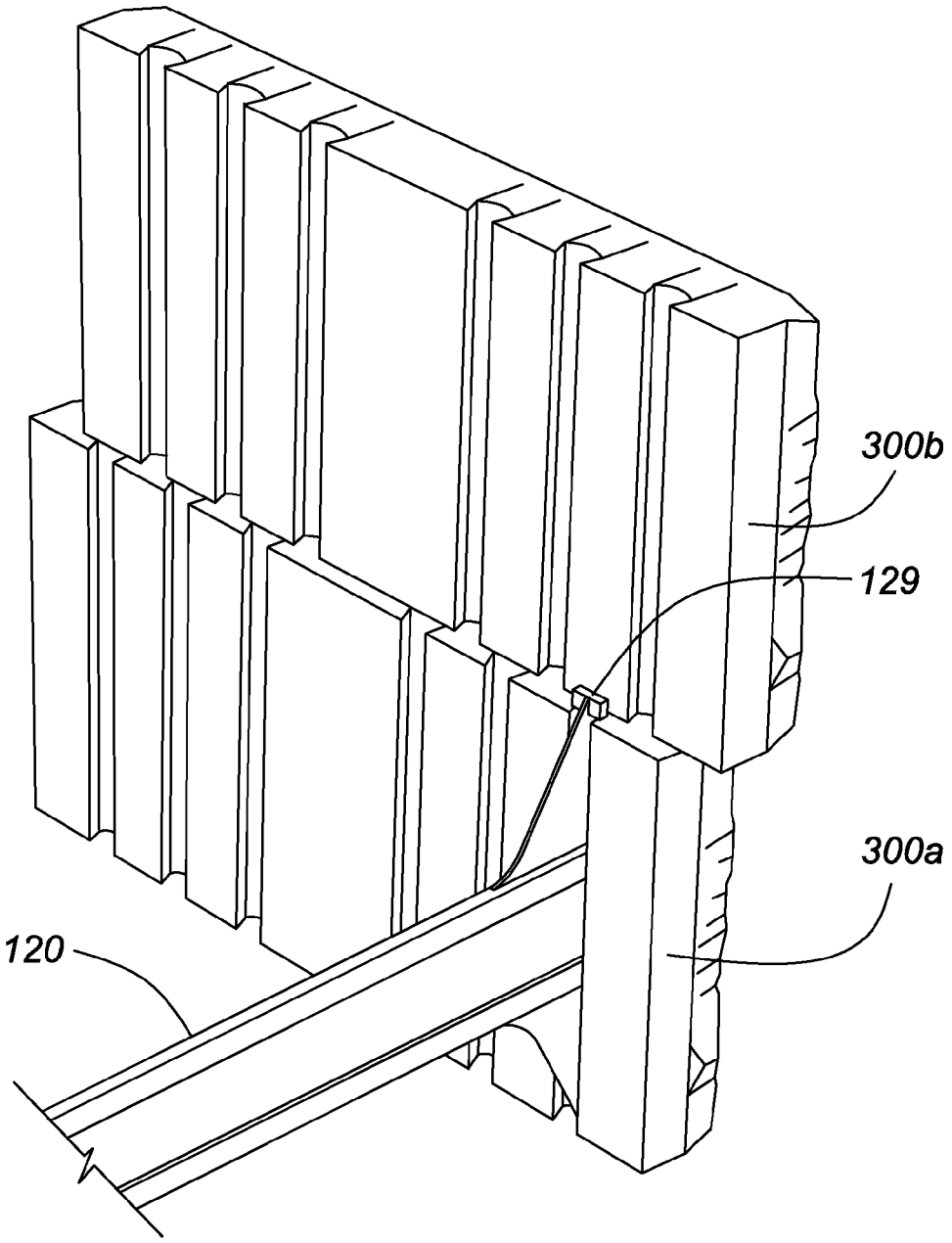

FIGS. 24*a* to 24*d* illustrate a retaining wall with setback, wherein the setback is achieved similar to the manner illustrated in FIGS. 14*a* to 14*f*, except that the setback or offset between consecutive rows of facing and backer blocks is achieved not with a separate setback plug, but with a connector 120 including a setback leg 129 integrated into that end of the connector intended to interlock with the backer block. In the installed condition of the connector as illustrated in FIGS. 24*c* and 24*d*, the connector is interlocked with a first backer block 300*a* and the setback leg 129 engages the rear surface 314 of a second backer block 300*b* stacked on top of the first backer block 300*a*.

While the invention has been described with a certain degree of particularity, it is understood that the invention is not limited to the embodiments set forth herein for purposes of exemplification, but is to be limited only by the scope of the attached claims, including the full range of equivalency to which each element thereof is entitled.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A modular wall system for constructing a freestanding retaining wall for retaining a loose material of a predetermined height, the retaining wall having a rear face for placement against the loose material to be retained, an exposed front face and a predetermined base width and total mass per unit length sufficient for maintaining the retaining wall upright against a pressure exerted by the loose material at the preselected height, the system comprising backer blocks stackable against the loose material and into a continuous rear wall portion of the preselected height, for forming the rear face, the rear wall portion having a first mass;

facing blocks stackable into a continuous front wall portion of the preselected height for forming the front face, the front wall portion having a second mass, a sum of the first and second mass being less than the total mass;

connectors for connecting each facing block in the front wall portion with at least one backer block in the rear wall portion to form an intermediate hollow space of fixed volume between the front and back wall portions, the fixed volume being defined by the preselected height of the retaining wall and a length of the connectors, the intermediate space being separated from the loose material by the rear wall portion;

one or more setback plugs for engagement with the retaining structures to create a setback for facing blocks or backer blocks in consecutive rows; and an amount of loose filler material of a known density for filling the fixed volume, the length of the connectors being selected for a width of the retaining wall being at least equal to the base width and the amount of loose filler material having an overall third mass constituting at least the remainder of the total mass;

wherein the connectors each have a connector body with at least two connecting ends for respective interlocking engagement with a facing block and backer block and each of the facing and backer blocks having multiple spaced apart retaining structures for respectively receiving one of the connecting ends, the connector body being rod or web shaped for minimizing a volume taken up by the connectors in the intermediate space and maximizing a volume of the filler material in the intermediate space.

2. The modular wall system of claim 1, wherein the connectors are constructed to be longitudinally rigid and laterally flexible.

3. The modular wall system of claim 2, wherein the facing blocks have a first width, the backer blocks have a second width, and the connectors have a length exceeding the sum of the first and second width.

4. The modular wall system of claim 3, wherein the retaining structures are one of a retaining protrusion on and a retaining recesses in a back surface of the facing blocks and a back surface of the backer blocks.

5. The modular wall system of claim 4, wherein the retaining recesses are oriented to extend vertical or horizontal in an installed condition of the blocks.

6. The modular wall system of claim 4, wherein the facing blocks have a base width W and the retaining structures in the facing blocks are spaced at 1 W.

7. The modular wall system of claim 6, wherein the retaining structures in the backer blocks are spaced at 1 W or less.

8. The modular wall system of claim 4, wherein the retaining structures are retaining recesses constructed as keyhole slots and each connector has a central portion with opposite, terminally positioned and enlarged terminal portions forming the first and second interlocking members respectively, or the retaining structures are retaining protrusions constructed as dovetail protrusions and each connector has a central portion with opposite terminal portions for respectively interlocking with one of the dovetail protrusions.

9. The modular wall system of claim 8, wherein the central portion is a planar central web and each interlocking member is shaped and constructed for interlocking engagement with a keyhole slot.

10. The modular wall system of claim 2, wherein the connectors have structures for interlocking with the filler material, for locking the wall components in place against lateral pressure of the material to be retained, through interaction between the filler material and the interlocking structures on the connectors.

11. The modular wall system of claim 10, wherein the structures for interlocking are ridges on the connectors and/or transverse passages through the connectors.

12. The modular wall system of claim 11, wherein a degree of interlocking between the structures for interlocking and the filler material is controlled by varying a coarseness of filler material.

13. A kit for constructing a freestanding retaining wall for retaining a loose material of a predetermined height, the retaining wall having a rear face for placement against the loose material to be retained, an exposed front face and a predetermined base width and total mass per unit length sufficient for maintaining the retaining wall upright against a pressure exerted by the loose material at the preselected height, comprising X backer blocks and Y facing blocks, the facing blocks being stackable into a continuous front wall portion and the backer blocks being stackable into a continuous rear wall portion for placement against the material to be retained;

connectors for connecting the backer blocks with the facing blocks in a back to back arrangement for the front and rear wall portions to define an intermediate space for filling with loose filler material when the facing blocks and backer blocks are connected by the connectors in the back to back arrangement, the connectors each having a body with at least two connecting ends for respective interlocking engagement with a facing block and a backer block and each of the facing and backer blocks having multiple spaced apart retaining structures for respectively receiving one of the connecting ends, wherein the connector body is rod or web shaped for minimizing a volume taken up by the connectors in the intermediate space;

instructions for selecting a length of the connectors to adjust a volume of the intermediate space so that a mass of the filler material in the intermediate space together with a mass of the front wall portion and a mass of the rear wall portion adding up to at least the total mass, and for stacking the backer blocks against the material to be retained for the backer blocks to separate the facing blocks, the intermediate space and the loose filler material from the material to be retained;

one or more setback plugs for engagement with the retaining structures to create a setback for facing blocks or backer blocks in consecutive rows; and an amount of loose filler material of a known density, the amount of loose filler material having an overall third mass constituting at least the remainder of the total mass.

14. The kit of claim 13, wherein X and Y are the same and the retaining structures are one of retaining protrusions on and retaining recesses in a back surface of the facing blocks and a surface of the backer blocks.

15. The modular wall system of claim 1, wherein the setback plugs are incorporated into the connectors at the connecting ends.

* * * * *